US008122687B2

(12) United States Patent
Kinigakis et al.

(10) Patent No.: US 8,122,687 B2
(45) Date of Patent: Feb. 28, 2012

(54) METHOD OF MAKING FLEXIBLE PACKAGES HAVING SLIDE CLOSURES

(75) Inventors: Panagiotis Kinigakis, Buffalo Grove, IL (US); Kenneth C. Pokusa, Indian Head Park, IL (US); Kelly E. Arnold, Chicago, IL (US); Harold Marvin Howell, III, Chicago, IL (US); Kenneth Radakovits, Orland Park, IL (US)

(73) Assignee: Kraft Foods Global Brands LLC, Northfield, IL (US)

( * ) Notice: Subject to any disclaimer, the term of this patent is extended or adjusted under 35 U.S.C. 154(b) by 485 days.

(21) Appl. No.: 10/631,630

(22) Filed: Jul. 31, 2003

(65) Prior Publication Data

US 2005/0025394 A1 Feb. 3, 2005

(51) Int. Cl.
*B65B 61/18* (2006.01)

(52) U.S. Cl. ..... 53/412; 53/455; 53/133.4; 53/139.2; 53/562; 493/213

(58) Field of Classification Search ..... 53/139.2, 53/412, 455, 133.2–133.4, 139.4, 562; 493/213, 493/214, 927; 383/64
See application file for complete search history.

(56) References Cited

U.S. PATENT DOCUMENTS 2,994,469 A 8/1961 Troup et al.
(Continued)

FOREIGN PATENT DOCUMENTS

EP 0 443 867 A1 8/1991
(Continued)

OTHER PUBLICATIONS

European Search Report; EP04254460 dated Jul. 1, 2009; 4 pages.
(Continued)

*Primary Examiner* — Stephen F Gerrity
(74) *Attorney, Agent, or Firm* — Fitch, Even, Tabin & Flannery LLP

(57) ABSTRACT

Horizontal form fill seal apparatus for making flexible packages with slider fastener closures is provided. Various types of fastener tracks are applied in-line with a plastic web and are bonded thereto. All package components are brought together at the point of fill. Flexible packages are provided with shrouded and unshrouded slide fastener closures.

11 Claims, 47 Drawing Sheets

U.S. PATENT DOCUMENTS

| | | | | |
|---|---|---|---|---|
| 3,033,257 | A * | 5/1962 | Weber | 53/455 |
| 3,234,614 | A | 2/1966 | Plummer | |
| 3,534,520 | A | 10/1970 | Moran | |
| 3,579,747 | A | 5/1971 | Hawley | |
| 3,660,875 | A | 5/1972 | Gutman | |
| 3,790,992 | A | 2/1974 | Herz | |
| 3,806,998 | A | 4/1974 | Laguerre | |
| 3,819,106 | A | 6/1974 | Schuster | |
| 4,186,786 | A | 2/1980 | Kirkpatrick | |
| 4,262,395 | A | 4/1981 | Kosky | |
| 4,355,494 | A | 10/1982 | Tilman | |
| 4,516,268 | A | 5/1985 | Kamp | |
| 4,534,158 | A | 8/1985 | McClosky | |
| 4,586,319 | A | 5/1986 | Ausnit | |
| 4,601,694 | A | 7/1986 | Ausnit | |
| 4,617,785 | A | 10/1986 | Chikatami et al. | |
| 4,646,511 | A | 3/1987 | Boeckmann et al. | |
| 4,658,433 | A * | 4/1987 | Savicki | 383/63 |
| 4,709,533 | A | 12/1987 | Ausnit | |
| 4,727,709 | A | 3/1988 | Zieke et al. | |
| 4,745,731 | A | 5/1988 | Talbott et al. | |
| 4,812,074 | A | 3/1989 | Ausnit et al. | |
| 4,848,064 | A | 7/1989 | Lems et al. | |
| 4,878,987 | A | 11/1989 | Ven Erden | |
| 4,894,975 | A | 1/1990 | Ausnit | |
| 4,903,841 | A | 2/1990 | Ohsima et al. | |
| 4,909,017 | A | 3/1990 | McMahon et al. | |
| 4,945,714 | A | 8/1990 | Bodolay et al. | |
| 5,010,627 | A | 4/1991 | Herrington et al. | |
| 5,014,489 | A | 5/1991 | Terminella et al. | |
| 5,014,498 | A | 5/1991 | McMahon | |
| 5,014,499 | A | 5/1991 | Boeckmann | |
| 5,020,194 | A | 6/1991 | Herrington et al. | |
| 5,036,643 | A * | 8/1991 | Bodolay | 53/562 |
| 5,067,208 | A * | 11/1991 | Herrington et al. | 24/400 |
| 5,080,747 | A | 1/1992 | Veix | |
| 5,088,971 | A | 2/1992 | Herrington | |
| 5,127,208 | A | 7/1992 | Custer et al. | |
| 5,131,121 | A | 7/1992 | Herrington et al. | |
| 5,140,796 | A | 8/1992 | Pope | |
| 5,141,795 | A | 8/1992 | Kai et al. | |
| 5,167,107 | A | 12/1992 | Terminella et al. | |
| 5,179,816 | A * | 1/1993 | Wojnicki | 53/133.4 |
| 5,186,543 | A | 2/1993 | Cochran | |
| 5,189,764 | A | 3/1993 | Herrington et al. | |
| 5,238,306 | A | 8/1993 | Heintz et al. | |
| 5,247,781 | A | 9/1993 | Runge | |
| 5,283,932 | A | 2/1994 | Richardson et al. | |
| 5,301,395 | A | 4/1994 | Richardson et al. | |
| 5,322,579 | A | 6/1994 | Van Erden | |
| 5,400,565 | A | 3/1995 | Terminella et al. | |
| RE34,905 | E | 4/1995 | Ausnit | |
| 5,405,478 | A | 4/1995 | Richardson et al. | |
| 5,417,035 | A | 5/1995 | English | |
| 5,442,837 | A | 8/1995 | Morgan | |
| 5,482,375 | A | 1/1996 | Richardson et al. | |
| 5,492,411 | A | 2/1996 | May | |
| 5,505,037 | A | 4/1996 | Terminella et al. | |
| 5,519,982 | A | 5/1996 | Herber et al. | |
| 5,525,363 | A | 6/1996 | Herber et al. | |
| 5,561,966 | A | 10/1996 | English | |
| 5,564,259 | A | 10/1996 | Stolmeier | |
| 5,664,299 | A | 9/1997 | Porchia et al. | |
| 5,664,406 | A | 9/1997 | Smith | |
| 5,669,715 | A | 9/1997 | Dobreski et al. | |
| 5,687,549 | A | 11/1997 | Jostler et al. | |
| 5,713,669 | A | 2/1998 | Thomas et al. | |
| 5,722,128 | A | 3/1998 | Toney et al. | |
| 5,725,312 | A | 3/1998 | May | |
| 5,733,045 | A | 3/1998 | Jostler et al. | |
| 5,743,070 | A | 4/1998 | Lerner et al. | |
| 5,746,043 | A | 5/1998 | Terminella et al. | |
| 5,768,852 | A | 6/1998 | Terminella et al. | |
| 5,769,772 | A | 6/1998 | Wiley | |
| 5,775,812 | A | 7/1998 | Phillips et al. | |
| 5,776,045 | A | 7/1998 | Bodolay et al. | |
| 5,826,401 | A | 10/1998 | Bois | |
| 5,836,056 | A | 11/1998 | Porchia et al. | |
| 5,845,465 | A | 12/1998 | Bennett | |
| 5,845,466 | A | 12/1998 | Laudenberg | |
| 5,871,281 | A | 2/1999 | Stolmeier et al. | |
| 5,878,549 | A | 3/1999 | Littmann et al. | |
| 5,884,452 | A | 3/1999 | Bois | |
| 5,904,425 | A | 5/1999 | May | |
| 5,906,438 | A | 5/1999 | Laudenberg | |
| 5,924,173 | A | 7/1999 | Dobreski et al. | |
| 5,930,983 | A | 8/1999 | Terminella et al. | |
| 5,937,615 | A | 8/1999 | Forman | |
| 5,938,337 | A | 8/1999 | Provan et al. | |
| 5,947,603 | A | 9/1999 | Tilman | |
| 5,950,285 | A | 9/1999 | Porchia et al. | |
| 5,956,815 | A | 9/1999 | O'Connor et al. | |
| 5,956,924 | A | 9/1999 | Thieman | |
| 5,983,594 | A | 11/1999 | Forman | |
| 5,985,384 | A | 11/1999 | Shibata | |
| 5,996,187 | A | 12/1999 | Tanaka et al. | |
| 6,000,197 | A | 12/1999 | Ausnit | |
| 6,029,428 | A | 2/2000 | Terminella et al. | |
| 6,036,364 | A | 3/2000 | Heuvel | |
| 6,044,621 | A | 4/2000 | Malin et al. | |
| 6,047,450 | A | 4/2000 | Machacek et al. | |
| 6,047,521 | A | 4/2000 | Terminella et al. | |
| 6,071,011 | A | 6/2000 | Thomas et al. | |
| 6,088,887 | A | 7/2000 | Bois | |
| 6,131,369 | A | 10/2000 | Ausnit | |
| 6,131,370 | A | 10/2000 | Ausnit | |
| 6,138,436 | A | 10/2000 | Malin et al. | |
| 6,138,439 | A | 10/2000 | McMahon et al. | |
| 6,139,662 | A | 10/2000 | Forman | |
| 6,148,588 | A | 11/2000 | Thomas et al. | |
| 6,149,302 | A | 11/2000 | Taheri | |
| 6,161,271 | A | 12/2000 | Schreiter | |
| 6,178,722 | B1 | 1/2001 | McMahon | |
| 6,183,134 | B1 | 2/2001 | Malin | |
| 6,185,907 | B1 | 2/2001 | Malin et al. | |
| 6,186,663 | B1 | 2/2001 | Ausnit | |
| 6,199,351 | B1 | 3/2001 | Mount | |
| 6,209,287 | B1 | 4/2001 | Thieman | |
| 6,212,857 | B1 | 4/2001 | Van Erden | |
| 6,216,423 | B1 * | 4/2001 | Thieman | 53/412 |
| 6,219,993 | B1 | 4/2001 | Linkiewicz | |
| 6,220,754 | B1 | 4/2001 | Stiglic et al. | |
| 6,224,262 | B1 | 5/2001 | Hogan et al. | |
| 6,244,021 | B1 | 6/2001 | Ausnit et al. | |
| 6,244,746 | B1 | 6/2001 | Tokito et al. | |
| 6,270,256 | B1 | 8/2001 | Todman | |
| 6,273,607 | B1 | 8/2001 | Buchman | |
| 6,286,189 | B1 | 9/2001 | Provan et al. | |
| 6,287,000 | B1 | 9/2001 | Buchman | |
| 6,287,001 | B1 | 9/2001 | Buchman | |
| 6,290,390 | B1 | 9/2001 | Buchman | |
| 6,290,391 | B1 | 9/2001 | Buchman | |
| 6,290,393 | B1 | 9/2001 | Tomic | |
| 6,292,986 | B1 | 9/2001 | Provan et al. | |
| 6,293,896 | B1 | 9/2001 | Buchman | |
| D451,378 | S | 12/2001 | Kinigakis et al. | |
| 6,327,754 | B1 | 12/2001 | Belmont et al. | |
| 6,327,837 | B1 * | 12/2001 | Van Erden | 53/412 |
| 6,347,885 | B1 | 2/2002 | Buchman | |
| 6,354,738 | B1 * | 3/2002 | Buckman et al. | 383/64 |
| 6,357,914 | B1 | 3/2002 | Kinigakis et al. | |
| 6,360,513 | B1 * | 3/2002 | Strand et al. | 53/412 |
| 6,363,692 | B2 | 4/2002 | Thieman | |
| 6,364,530 | B1 | 4/2002 | Buchman | |
| 6,378,177 | B1 | 4/2002 | Athans et al. | |
| 6,389,780 | B1 | 5/2002 | Coomber et al. | |
| 6,412,254 | B1 * | 7/2002 | Tilman et al. | 53/412 |
| 6,422,987 | B1 * | 7/2002 | Hamm | 493/214 |
| 6,427,421 | B1 * | 8/2002 | Belmont et al. | 53/412 |
| 6,438,926 | B1 | 8/2002 | Thieman | |
| 6,449,924 | B2 | 9/2002 | McMahon et al. | |
| 6,470,551 | B1 | 10/2002 | Provan et al. | |
| 6,474,045 | B2 | 11/2002 | McMahon et al. | |
| 6,477,821 | B1 | 11/2002 | Bois | |
| 6,481,183 | B1 | 11/2002 | Schmidt | |
| D467,170 | S | 12/2002 | Kinigakis et al. | |
| 6,499,272 | B2 | 12/2002 | Thieman | |

| | | | | |
|---|---|---|---|---|
| D468,629 | S | 1/2003 | Arnold et al. | |
| 6,517,242 | B1 * | 2/2003 | Buchman | 493/213 |
| D471,088 | S | 3/2003 | Kinigakis et al. | |
| 6,526,727 | B2 * | 3/2003 | McMahon et al. | 53/412 |
| 6,595,690 | B2 * | 7/2003 | Machacek | 383/203 |
| 6,609,353 | B1 * | 8/2003 | McMahon et al. | 53/412 |
| 6,616,333 | B2 | 9/2003 | Kinigakis et al. | |
| D484,040 | S | 12/2003 | Kinigakis et al. | |
| 6,675,558 | B2 | 1/2004 | Kinigakis et al. | |
| 6,688,080 | B2 | 2/2004 | Kinigakis et al. | |
| 6,769,229 | B2 | 8/2004 | Kinigakis et al. | |
| 6,830,377 | B2 * | 12/2004 | Schneider | 383/64 |
| 6,834,474 | B2 | 12/2004 | Dutra et al. | |
| 6,863,646 | B2 * | 3/2005 | Kinigakis et al. | 493/213 |
| 6,884,207 | B2 | 4/2005 | Pokusa | |
| 6,910,805 | B2 * | 6/2005 | Johnson | 383/64 |
| 6,910,806 | B2 | 6/2005 | Strand et al. | |
| 6,939,041 | B2 | 9/2005 | Kinigakis et al. | |
| 6,974,256 | B2 | 12/2005 | Kinigakis et al. | |
| 6,986,377 | B2 * | 1/2006 | Johnson et al. | 493/213 |
| 2001/0001164 | A1 | 5/2001 | Van Erden | |
| 2001/0017950 | A1 | 8/2001 | Strand et al. | |
| 2001/0039235 | A1 | 11/2001 | Buchman | |
| 2001/0039783 | A1 | 11/2001 | McMahon et al. | |
| 2001/0042357 | A1 | 11/2001 | McMahon et al. | |
| 2001/0045083 | A1 | 11/2001 | McMahon et al. | |
| 2001/0053253 | A1 | 12/2001 | Buchman et al. | |
| 2002/0017078 | A1 | 2/2002 | Thieman | |
| 2002/0064320 | A1 | 5/2002 | May | |
| 2002/0064321 | A1 | 5/2002 | Schreiter | |
| 2002/0064322 | A1 | 5/2002 | May | |
| 2002/0068668 | A1 | 6/2002 | Chow et al. | |
| 2002/0118896 | A1 | 8/2002 | Forman | |
| 2002/0134046 | A1 | 9/2002 | Bois | |
| 2002/0134050 | A1 | 9/2002 | Thieman | |
| 2002/0150313 | A1 | 10/2002 | Bois | |
| 2002/0152719 | A1 | 10/2002 | Kinigakis et al. | |
| 2002/0152720 | A1 | 10/2002 | Kinigakis et al. | |
| 2002/0173414 | A1 | 11/2002 | Leighton | |
| 2002/0178556 | A1 | 12/2002 | McMahon et al. | |
| 2002/0184858 | A1 | 12/2002 | Ausnit et al. | |
| 2002/0194818 | A1 | 12/2002 | Thieman | |
| 2002/0196987 | A1 | 12/2002 | Tilman et al. | |
| 2003/0172622 | A1 | 9/2003 | Kinigakis et al. | |
| 2003/0219176 | A1 | 11/2003 | Kocher et al. | |

FOREIGN PATENT DOCUMENTS

| | | |
|---|---|---|
| EP | 0608123 | 7/1994 |
| EP | 1 164 087 A2 | 12/2001 |
| EP | 1251075 | 10/2002 |
| EP | 1367000 | 12/2003 |
| JP | 55-89068 | 7/1980 |
| JP | 61-259959 | 11/1986 |
| JP | 01-226556 | 9/1989 |
| JP | 04-173510 | 6/1992 |
| JP | 4-215954 | 8/1992 |
| JP | 5-91909 | 4/1993 |
| JP | 5-91910 | 4/1993 |
| JP | 7-112746 | 5/1995 |
| JP | 7-187202 | 7/1995 |
| JP | 9-216642 | 8/1997 |
| JP | 10-706 | 1/1998 |
| JP | 10-501714 | 2/1998 |
| JP | 10-503672 | 4/1998 |
| JP | 10-147352 | 6/1998 |
| JP | 10-203539 | 8/1998 |
| JP | 11-20051 | 1/1999 |
| JP | 11-157553 | 6/1999 |
| JP | 11-314648 | 11/1999 |
| WO | WO 98/24704 | 6/1998 |
| WO | WO 98/45180 | 10/1998 |
| WO | 0194221 | 12/2001 |
| WO | WO 01/96195 | 12/2001 |

OTHER PUBLICATIONS

European Search Opinion; EP04254460 dated Aug. 18, 2010; 6 pages.

* cited by examiner

METHOD OF MAKING FLEXIBLE PACKAGES HAVING SLIDE CLOSURES

BACKGROUND OF THE INVENTION

1. Field of the Invention

The present invention pertains to flexible packages, such as plastic bags, and in particular to packages having fastener closures employing sliders.

2. Description Of The Related Art

With the recent emphasis in providing consumers with bulk quantities of various commodities, such as food products, reclosable packages have become increasingly popular. One of the most popular means of providing reclosability is to employ zippers of various types, particularly zippers which are compatible with flexible packages of plastic film construction. Manufacturers of food products and other commodities are concerned with filling the contents of a flexible package as quickly and economically as possible. It is important that the opening provided by the fastener be made as large as practically possible. Consumers or other end users also prefer large sized openings for easy extraction of products from the package interior. Even with large openings, however, products within the package may interfere with fastener operation when product poured or otherwise dispensed from the package becomes entrained in the fastener components.

Other improvements to flexible reclosable packages are being sought. For example, when handling products comprised of numerous small pieces, such as shredded cheese or cereal, for example, it is generally desirable to have the package formed into a pouch which is open at one end, or along one side, so as to allow product to be poured or shaken through the reclosable opening. It is desirable that the product be allowed to freely flow past the reclosable opening. Preferably, the path taken by the product within the package should be made as smooth as possible.

Although improvements have been made in the art of plastic welding and joining, manufacturers of consumer products employing high speed production techniques are continually seeking improved package forming methods and equipment.

SUMMARY OF THE INVENTION

The invention provides improved shrouded and unshrouded flexible packages.

One embodiment of the invention relates to a method and apparatus for forming, filling and sealing food packaging on automated in-line equipment wherein web material is reverse folded to form a folded web top and a folded web bottom with a serial succession of folded package portions downwardly depending from the web top which comprises a dead fold. After side seals are provided to form a serial succession of pouches, the dead fold at the upper end is slit to form a fill opening. After filling the upper portion is sealed to enclose product within the pouch.

Another embodiment of the invention relates to a reclosable flexible package including opposed front and rear panels in interlockable first and second fastener tracks. The fastener tracks include a first track with a shorter flange mated to a second track with a longer flange which includes a reverse fold. Free edges of the reverse fold of the longer flange and the free edge of the shorter flange are separated by a gap. The package includes a slider movable along the fastener tracks and an optional shroud covering the slider. Preferably, the mated fastener tracks are provided from a roll of continuous track material which is later crushed at spaced apart portions to form a series of spaced apart back-to-back slider stop portions.

A further embodiment of the invention relates to a reclosable flexible package in which opposed front and rear panels are joined to first and second interlockable fastener tracks. The slider is movable along the fastener tracks for closing and opening. A shroud covers the slider and at least a portion of the fastener tracks and a weakening portion in the shroud, generally coextensive with the fastener tracks, severs an upper portion of the shroud for removal. A hinged panel is provided in a lower portion of the shroud and includes a hinge line generally coextensive with and generally below the fastener tracks. With severing of the shroud portions, the hinge panel is exposed, free for downward folding about the hinge line so as to expose the fastener tracks.

DETAILED DESCRIPTION OF THE PREFERRED EMBODIMENTS

Figure 1:
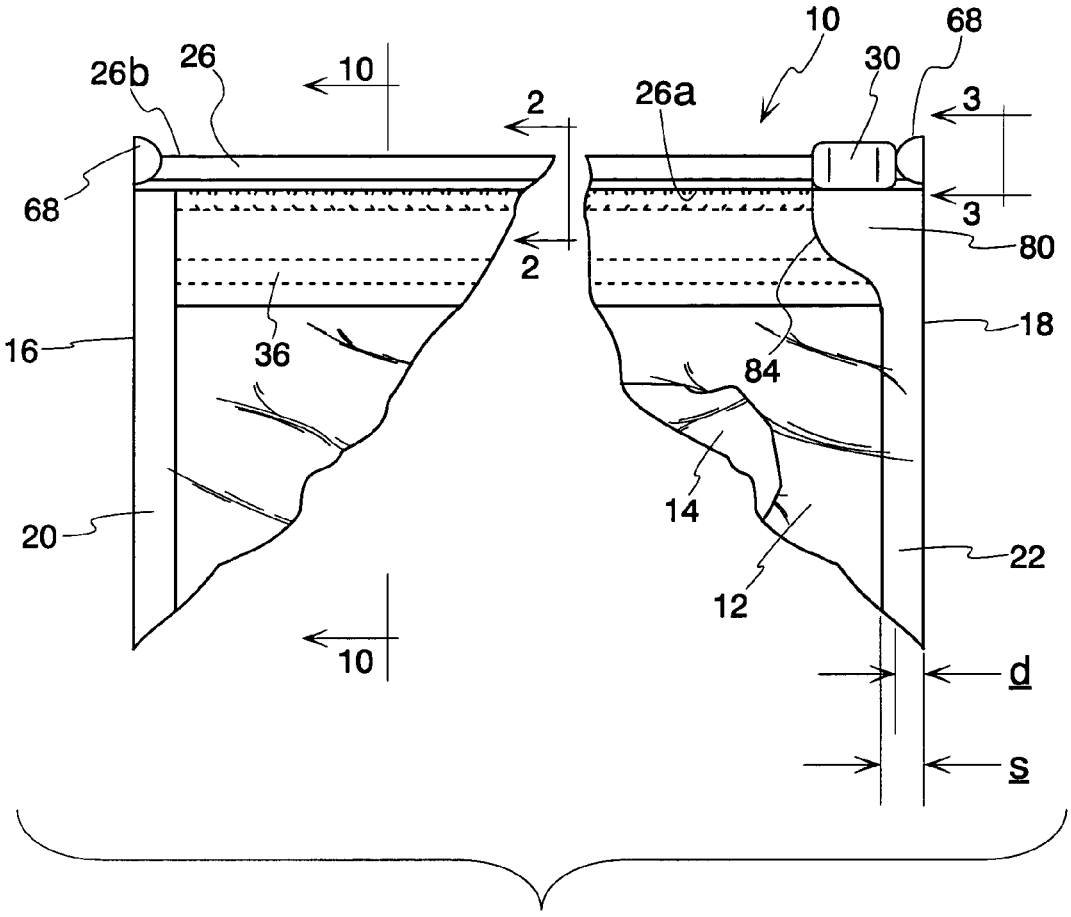
FIG. 1 is a fragmentary front elevational view of a flexible package according to principles of the present invention.

Referring now to the drawings and initially to FIGS. 1-8, a flexible package is generally indicated at 10. The terms "package" and "bag," are used interchangeably and are not intended to refer to any relative size of the finished item.

Flexible package 10 preferably comprises a plastic bag having front and back panels 12, 14 joined together at the left end by a side seal 20 and at the right end by a side seal 22. Side seal 20 is preferably of conventional conduction heat-sealed construction, having a generally constant width throughout. If desired, side seal 20 can be employed on both sides of the flexible package. A fold line with panels 12, 14 is formed from a continuous sheet of plastic material, or with a conventional gusseted bottom construction.

Figure 2:
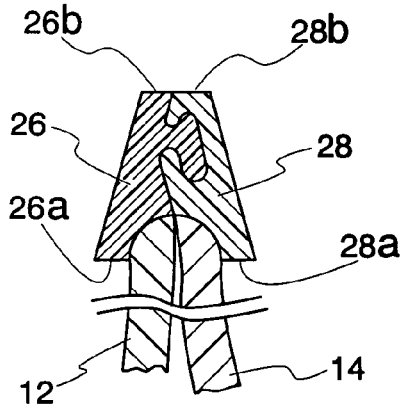
FIG. 2 is a fragmentary cross-sectional view taken along the line 2-2 of FIG. 1.

The upper end of flexible package 10 features a reclosable opening including a slide fastener arrangement with fastener tracks 26, 28 and a slider 30, all preferably of polyolefin material. The slider 30 is slidable along the fastener tracks, causing the fastener tracks to interlock or mate (as shown in FIG. 2) for closure of the flexible package and to unmate or separate to open the flexible package for access to contents in the package interior. FIG. 2 shows the upper portion of a pair of mated fastener tracks. As will be seen herein, lower portions of the fastener tracks include flanges of various constructions, including flanges of unequal length, flanges of equal length joined at their lower ends, and flanges of unequal lengths where the longer flange has a reverse fold. As will be seen herein, features associated with the fastener slider arrangement allow an unprecedented enlarged opening of the flexible package. The enlarged package opening made possible by the present invention benefits manufacturers filling the package, as well as consumers dispensing product from the interior of the flexible package. In the preferred embodiment shown, the fastener tracks are also referred to as "zipper" tracks.

These and other flexible packages according to principles of the present invention have found immediate commercial acceptance for use with food products, including perishable food products, such as cheese. Accordingly, it is generally preferred that the flexible package includes a hermetic seal 36 in the form of a peelable seal as taught in commonly assigned U.S. Pat. Nos. 5,014,856; 5,107,658 and 5,050,736, the disclosures of which are incorporated by reference as if fully set forth herein.

Figure 3:
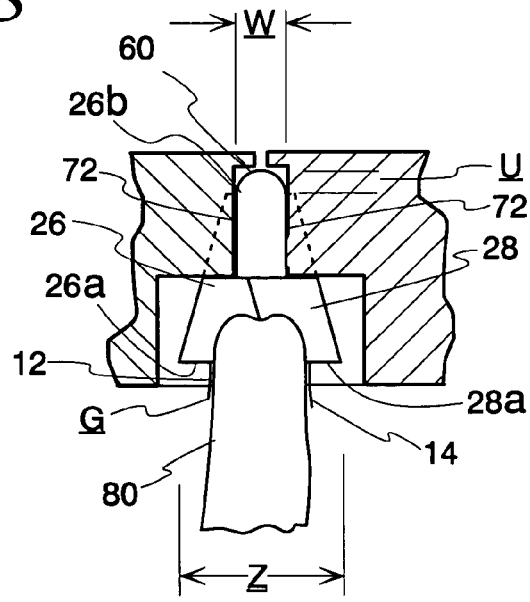
FIG. 3 is a fragmentary end view indicated by line 3-3 of FIG. 1.

As mentioned above, flexible package 10 preferably comprises a bag having panels 12, 14 formed from plastic sheet material. The sheet material can be of a single material type, such as polyolefin materials including polyethylene and polypropylene, but preferably comprises a laminate assembly of several different material types, as is known in the art to provide a barrier to moisture as well as certain gases, such as oxygen or inert fillers of the types used with food products. Other types of laminate films, such as those known in the art to preserve food freshness, may be employed. Where the contents of the flexible package are not perishable or where other considerations may dictate, the panels 12, 14 can be constructed without regard to gas or vapor barrier properties. FIGS. 2 and 3 indicate that it is generally preferred that the fastener tracks be joined to web-like flanges which, in turn, are joined to panels 12, 14 as will be described below with reference to FIG. 10.

Referring now to FIGS. 5-8, fastener slider 30 has a top wall 44, a shorter side wall 46 and a longer side wall 48, cooperating to define an internal cavity 50 for receiving the fastener tracks 26, 28. As can be seen by comparing the end views of FIGS. 7 and 8, a first end 54 of the slider defines a cavity which is generally rectangular. The opposed end 56 (shown in FIG. 8) defines a cavity which is generally arrowhead or A-shaped, as indicated by reference numeral 50*b*, conforming to the outline of the interlocked fastener tracks shown in FIG. 2. When the slider 30 of FIG. 1 is moved to the right, end 56 is at the leading end of the slider and the fastener tracks 26, 28 are unlocked, thus opening the flexible package 10. Conversely, as slider 30 of FIG. 1 is moved to the left, end 54 (shown in FIG. 7) is made the leading end, and fastener tracks 26, 28 are interlocked in the manner indicated in FIG. 2, to close the flexible package.

Referring again to FIGS. 2, 7 and 8, a number of features cooperate to maintain slider 30 captive on fastener tracks 26, 28. As can be seen for example in FIG. 8, a pair of upwardly facing stepped portions 62 are formed on either side of the slider cavity. Inwardly extending protrusions 64 are located at the other end of the slider. Protrusions 64 and stepped portions 62 engage the bottoms 26*a* and 28*a* (see FIG. 2) of fastener tracks 26, 28, as can be seen for example in FIG. 10. The engagement of the stepped portions 62 and the protrusions 64 with the bottoms of the fastener tracks prevents the slider from being upwardly dislocated from the fastener tracks.

Figure 13:
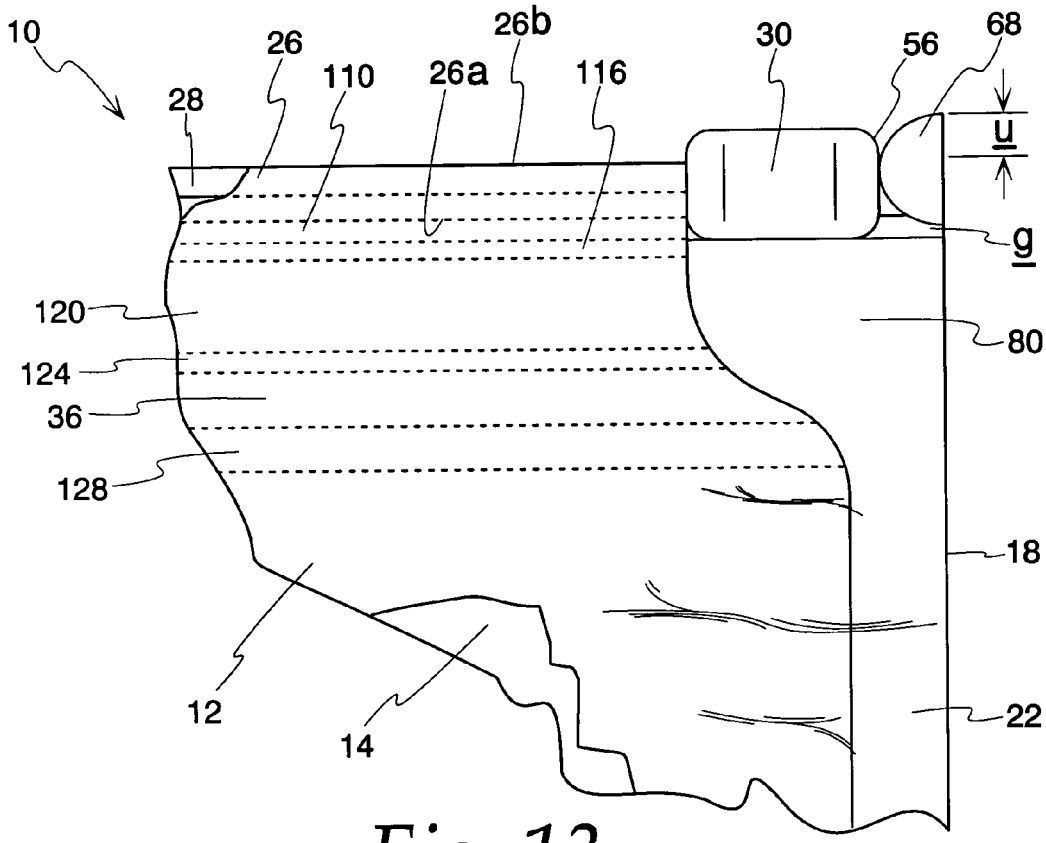
FIG. 13 is a fragmentary front elevational view of another flexible package according to principles of the present invention.

Referring to FIGS. 1, 3 and 13, the ends of the fastener tracks are deformed or "crushed" to form stops 68. Preferably, stops 68 are formed by the application of ultrasonically generated heat and pressure to the ends of fastener tracks 26, 28. It has been found that the use of present day conduction heat sealing techniques does not provide the control needed to attain the intricate, close tolerance design of stop members according to principles of the present invention. Further, it has been found that the use of present day conduction heat sealing techniques immediately adjacent previously formed stop members tends to distort the stop members, oftentimes to an extent rendering the stop members unacceptable from a quality control standpoint. As will be seen herein, stops 68 are configured for maximum efficiency, having the smallest front elevational surface area (i.e., the surface area visible in FIGS. 1 and 13, for example), which is adequate for containing slider 30 on the fastener tracks.

Referring to FIG. 3, the sides of the fastener tracks are softened and compressed at stop faces or sides 72 so as to impart a pre-selected width w and an upwelling displacement u above the upper surfaces 26*b*, 28*b* of fastener tracks 26, 28 (see FIG. 2). The material displaced above the upper surface of the fastener tracks interferes with the top wall 44 and ends of slider 30 to limit its sideways travel.

With reference to FIG. 3, the slider stop 68 (that is, the deformed portion of fastener tracks 26, 28) is carefully configured so as to avoid deformation of the bottom surfaces 26*a*, 28*a* of the fastener tracks. With reference to FIG. 1, the lower ends of the fastener tracks extend undeformed, substantially to the side edges 16, 18 of the flexible package 10. FIG. 1 shows slider 30 "parked" at a fully opened position, with end 56 contacting the stop 68 located at the right-hand end 22 of the flexible package. Stop members 68 and the undisturbed bottom surfaces 26*a*, 28*a* of the fastener tracks in the area of stop members 68 cooperate to captivate slider 30 on the fastener tracks, preventing its unintentional removal from flexible package 10.

It is preferred that the bottom edges 26*a*, 28*a* remain undeformed also for that portion extending beyond slider 30, and underneath at least a portion of the right hand stop 68. With reference to FIG. 3, a gap g is formed between the bottom edges of the fastener tracks and the top portion 81 of side seal 22. As can be clearly seen in FIG. 3, the stop 68, formed by ultrasonic techniques, is separated by a substantial distance from the side seal, which is typically formed using conduction heat seal techniques found to be incompatible with the precise, high resolution ultrasonic techniques used to form stop 68. A second stop 68 formed at the left-hand end 16 of flexible package 10 is constructed in a similar fashion and extends beyond the end 54 of slider 30 when the slider is moved fully to the left, closing the upper end of the flexible package. As will be explained in greater detail herein, separation of the "crush" operation performed on the fastener tracks to form stops 68 from the conduction heat sealing operation to form the enlarged side seals, allows stops 68 to take on a reduced size, effectively extending the size of the package opening, without sacrificing ability of the stops to effectively retain slider 30 on the fastener tracks.

Figure 4:
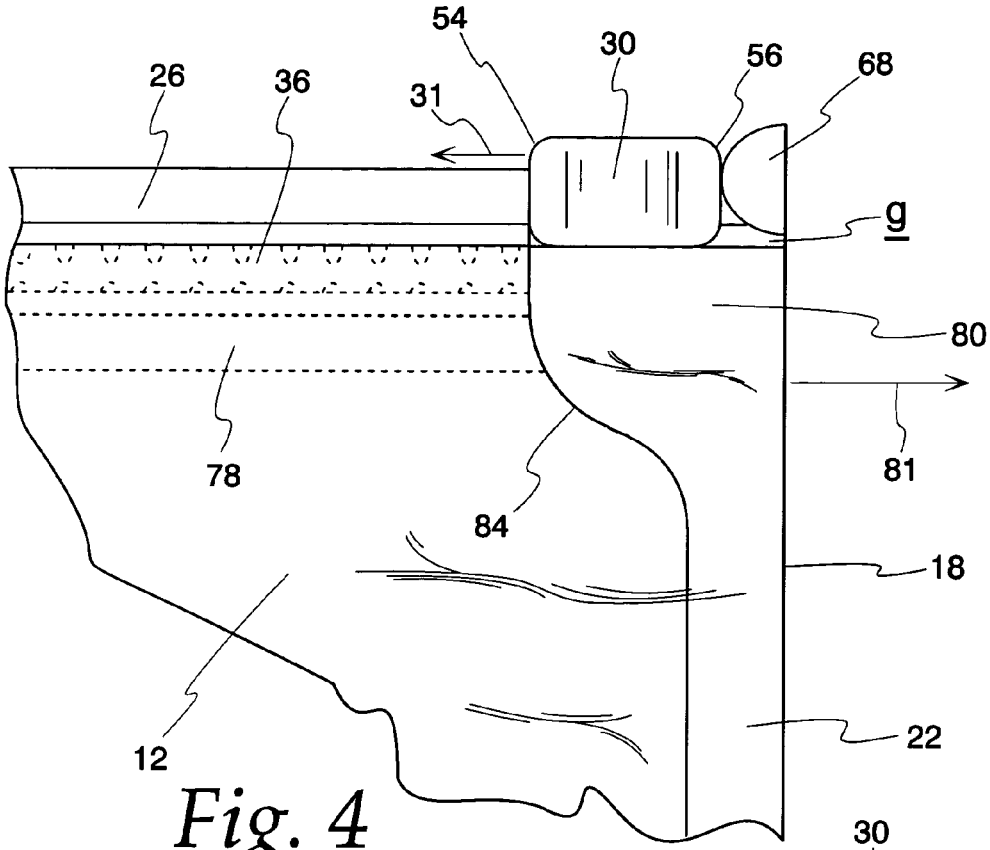
FIG. 4 is fragmentary front elevational view showing construction of the flexible package.
Figure 5:
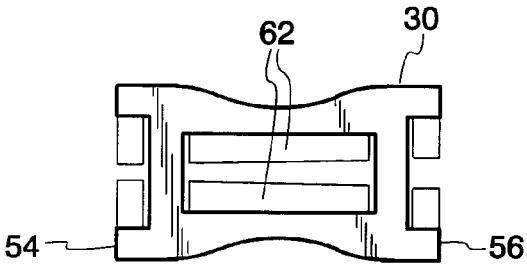
FIG. 5 is a top plan view of the slider member.
Figure 6:
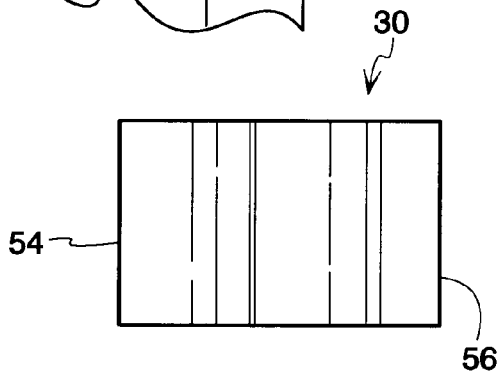
FIG. 6 is a front elevational view thereof.
Figure 7:
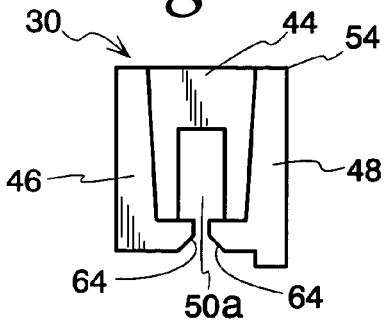
FIG. 7 is an elevational view from one end thereof.
Figure 8:
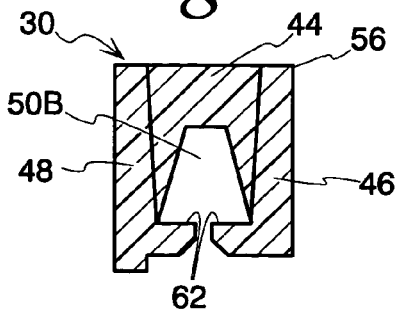
FIG. 8 is an elevational view from the other end thereof.

Referring to FIGS. 1 and 4, side seal 22 includes an upper enlarged or tapered portion 80 having a width substantially greater than the lower end of side seal 22, sufficient to underlie the substantial entirety of slider 30 when the slider is fully moved to the "parked" position as shown in FIG. 1. The width of the enlarged, tapered portion 80 ranges between 200% and 400% (or more for very narrow side seals, e.g., 2 mm or less) of the width s of side seal 22 and most preferably ranges between 250% and 300% of the side seal width s.

Figure 11:
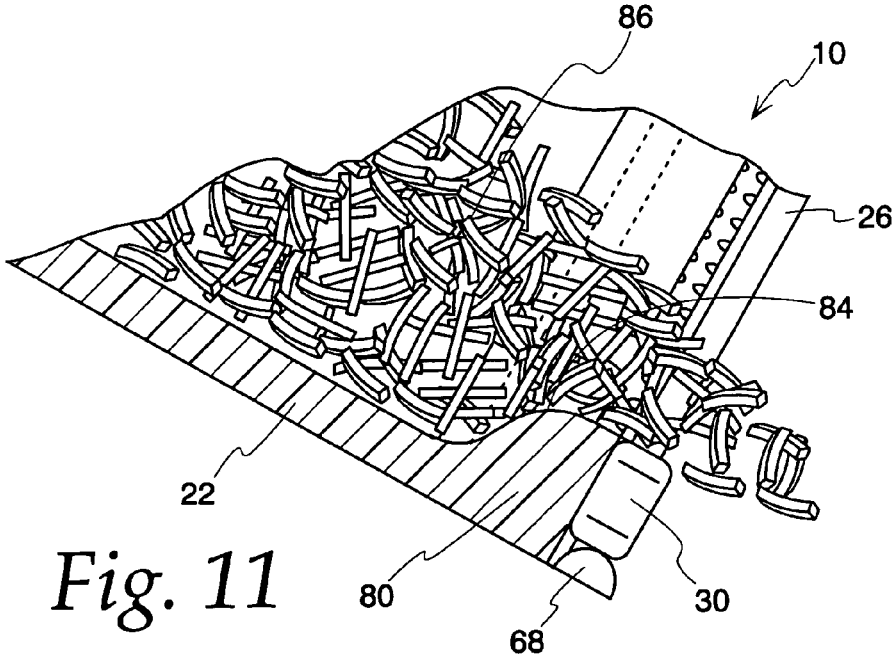
FIG. 11 is a fragmentary front elevational view showing contents being poured from the flexible package.

The enlarged, tapered end 80 of side seal 22 has a S-shaped or double re-entrant bend contour 84 which partly defines the package interior. With reference to FIG. 11, the curved edge 84 of the enlarged side seal portion 80 provides a smooth transition at the corner of the package opening, preventing product entrapment within the flexible package. As those skilled in the art will appreciate, the smooth transition at the opening corner is especially beneficial for flexible packages, where shaking techniques otherwise suitable for rigid packages, are rendered largely ineffective by flexible panels 12, 14 and especially panels of very thin, unsupported material which are likely to collapse in use.

Figure 12:
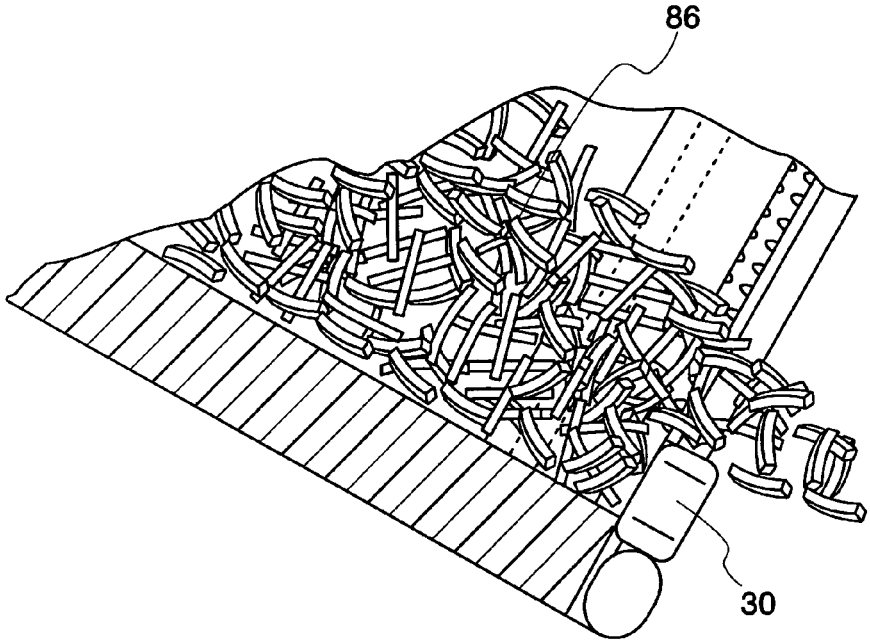
Fig. 12 Prior Art
FIG. 12 is a fragmentary front elevational view showing contents of a prior art package.

The smooth transition provided by curved edge 84 also deflects or guides product 86 away from slider 30 as product is poured or otherwise removed from flexible package 10. This prevents contamination of mating surfaces of the slider and the fastener tracks, which would otherwise deteriorate the ability of slider 30 to move freely, performing interlocking and unlocking of the fastener tracks. As indicated in FIG. 12, in prior art arrangements product 86 is allowed to freely contact the bottom end of slider 30, a condition which is avoided by flexible packages according to principles of the present invention.

Preferably, fastener tracks 26, 28 are "crushed" to form stop member 68, using conventional ultrasonic heating equipment which allows for a highly accurate shaping of the stop member as well as withdrawal of the deformation area away from the bottom surfaces 26*a*, 28*a* as shown, for example, in FIG. 3. As can be seen for example in FIG. 1, the width of stop member 68 is considerably less than the enlarged tapered portion 80 of side seal 22, and preferably is of a smaller width than that of the narrower major portion of side seal 22. With reference to FIG. 1, the width d of stop member 68 is less than the width s of side seal 22. Preferably, stop member width d ranges between 50% and 200% of the width s of side seal 22. Preferably, the width w of the stop member 68 (i.e., the "crush" dimension) ranges between 25% and 80% of the width z of the fastener tracks, as illustrated in FIG. 3. The amount of upward displacement or upwelling u is approximately at least as great as the thickness of upper wall 44. It should be kept in mind that the total mass of the stop must be sufficient to hold the slider captive.

The stop member 68, in addition to having a reduced width d in front elevational view and a small width w in end view (see FIG. 3), has a sufficiently smaller mass and frontal surface area than stops employed in the prior art. This construction allows the slider 30 to be moved to an extreme position immediately adjacent the edge 22 of flexible package 10, thus maximizing the package opening, allowing for easier removal of the package contents. This reduced size of stop 68 also contributes to the precision of the ultrasonic heating and formation of the stop member, needed to attain required precise dimensions. Further, from a manufacturing standpoint, the dwell time to melt and shape the stop 68 is substantially reduced, contributing to the overall efficiency for the package manufacturer.

Prior art stop members have been formed by "crushing" the entire fastener profile, including the bottom surfaces 26*a*, 28*a*. In addition, even if ultrasonic techniques are employed for the stop member, prior art side seals (formed using conduction heat seal techniques and much larger, oftentimes three to four times larger than side seals according to the present invention) were typically overlaid with the stop, contributing to a substantial distortion of the stop structure. Even if the prior art side seals were made to stop short of the fastener tracks, the relatively high level of conduction heating in the immediate proximity of the stop have been found to cause a distortion of the stop, degrading control over its size and shape. These disadvantages are avoided with practice of the present invention, where the small, compact size of the stop is employed, and the gap g is formed between undeformed fastener bottom surfaces 26*a*, 28*a* and the enlarged seal portion 80.

Figure 9:
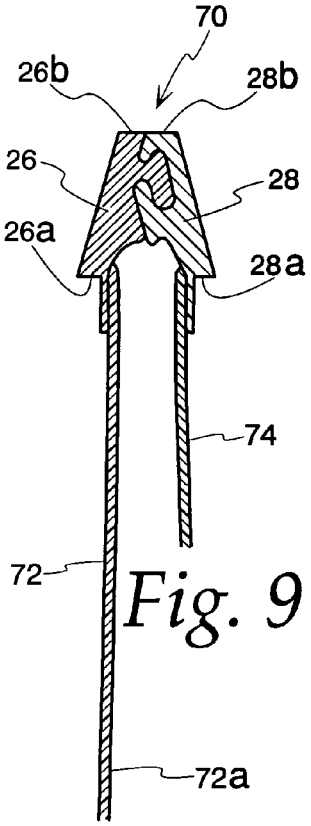
FIG. 9 is an end view of a fastener track sub-assembly.
Figure 10:
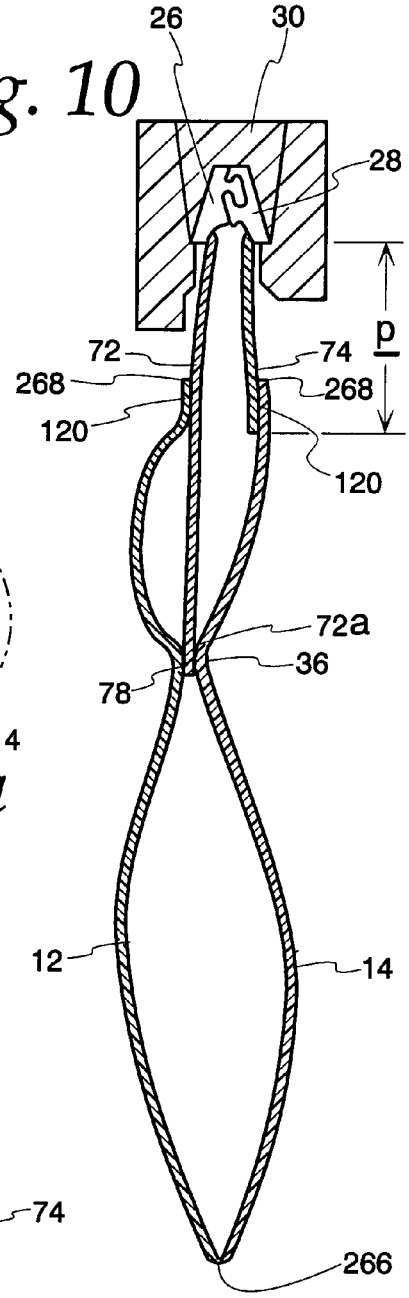
FIG. 10 is a cross-sectional view, in schematic form, taken along the line 10-10 of FIG. 1 with the slider moved to the left.

Turning now to FIGS. 4, 9 and 10, and initially to FIG. 9, the fastener tracks are preferably formed from a sub-assembly generally indicated at 70 in which the fastener tracks 26, 28 are provided with corresponding fastener flanges 72, 74. The fastener flanges 72, 74 are coextensive with the fastener tracks 26, 28 and take the form of a plastic web to be heat sealed to the panels 12, 14. As can be seen in FIG. 9, fastener flange 74 is shorter in height than fastener flange 72, so as to accommodate the preferred hermetic seal arrangement shown in FIG. 10.

Figure 10A:
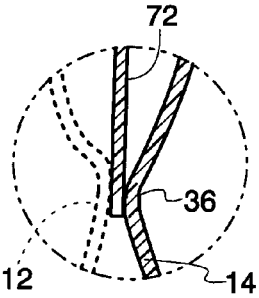
FIG. 10*a* is a fragmentary view, of FIG. 10 shown on an enlarged scale.

The fastener flanges 72, 74 are heat sealed to panels 12, 14. With reference to FIGS. 4 and 10, fastener flange 72 is welded or otherwise mechanically sealed to panel 12 at weld band 78. As shown at the upper portion of FIG. 10, the upper ends of panels 12, 14 are joined to the outer outwardly facing surfaces of fastener flanges 72, 74 at points intermediate the fastener tracks and peelable seal 36. Band 36 preferably comprises a hermetic peelable seal formed by the joinder of panel 14 to the inside face 72*a* of fastener flange 72 (see FIGS. 10 and 10*a*). Panel 12 is sealed to the opposite outside face of the fastener flange as schematically indicated in FIG. 10. In FIG. 10*a* the components of the peelable seal 36 are shown, with film 12, which plays no part in the preferred peelable seal, being shown in phantom.

Figure 10B:
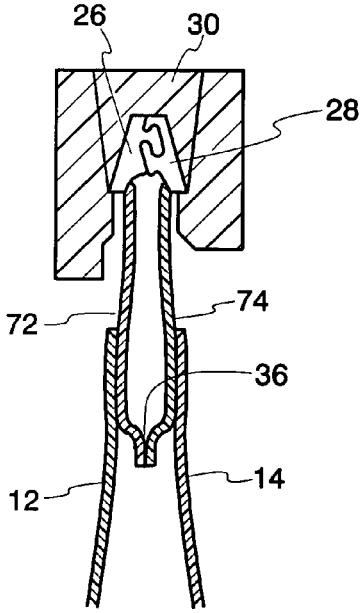
FIGS. 10*b* and 10*c* show alternative zipper track weld constructions.
Figure 10C:
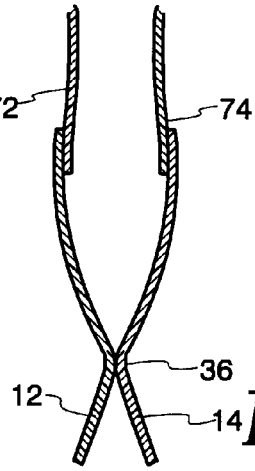

Variations of the peelable seal are also contemplated by the present invention. For example, in FIG. 10*b*, the flanges 72, 74 of the fastener arrangement are joined with a peelable seal. The upper ends of these flanges are heat sealed to panels 12, 14 as shown. In FIG. 10*c* a further alternative is shown with the peelable seal 36 being formed at the joinder of lower portions of panels 12, 14. The upper portions of panels 12, 14 are heat sealed to fastener flanges 72, 74.

As will now be appreciated, the enlarged, tapered end portions 80 of side seal 22 cooperate with other features of flexible package 10 to provide a number of important advantages. More specifically, the enlarged tapered end portions 80 provide a smooth transition of the interior of flexible package 10 preventing product entrapment in the slider and fastener track surfaces when product is poured or otherwise dispensed. In addition, the enlarged tapered portion 80 helps to secure slider 30 about tracks 26, 28 by maintaining a clearance from bottom surfaces 26*a*, 28*a* of the fastener tracks. Further, the enlarged tapered portions 80 of side seals 22 strengthen and rigidify edge portions of panels 12, 14 in the immediate area of the parked position of slide 30.

Often, the greatest amount of force applied by the user to slider 30 occurs at the closing of the slider, when the fastener tracks are unlocked or separated from one another. When the slider 30 is in the middle of its travel along the fastener tracks, the user is provided with a sensation of the proper direction of slider movement. However, when the slider 30 is in the parked position, and especially in the "parked open" position shown in FIG. 1, the user's initial application of force may be misdirected. The enlarged tapered portion 80 provides added stiffness and rigidity to the flexible package at the initial point where pressure is applied to the slider, thus further contributing to the assurance that secure engagement will be maintained between slider 30 and the tracks 26, 28.

With reference to FIG. 4, a consumer desiring to close the flexible package will grasp the enlarged side seal portion 80, pulling in the direction of arrow 81 while pulling or pushing slider 30 in the direction of arrow 31. The added stiffness and rigidity offered by enlarged side seal portion 80 is provided at a point of optimal effectiveness to react in an appropriate manner to forces applied to slider 30 and to overcome any resistance of the tracks 24, 26 to resume a mating, interlocked condition as the fastener tracks are interlocked. Those skilled in the art will appreciate that the "rolling resistance" or dynamic resistance to movement of slider 30 is oftentimes lower than the initial static resistance, opposing movement of the slider away from the fully opened parked position shown, for example, in FIG. 4.

The added stiffness and rigidity imparted to the flexible package 10 and especially panels 12, 14 by enlarged side seal portion 80 results in other advantages when lightweight panels 12, 14 are employed. For example, panels of the single polyolefin type where no laminate film (such as PET or NYLON) is used to stiffen and support the support panel, have oftentimes excluded the use of sliding zippers, since minimum stiffness and rigidity needed to operate a fastener slider was not available. However, with enlarged side seal portions according to principles of the present invention, adequate stiffness is provided, even for lightweight, so-called "single" films.

As indicated in FIG. 10, flanges 72, 74 are joined to respective panels 12, 14, preferably at their lower ends, so as to prevent product from entering between flange 72 and panel 12, as well as between flange 74 and panel 14. In certain applications this may not be a critical requirement. In FIG. 10, the upper portion of panel 12 is shown for illustrative purposes as spaced from the lower end of flange 72. In practice, it is generally preferred that this spacing be eliminated, with panel 12 being in intimate contact with flange 72. Similarly, any gap between panel 14 and the lower end of fastener flange 74 is preferably eliminated. Although it is most preferred that the peelable seal be formed by joining panel 14 to fastener flange 72, the peelable seal, preferably a hermetic seal, can be formed between the fastener flanges 72, 74 or directly between the panels 12, 14, although these alternative constructions are less preferred than the arrangement shown in FIG. 10.

Turning now to FIG. 13, flexible package 10 is shown constructed with the panels 12, 14, side seal 22, upper enlarged side seal portion 80 and fastener tracks 26, 28, as described above. The fastener tracks 26, 28 are preferably joined to flanges 72, 74 (not visible in FIG. 13). FIG. 13 schematically illustrates commercial fabrication of flexible package 10. As will be appreciated by those skilled in the art, practical commercial assembly requires recognition of tolerances of the equipment and materials used to construct a viable commercial product. For example, tracks 26, 28 are ultimately mechanically coupled to panels 12, 14 using conduction heat seal tooling. A gap 110 shown in FIG. 13 represents the tolerance range or margin of error for tool alignment used to secure the fastener tracks 26, 28. As mentioned, it is preferred that the upper end of enlarged side seal portion 80 be spaced below the lower ends of the fastener tracks, such as the lower end 26*a* of fastener track 26 visible in FIG. 13. Further, it is preferred that the gap g continue beyond the end 56 of slider 30.

A gap 116 represents a tolerance range or margin of error for the desired positioning of the upper end of enlarged side seal portion 80, to provide clearance for the bottom edge of slider 30. As illustrated in FIG. 13, the upper end of enlarged side seal portion 80 falls at an outermost limit of its tolerance range. Preferably, the upper end of enlarged side seal portion 80 is within the gap 116, rather than to one end thereof. The gap 116 also accounts for any cant or angular mis-positioning or mis-alignment where the upper end of side seal 80 may be angled slightly from a position parallel to the fastener tracks, as may be encountered in a practical commercial environment.

A band 120 shown in FIG. 13 represents a conduction heat seal of the fastener flange to the panels 12 or 14. This conduction heat seal 120 provides the principal mechanical attachment of the fastener track assembly to the package panels. Band 36 is the peelable seal, preferably a hermetic seal, between panel 14 and fastener flange 72. A gap 124 represents the desired production spacing between production seal 120 and peelable seal 36. The remaining band 128 represents the production tolerance range or margin of error for positioning of peelable seal 36 with respect to the package panels.

In one commercial embodiment, flexible package 10 comprises a plastic bag having a width of approximately 6.5 inches from side edge to side edge and a total overall height of approximately 10.75 inches. The fastener tracks 26, 28 have a height of approximately 4 millimeters, with gaps 110, 116 each having a height of 2 millimeters. As shown in the upper right-hand corner of FIG. 13, stop 68 projects a distance u above the top edge of the fastener tracks. In FIG. 13, only the top edge 26*b* is visible. With reference to FIG. 10, the upper ends of panels 12, 14 are preferably spaced a distance p from the bottom edges of the fastener tracks, ranging between 2 and 3 millimeters. The conduction heat seal 120 and the peelable seal 36 each have a height of 6 millimeters, and gap 124 located between the two, has a height of 2 millimeters. The desired spacing between conduction heat seal 120 and peelable seal 36 has a maximum value of 2 millimeters and a minimum value required to prevent overlap of the conduction heat seal and peelable seal. The side seal 22 has a width ranging between 3 and 8 millimeters and the stop 68 has a width (see reference character d in FIG. 1) ranging between 2.0 and 8.0 mm. As can be seen with reference to FIG. 13, the upper end of side seal 22 is spaced a substantial distance below the upper edge of the flexible package. This spacing ranges between a minimum value equal to the combined height of the fastener tracks and gap 110, and a maximum value equal to the combined height of the fastener tracks, gap 110 and gap 116.

Figure 14:
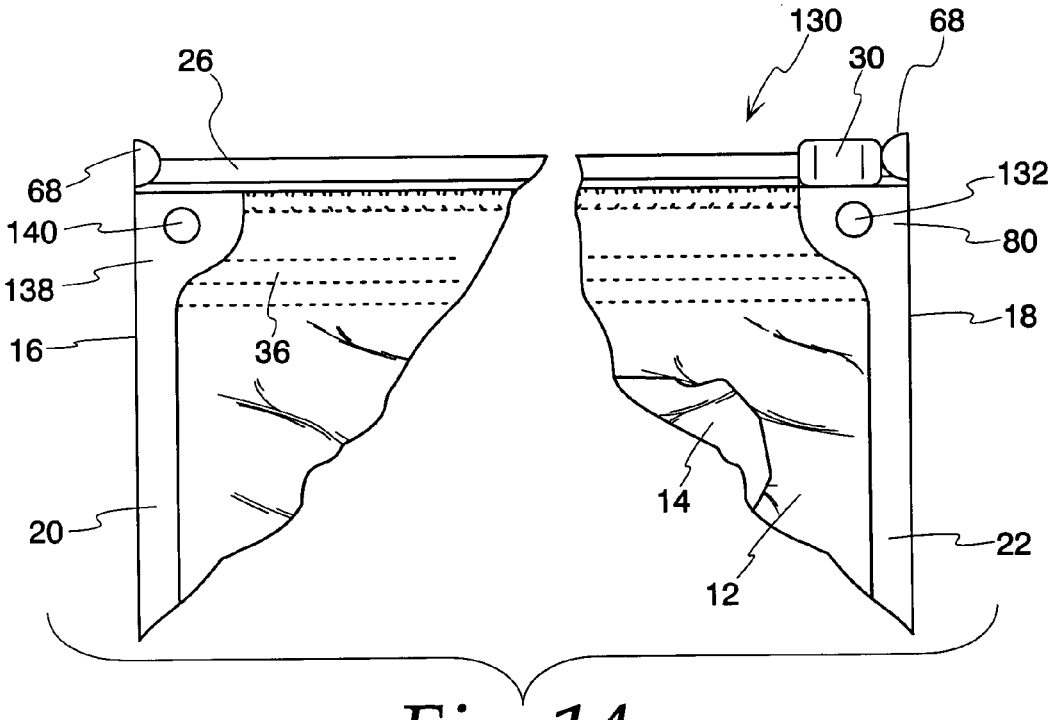
FIG. 14 is a front elevational view of another flexible package according to principles of the present invention.

Referring to FIG. 14, several alternative features are shown with reference to a flexible package 130. The right-hand portion of flexible package 130 is identical to flexible package 10, described above, except for the addition of a peg hole 132 formed in the enlarged side seal portion 80. Flexible package 130 has a left side seal 20 as described above with respect to FIG. 1. However, in the flexible package 130, the upper end of side seal 20 is enlarged at 138 in a manner similar to that of enlarged side seal portion 80. An optional peg hole 140 is formed in the enlarged side seal portion 138. Although the peg holes 132, 140 are shown having a circular shape, virtually any shape (e.g., oval) can be used, as well. Peg holes 132, 140 can be formed by punching before or after the side seals are fully formed, it being preferred that the upper ends of the side seals provide a complete sealing of the panels and other components of the flexible package. It will be appreciated by those skilled in the art that the holes add heat relief to the enlarged side seal portion. This helps preserve the uniformity of the tapered area and of the dimensioning of gap g, as well as the uniformity of shrinkage which helps control manufacture on a production basis. If desired, the heat sealing die can be made hollow in the region of the peg holes, even in the absence of peg hole features to attain further heat relief advantages. It may also be preferable in some instances to form the peg holes 132, 140 as part of the formation of the side seals using, in effect, a thermal cutting or thermal punching technique. With the inclusion of two peg holes 132, 140, flexible package 130 can provide an improved presentation of art work or other indicia carried on the panels of the flexible package.

It is generally preferred that textual and graphic information be oriented generally perpendicular to the side edges of the flexible package. If only one peg hole is provided, the package will tend to hang rotated in a vertical plane, according to the distribution of product within the flexible package. With support given to two peg holes 132, 140, the flexible package is oriented in an upright position, making it easier to read the text and graphical information carried on the package. If desired, the text and graphical information printed on the rear panel can be inverted so that a consumer can "flip" the package to inspect the rear panel, without having to remove the package from the support pegs passing through peg holds 132, 140.

Although the package opening, fastener tracks and related features are shown at the upper end of the flexible package, the present invention is intended to cover arrangements in which the opening and related structure is provided on the side or bottom of the flexible package.

Figure 23:
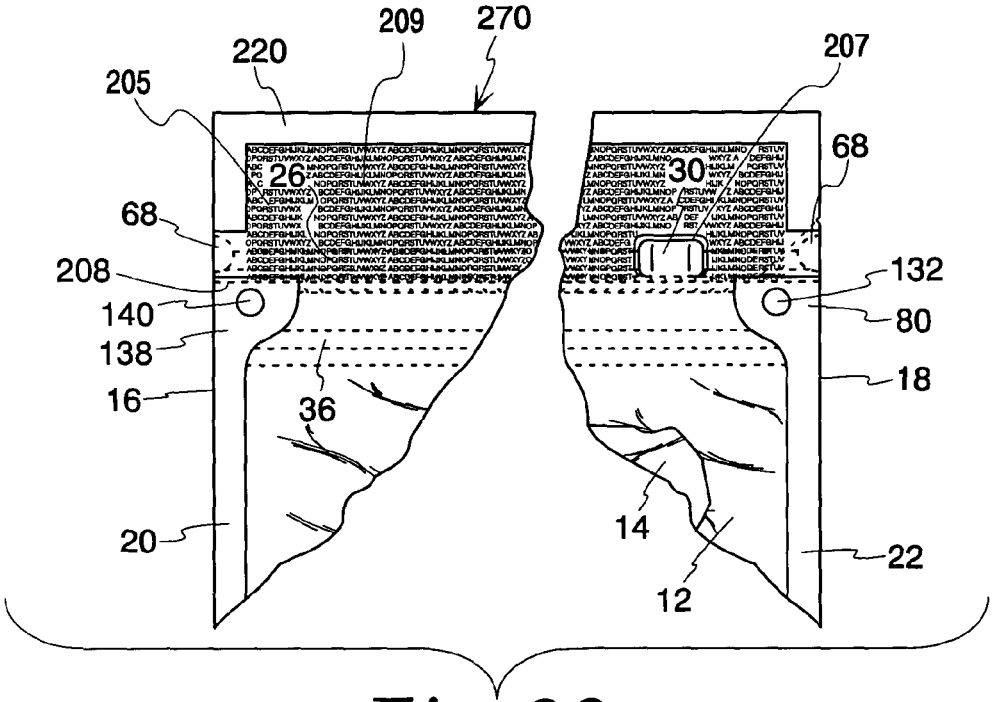
FIG. 23 is a fragmentary elevational view of an additional embodiment of a shrouded flexible package.
Figure 24:
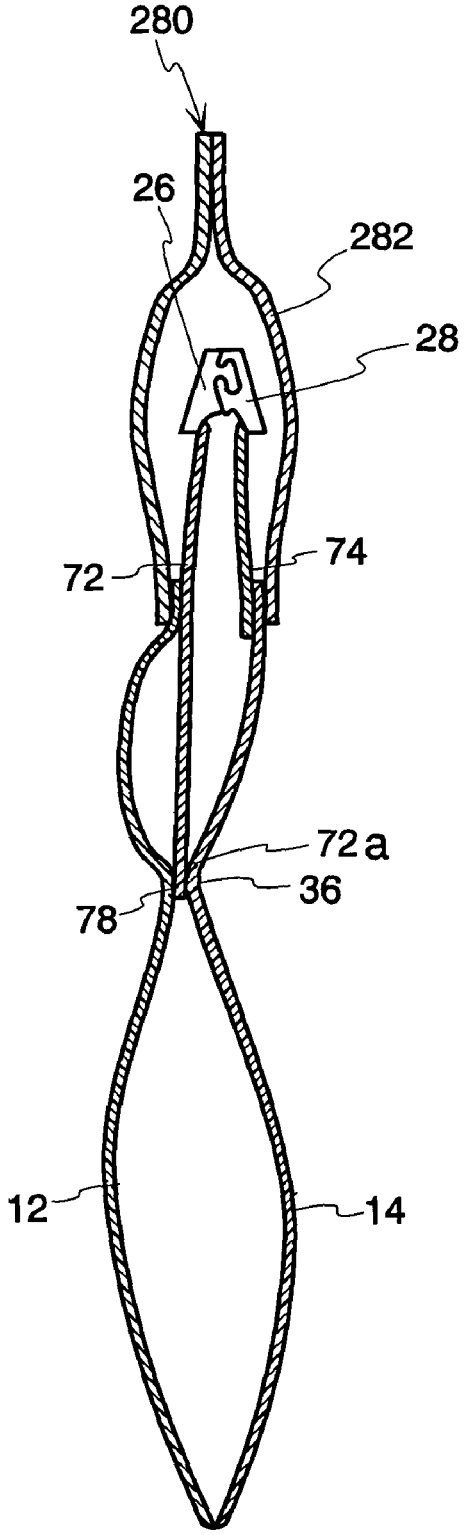
FIG. 24 is a cross-sectional view similar to that of FIG. 20 but showing an alternative shroud construction.
Figure 25:
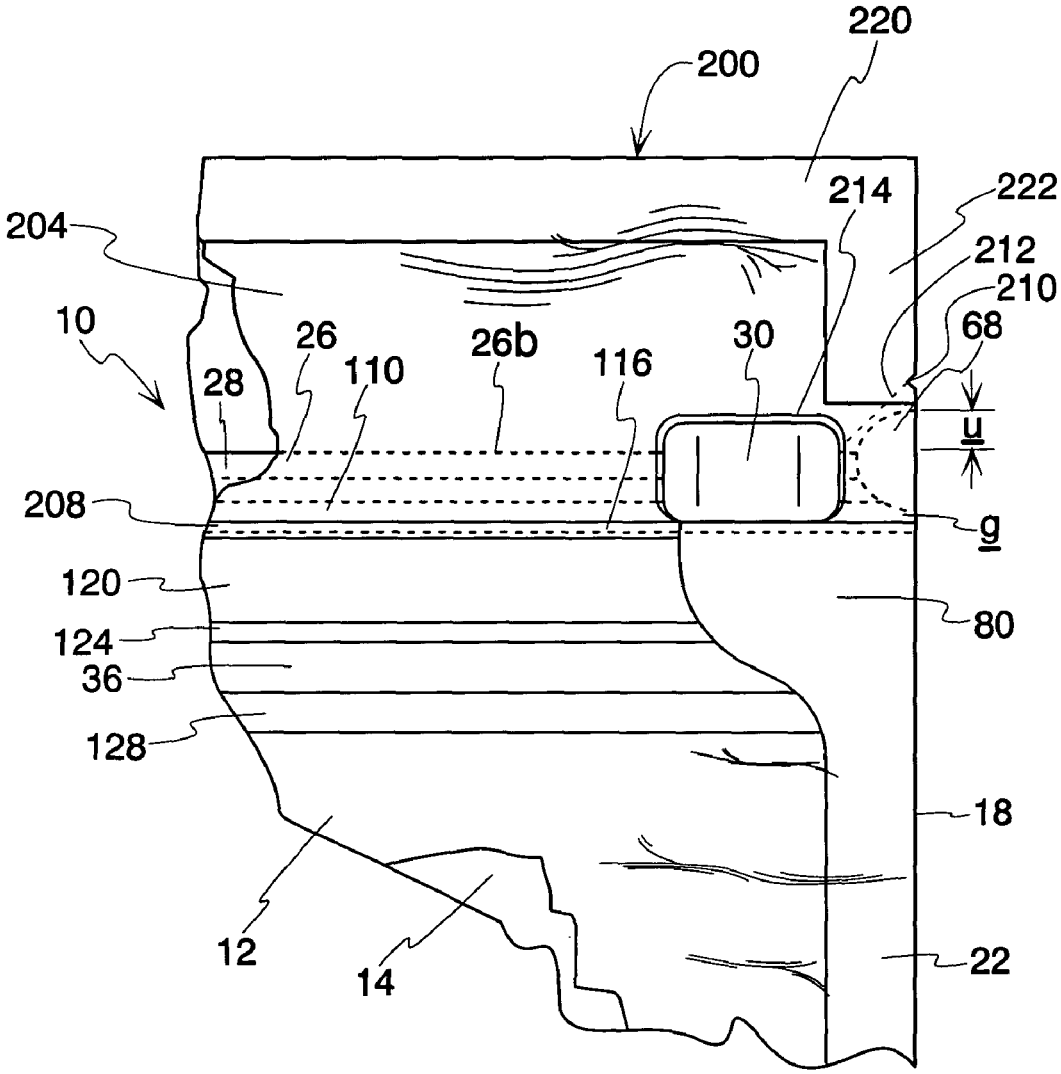
FIG. 25 is a fragmentary elevational view of a further embodiment of a shrouded flexible package.

Referring now to FIGS. 15-25 and initially to FIG. 25, an improved package 200, is shown. Package 200 includes the features of flexible package 10, described above and in addition includes a shroud portion 204 extending above line of weakness 208 formed in panels 12, 14. Line of weakness 208 can be formed using available conventional techniques, and is preferably formed, using laser scoring techniques. Preferably, line of weakness 208 extends across the width of flexible package 200, from one side edge to the other. As shown in FIG. 25, line of weakness 208 extends to edge 18, located at side seal 22. If desired, side seal 22 can be replaced by side seal 20.

Preferably, shroud 204 is made for easy tear-away removal in an intuitive manual operation not requiring special directions. Preferably, a notch 210 is formed in edge 18, and is located slightly above stop 68. An optional angled or diagonal line of weakness 212 extends from notch 210 to an opening 214 which surrounds slider 30. Opening 214 is illustrated as a rectangle with rounded corners. Opening 214 can however take on other shapes, such as that of a circle or teardrop, for example. Opening 214 relaxes the strain in the shroud portion of the flexible package caused by relatively large-sized slide members. It is preferred that the opening 214 be formed in the web prior to joining with fastener tracks. Accordingly, careful registration of the opening 214 is needed to insure the desired finished flexible package is produced.

Preferably, slider 30 is located at a fully closed position along the fastener tracks and is surrounded by opening 214 at the closed position. In order to gain access to the package contents, a user grasps the upper edge of shroud 204 causing an initially tearing at notch 210. Tearing continues along diagonal line 212 and enters opening 214, continuing along opening 214 to line 208. With continued tearing across the width of package 200 the shroud 204 is removed, leaving a package substantially similar to the packages described above in FIGS. 1-14.

Referring again to FIG. 25, shroud 204 includes an upper fin seal 220 and a side fin seal portion 222. Preferably, the upper fin seal 220 inside fin seal 222 are formed in separate sealing operations and are made to slightly overlap one another for package integrity and sealing of the package interior. The bottom of side fin seal 222 is terminated at or slightly above end stop 68. It is most preferred that side fin seal 222 be terminated slightly above end stop 68 to avoid interfering with the controlled formation of the end stop which, as pointed out above, has a shape and position providing novel advantages. Notch 210 in the preferred embodiment shown in FIG. 25 is formed at the lower end of side fin seal 222. If desired, notch 210 could be formed in a gap between end stop 68 and a side fin seal shortened with respect to the side fin seal illustrated in FIG. 25.

Figure 15:
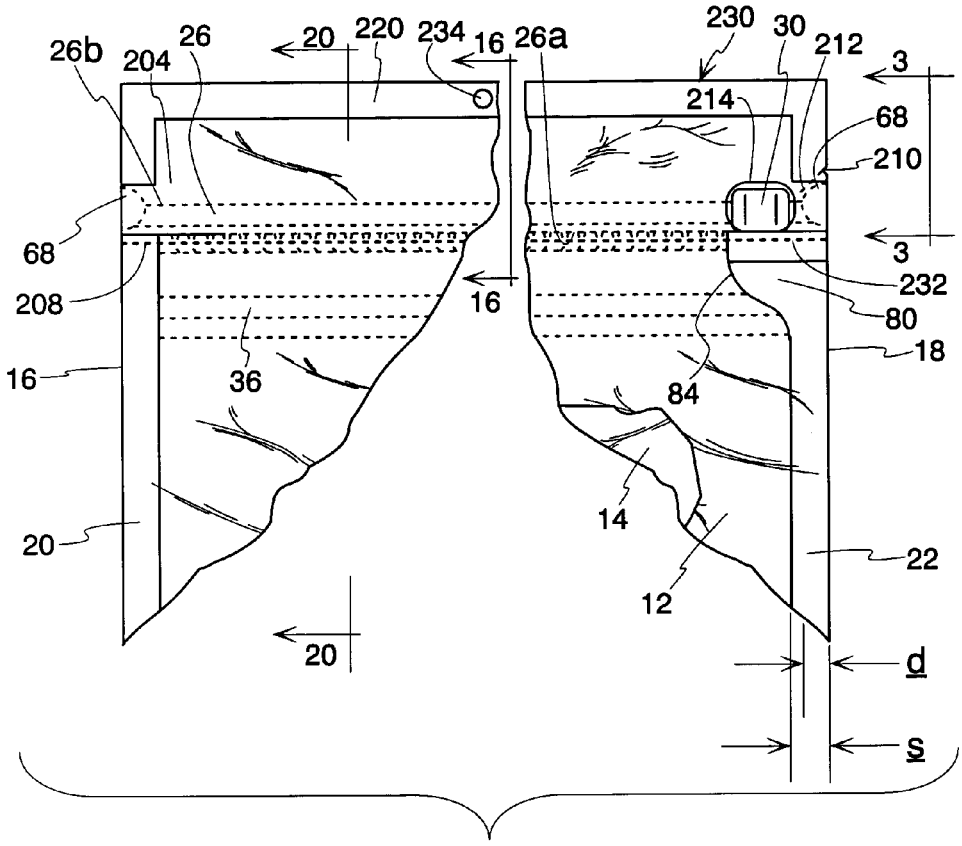
FIG. 15 is a fragmentary elevational view of a shrouded flexible package constructed according to principles of the present invention.
Figure 16:
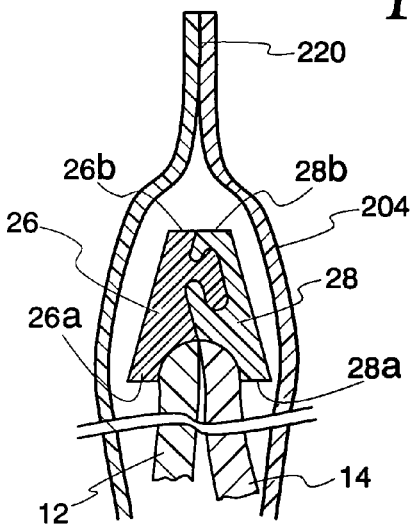
FIG. 16 is a fragmentary cross-sectional view taken along line 16-16 of FIG. 15.
Figure 17:
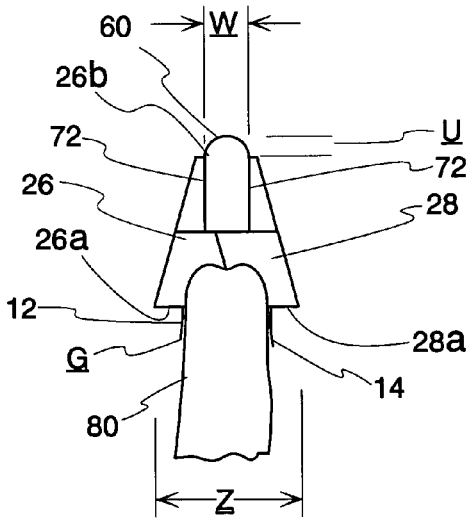
FIG. 17 is a fragmentary end view of the package of FIG. 15.

Turning now to FIGS. 15-18 a flexible package 230 is shown. Package 230 is substantially identical to package 200 described above, except that opening 214 does not directly communicate with diagonal line 212. Tearing of package 230 to remove shroud 204 is initiated at notch 210 and continues along diagonal line 212 to a point of intersection with line of weakness 208. If desired, the portion of weakness line 208 designated by reference numeral 232, line between diagonal line 212 and edge 18 can be omitted, if desired. Further, weakening line 208 and diagonal line 212 can be formed in a single operation using conventional techniques such as laser scoring. As a further alternative, diagonal line 212 can be made to curve either along its entire length, or at the point of intersection with weakening line 208. FIG. 15 shows a central peg hole 234 is formed in upper fin seal 220.

Figure 19:
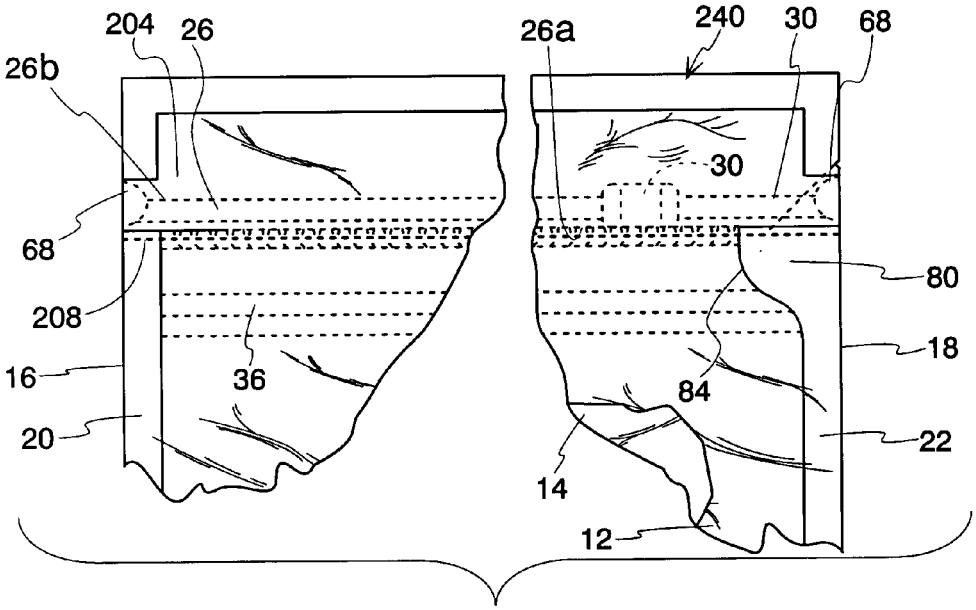
FIG. 19 is a fragmentary elevational view of another embodiment of a shrouded flexible package.

Referring now to FIG. 19, flexible package 240 is substantially identical to flexible package 230, except for the omission of opening 214. Arrangement of FIG. 19 is preferably employed where the width of slider 30 is reduced, or the shroud 204 is sufficiently flexible or has an enlarged cross section so as to completely enclose slider 30 without requiring an opening to relax tension in the material forming the shroud.

Figure 20:
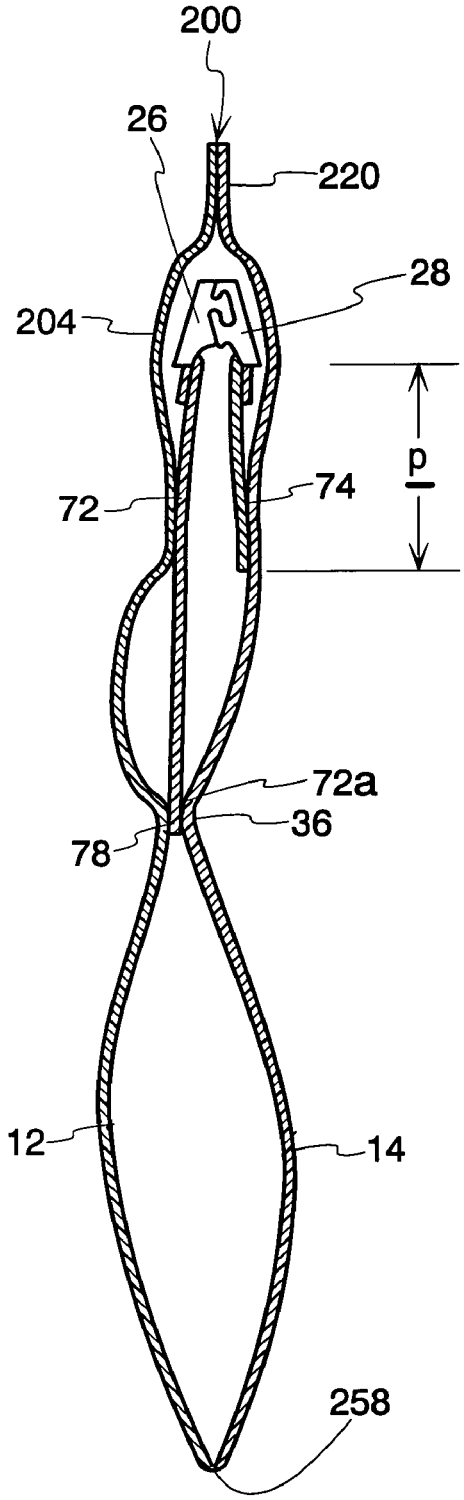
FIG. 20 is a cross-sectional view taken along the line 20-20 of FIG. 15.

Referring now to FIG. 20, a cross section of flexible package 200 is shown. Preferably, shroud 204 is formed as a continuous integral extension of panels 12, 14, the upper free edges of which are joined together to form upper fin seal 220.

Figure 21:
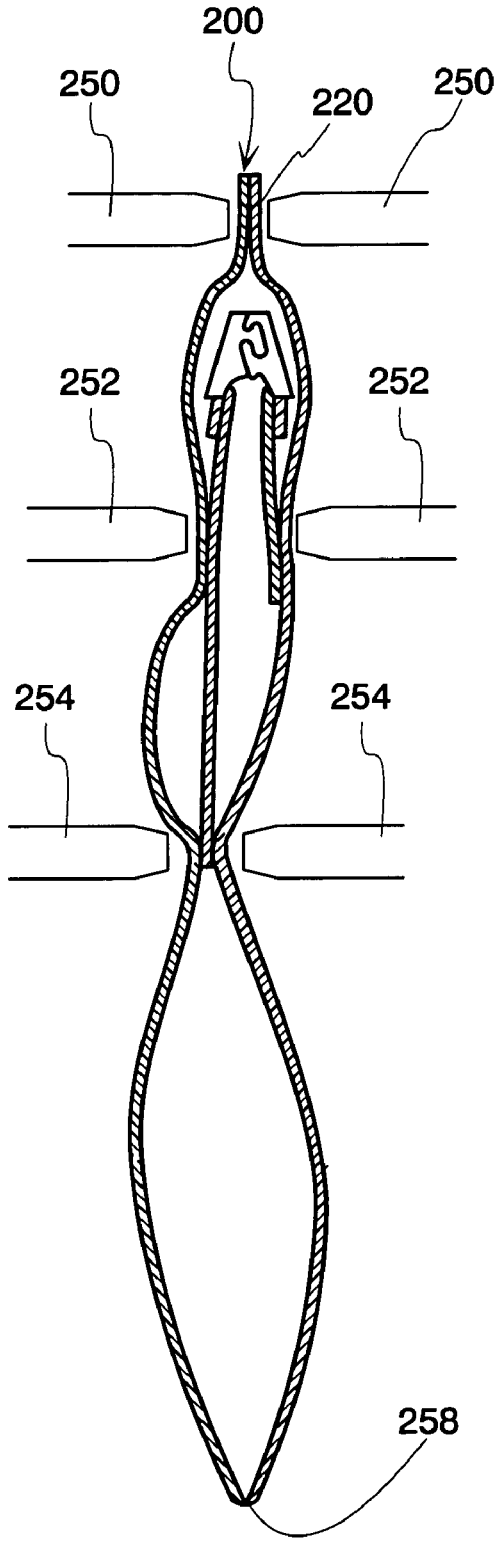
FIG. 21 is a cross-sectional view similar to that of FIG. 20, shown with the schematic depiction of tooling to form the flexible package.

Referring to FIG. 21, exemplary tooling to form the package 200 are shown. For example, a pair of upper seal bars 250 form upper fin seal 220 while a pair of intermediate seal bars 252 join panels 12, 14 to fastener flanges 72, 74. Lower seal bars 254 form the peel seal 36 and weld band 78 (FIG. 20). The bottom of package 200, as is preferred, with the other flexible packages shown herein, is formed by a dead fold 258. However, a gusseted bottom construction can also be employed if desired.

Figure 18:
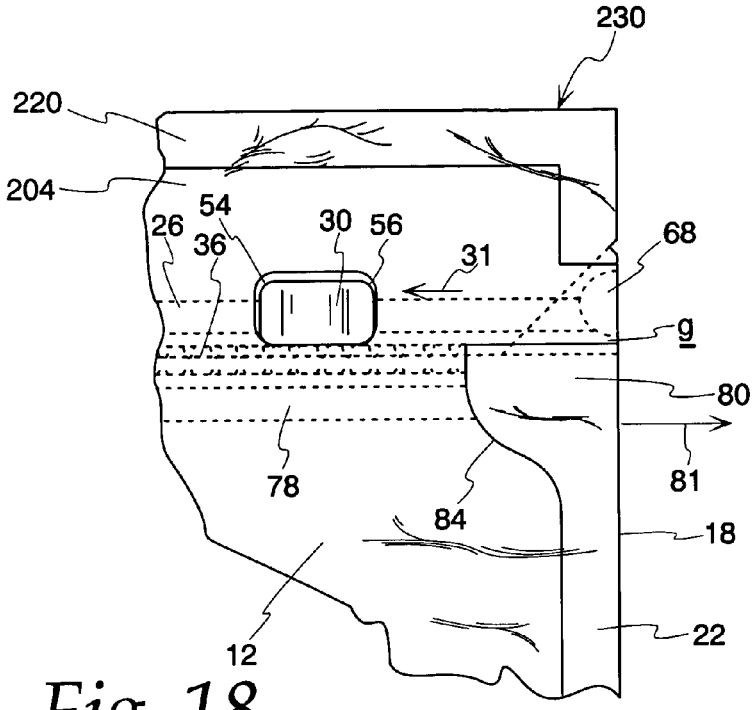
FIG. 18 is a fragmentary elevational view of a further embodiment of a flexible package constructed according to principles of the present invention.
Figure 22:
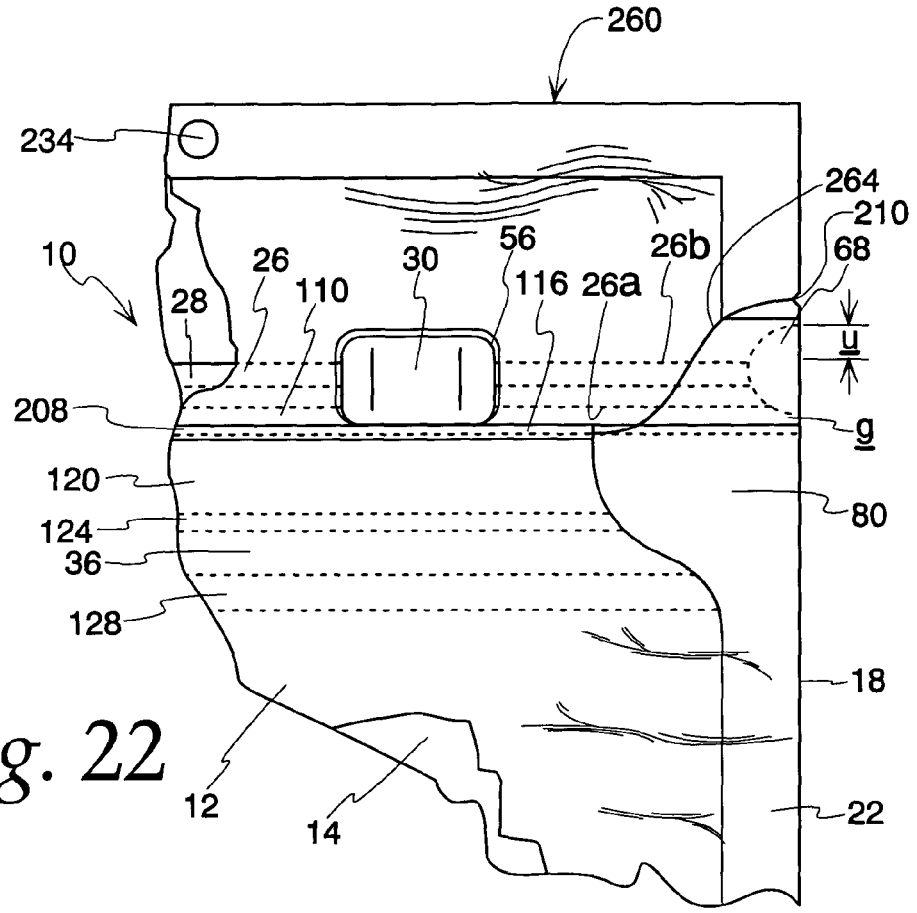
FIG. 22 is a fragmentary elevational view of a further embodiment of a shrouded flexible package.

Referring now to FIG. 22, a flexible package 260 is substantially identical to flexible package 230 of FIG. 18, except for a curved line of weakness 264 joining notch 210 with weakening line 208.

FIG. 23 shows a flexible package 270 generally similar to that of flexible package 230, except that a large or tapered side seals are provided at each side of the package. Peg holes 132, 140 are formed in the tapered side seal portions and if desired an optionally central peg hole 234 can be formed in upper fin seal portion 220. As with the other embodiments shown herein, it is generally preferred that the enlarged or tapered side seal portions stop short of the line of weakness 208.

If desired, the enlarged tapered side seals and/or the peg holes can be omitted. Flexible package 270 includes a continuous shroud 205 similar to that described above with reference to FIG. 19. Shroud 205 is continuous or unbroken in that it lacks a hole or opening for slide member 30. However, shroud 205 does include a region 207 which is transparent or free of printing indicia 209 which is applied to the remainder of the shroud material.

FIG. 24 is a cross-sectional view of a flexible package 280 substantially identical to flexible package 200, described above, except that a shroud member 282 is separately formed from panels 12, 14 and is joined to the upper ends of the panels by conventional welding or other joining techniques.

Most preferably, shroud 282 is joined to the upper ends of panels 12, 14 at the point of sealing with flanges 72, 74. The weakening line for removal of shroud of 282 can be formed either above or below the point of sealing with remainder of the flexible package.

It is generally preferred that textual and graphic information be oriented generally perpendicular to the side edges of the flexible package. If only one peg hole is provided, the package will tend to hang rotated in a vertical plane, according to the distribution of product within the flexible package. With support given to two peg holes 132, 140, the flexible package is oriented in an upright position, making it easier to read the text and graphical information carried on the package. If desired, the text and graphical information printed on the rear panel can be inverted so that a consumer can "flip" the package to inspect the rear panel, without having to remove the package from the support pegs passing through peg holds 132, 140.

Although the package opening, fastener tracks and related features are shown at the upper end of the flexible package, the improved flexible package is intended to cover arrangements in which the opening and related structure is provided on the side or bottom of the flexible package.

Figure 26:
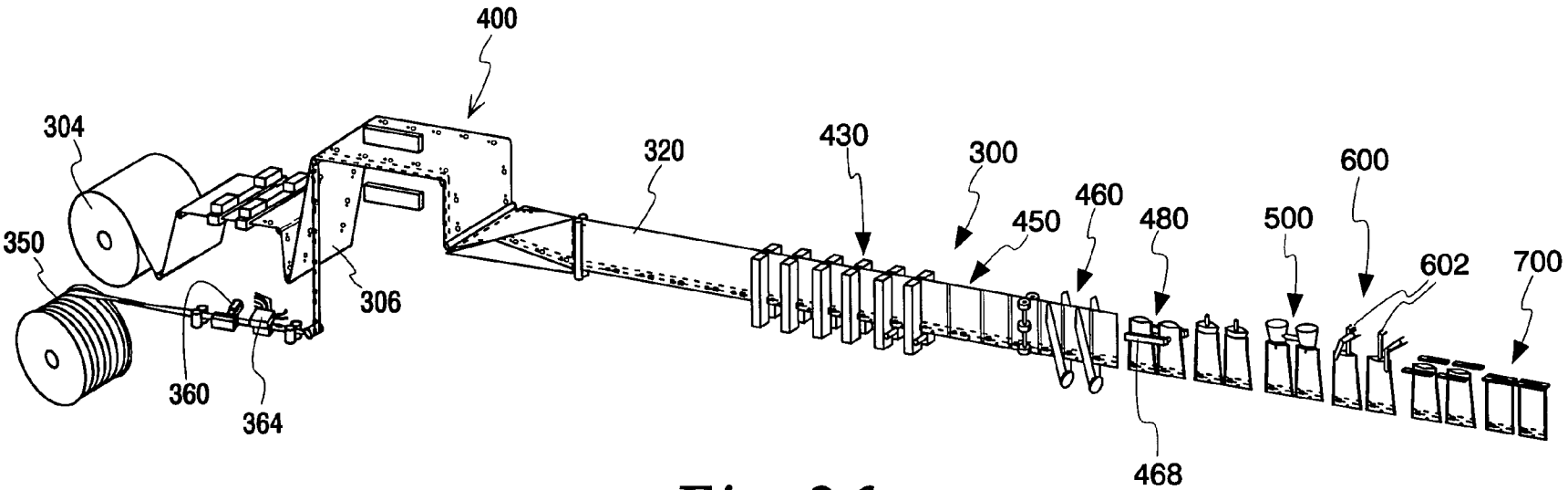
FIG. 26 is a perspective view of apparatus for constructing flexible packages according to principles of the present invention.

Other package constructions contemplated by the present invention will be described after the following description of apparatus for manufacturing improved flexible packages having slide closures. With reference to FIG. 26 and following, apparatus according to principles of the present invention, generally indicated at 300, employs a horizontal form fill seal arrangement with the in-line application of mated fastener tracks to a reverse (i.e., upside down) folded web. Apparatus 300 brings all of the required packaging components together, for assembly, at the point of fill and final sealing.

Figure 27:
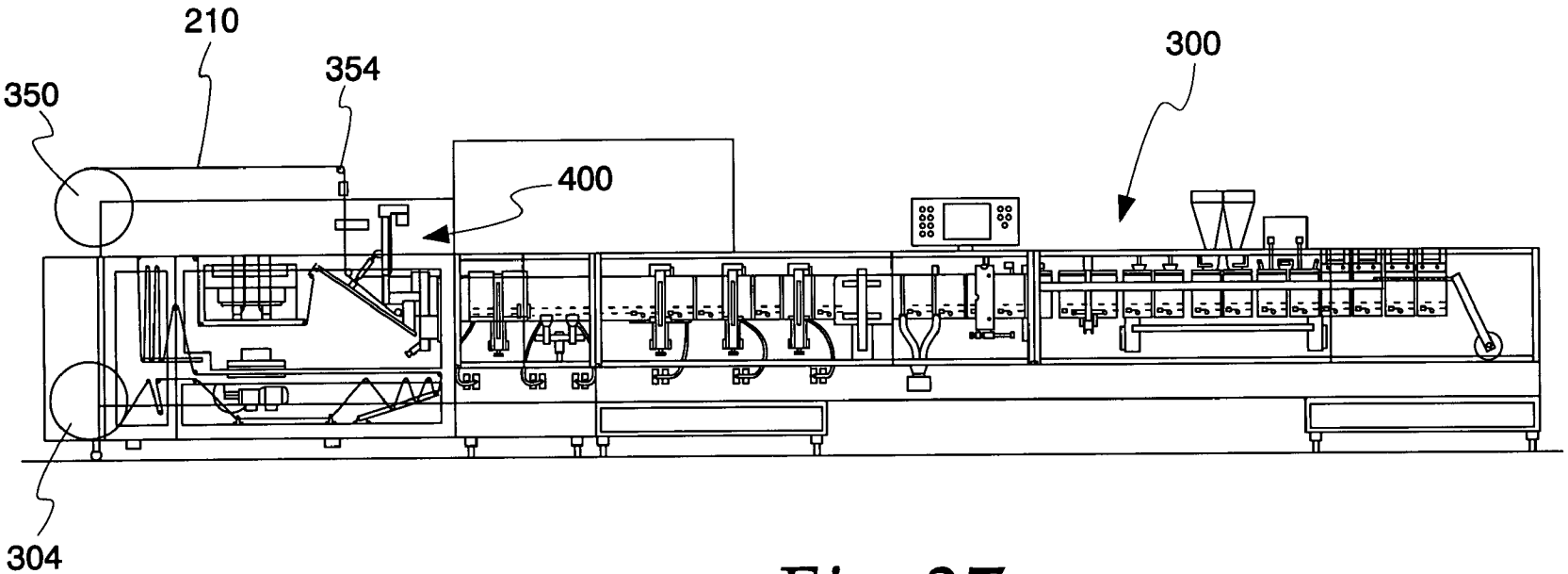
FIG. 27 is a side elevational view thereof.
Figure 28:
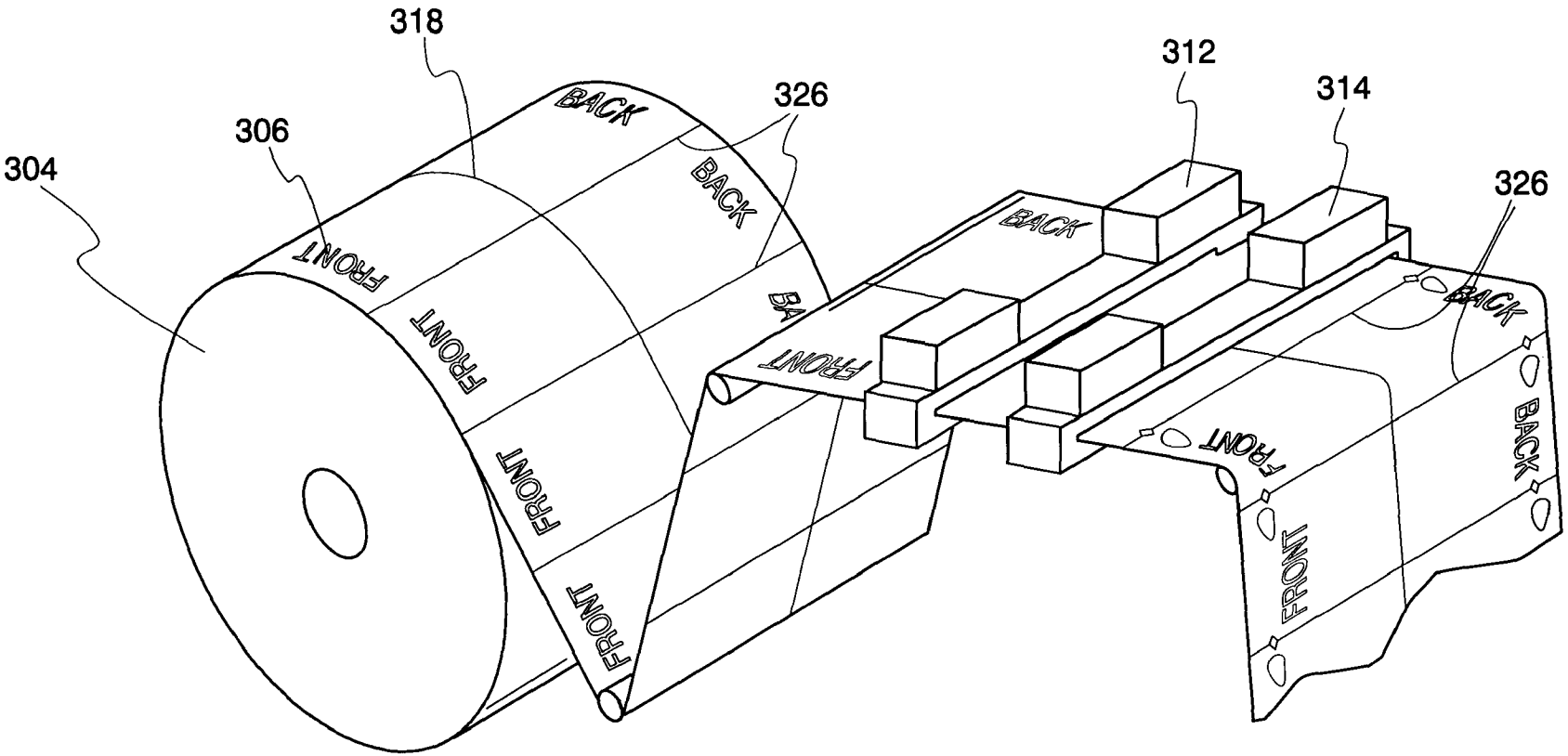
FIG. 28 is a fragmentary view showing the plastic web.
Figure 29:
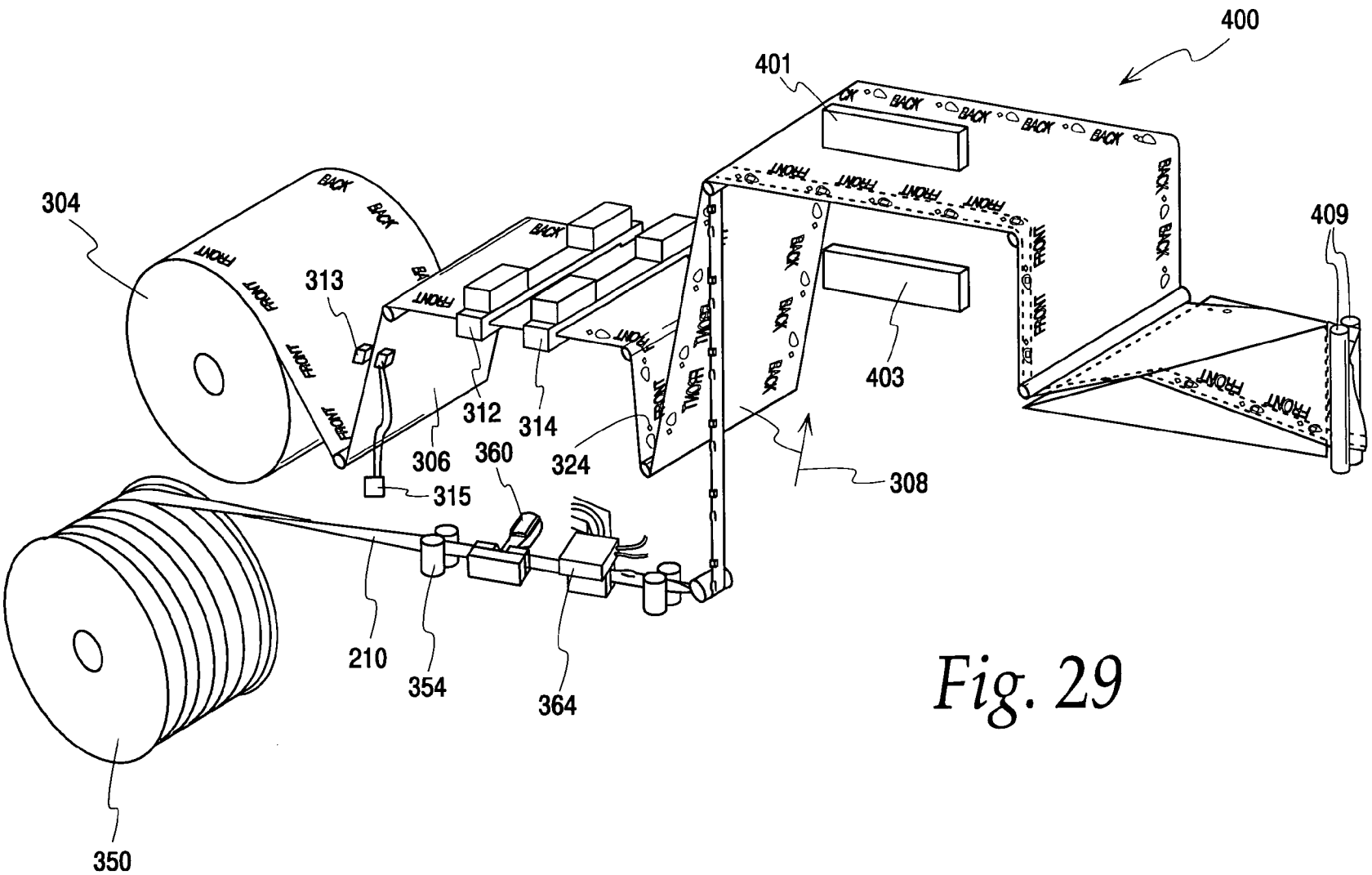
FIG. 29 shows the plastic web being folded.
Figure 34:
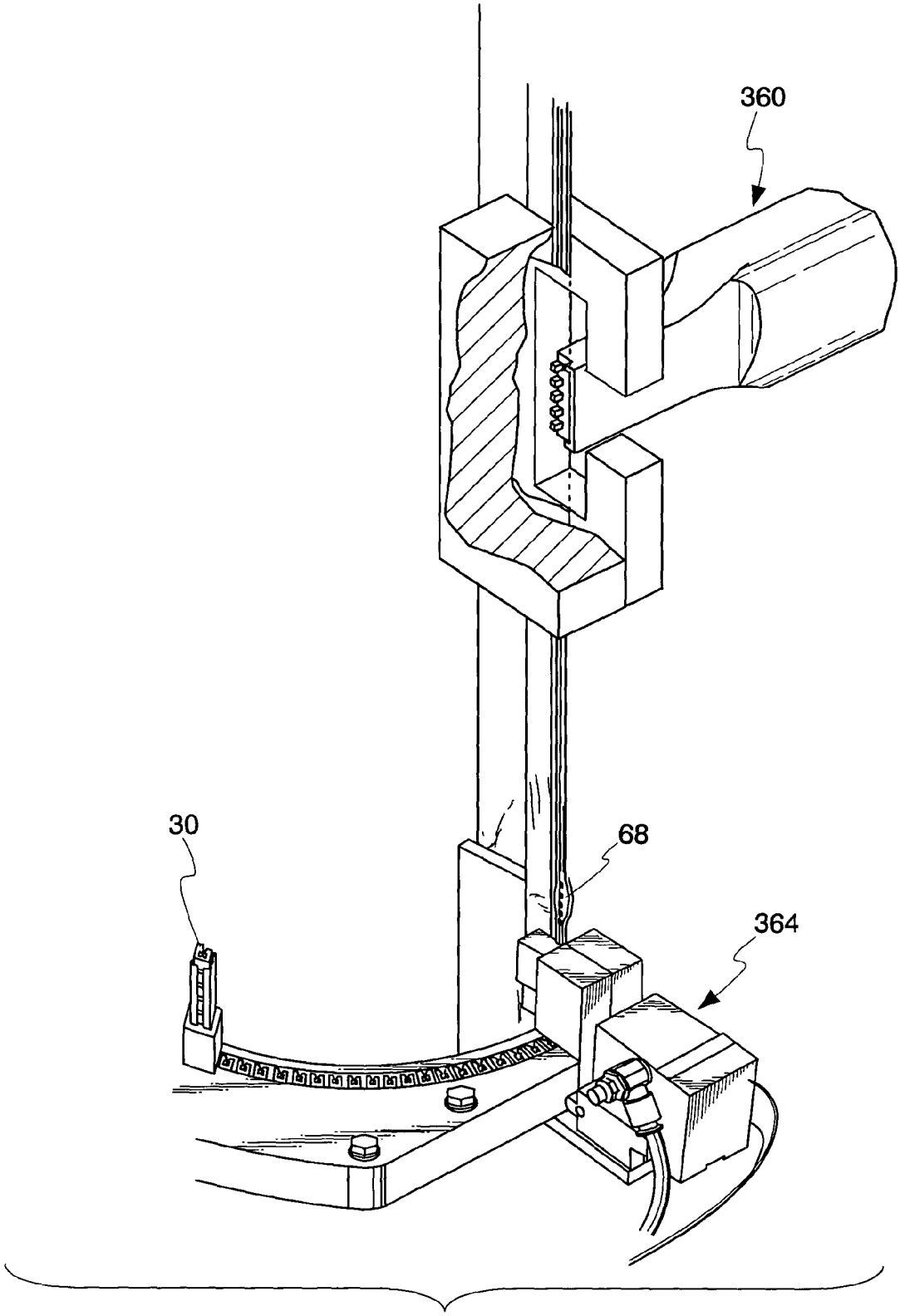
FIG. 34 is a perspective view of work stations performing operations on a mated zipper track.
Figure 39:
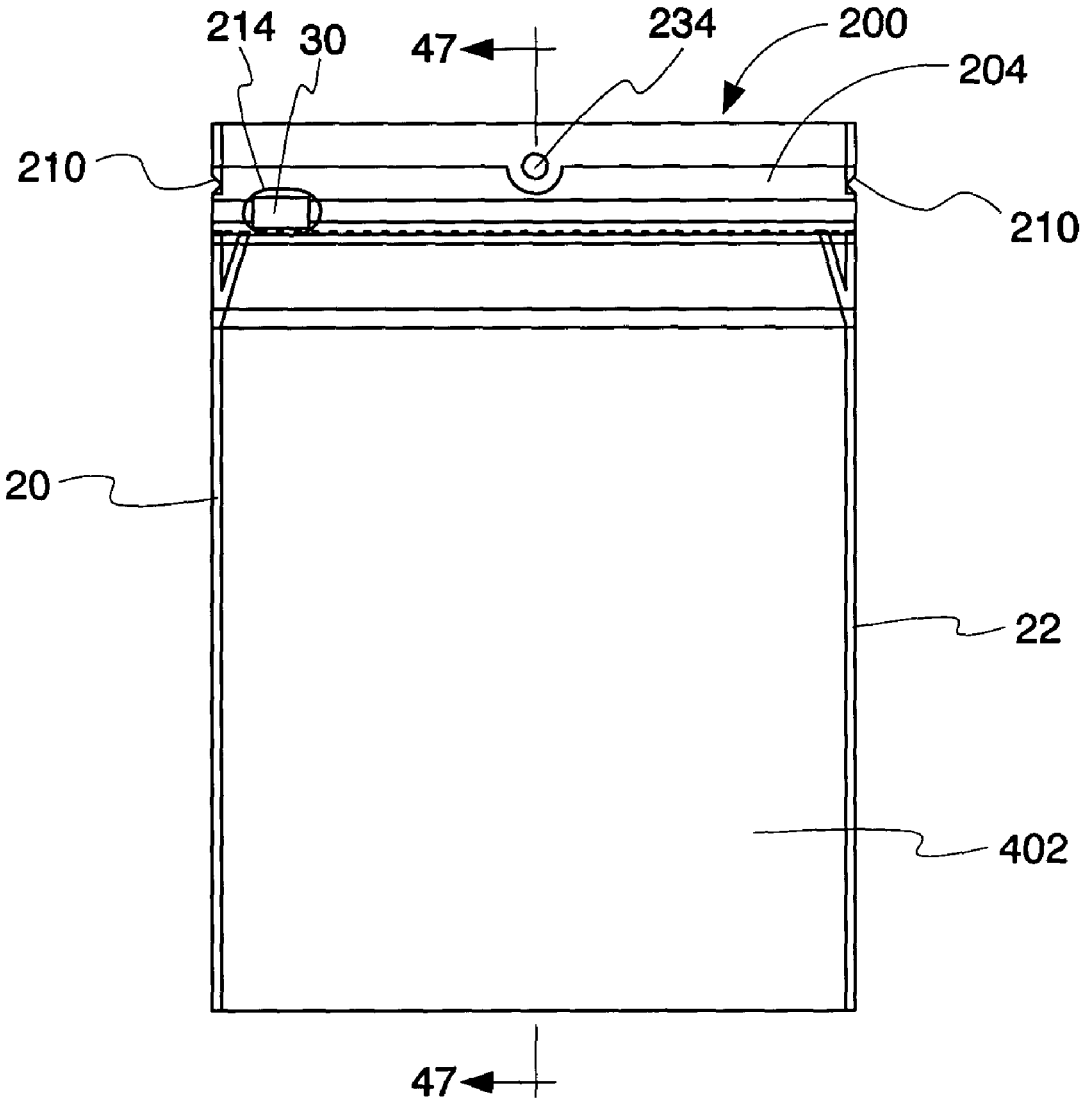
FIG. 39 is an elevational view of a flexible package constructed according to principles of the present invention.

Referring to FIGS. 26 and 27, apparatus 300 includes a web supply roll 304 providing a supply of web material 306 preferably comprising a conventional plastic packaging film. As will be seen herein, the flexible packages or bags are formed in an inverted, or upside down position. Referring to FIG. 28, punches 312, 314 are schematically indicated and form the openings on opposed bag panel portions 12, 14 for the slider member. Also, indicated in FIG. 29 are diamond shape cutouts 324 formed by punches schematically indicated in FIG. 28 at 314. As indicated in FIG. 26 and elsewhere, such as FIGS. 29 and 30, web 306 is "reverse" folded about its longitudinal center line to form a "dead fold" 320 which would otherwise form the end of the finished packages. However, according to principles of the present invention, as will be seen herein, the dead fold 320 is subsequently slit for package filling operations and is later resealed in either a fin seal or a gusseted construction to form a finished seal at the bottom of the flexible packages. The lines 326 (see FIG. 30) running generally transverse of web 206 indicate severing lines which divide one bag portion from another, the bag portions preferably being serially formed from a common web. The severing also severs back-to-back mirror image stop portions which are "stomped" or "crushed" in the zipper track, at station 360 (see FIGS. 26 and 34). Cutting is carried out at station 460 as shown in FIG. 26. After cutting, the diamond cutouts 324 are divided to become V-shape tear notches 210 shown for example in FIG. 39.

As indicated in FIG. 25 and in preceding figures, openings 214 are preferably formed in the side panels to allow room for the slider members and to accent the slider members to consumers alerting them immediately to the presence of a slider member, even before opening the package. The slider openings are preferably formed in the web material prior to delivery for package construction (see 312, 314 in FIG. 29). The slider openings, as with the diamond cut outs and indicia imprinted on the web material are equally spaced at predefined intervals to facilitate subsequent high speed automated production when the web material and fastener tracks are continuously aligned. The periodic spacing is referred to as a "bag width" and is visualized by lines 326 shown in FIG. 30.

Figure 30:
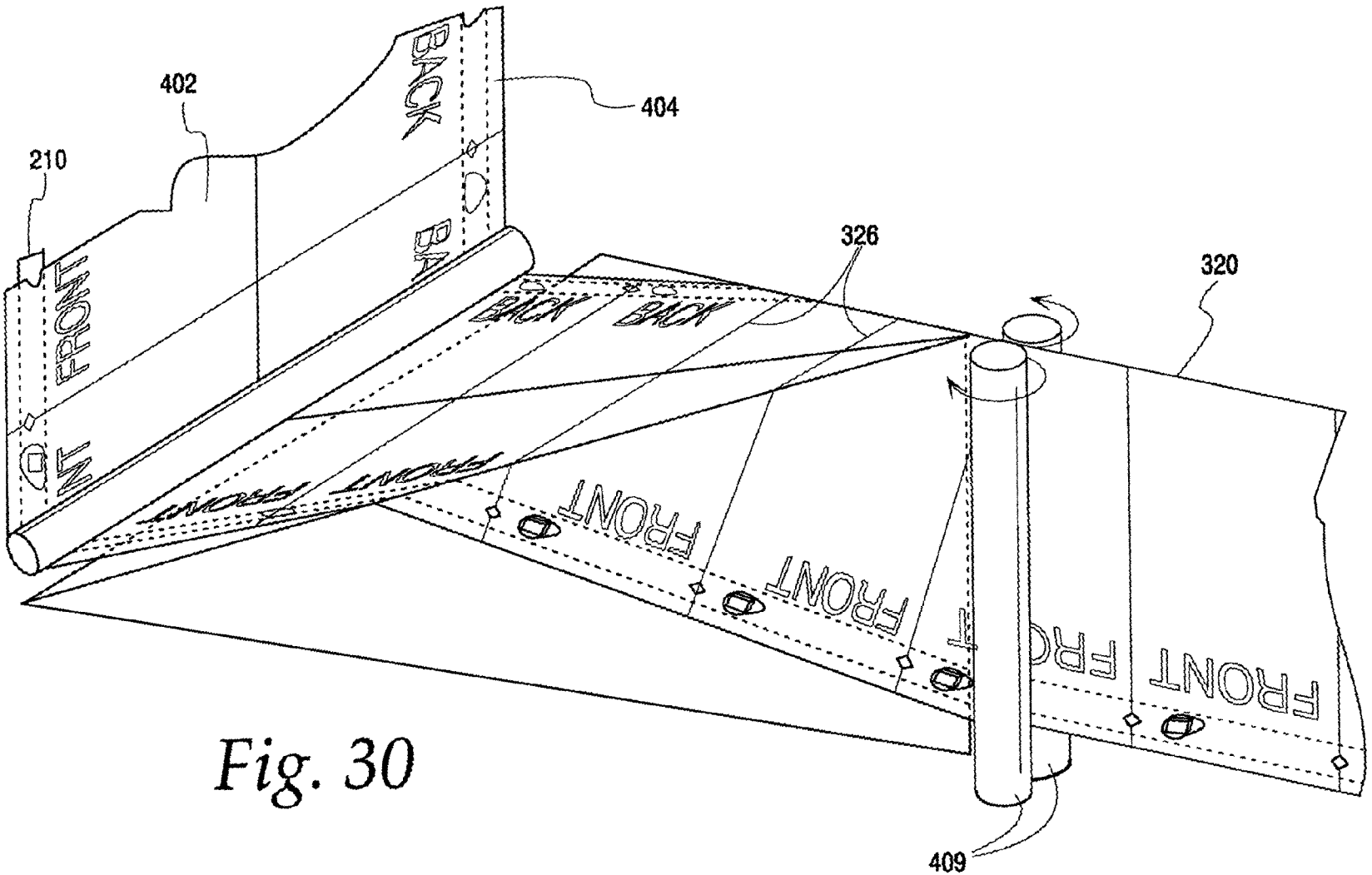
FIG. 30 is a fragmentary perspective view of the web folding operation.
Figure 36:
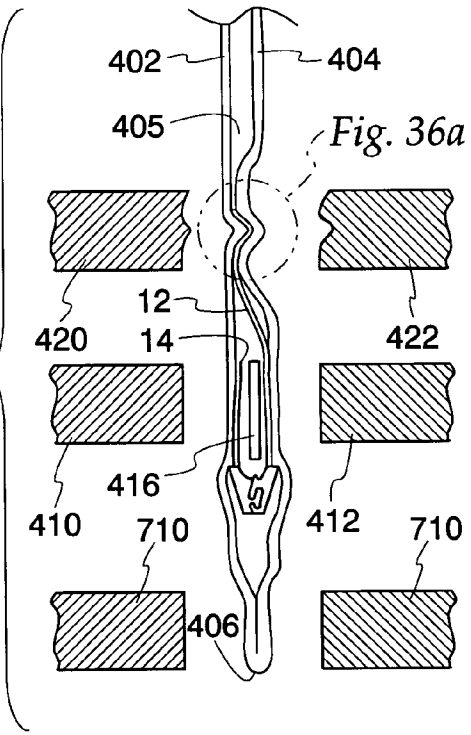
FIG. 36 is a cross-sectional view similar to that of FIG. 35 but showing sealing tools for sealing the fastener track to the package sidewalls.
Figure 35:
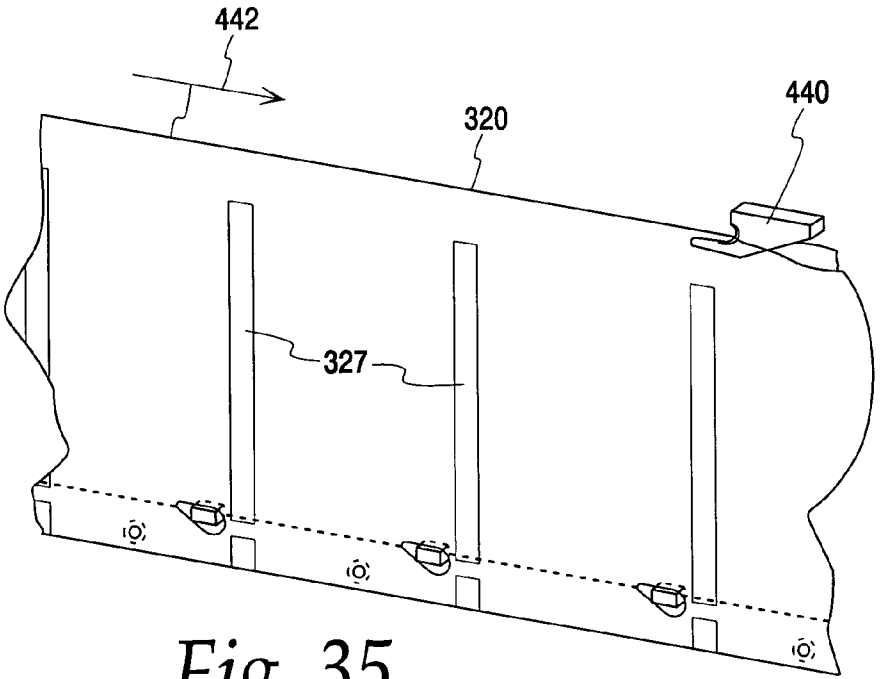
FIG. 35 is a cross-sectional view of a package immediately following a flange sealing operation.

Referring to FIGS. 26, 29 and 30, a supply of mated fastener track 210 (preferably comprising fastener tracks 26, 28) is supplied on roll 350. As mentioned, the fastener tracks can take a variety of different cross-sectional shapes, all of which can be accommodated by apparatus 300. Generally, the fastener tracks include respective mounting flanges which at least partly overlie one another, and which extend along the mated fastener tracks. As can be seen in FIGS. 35 and 36, the mounting flanges of the illustrated embodiment are of unequal height (with the food package viewed in an upright position) and extend different amounts from the fastener tracks. Further details concerning the construction and operation of these mated fastener tracks 210 and slider 30 of the preferred embodiment may be obtained with reference to U.S. Pat. No. 6,047,450, the disclosure of which is herein incorporated by reference.

With reference to FIG. 29, the mated fastener track 210 is fed through a roller guides 354 to enter a work station generally indicated at 360 for forming stops 68 in the mated fastener track. An adjacent work station 364 is provided for applying slide members 30 to the fastener track.

Figure 31:
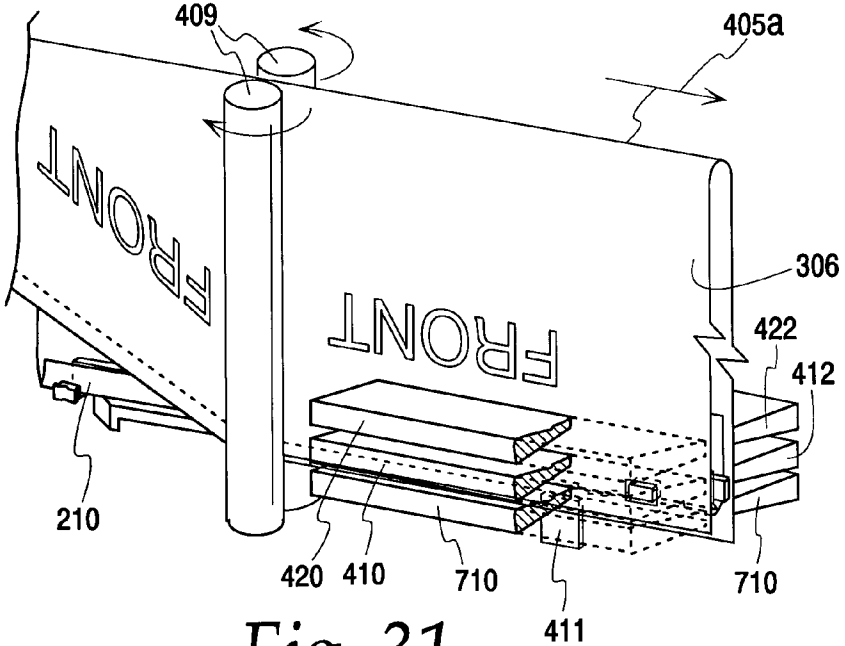

Turning again to FIG. 26 and with additional reference to FIG. 31, the prepared zipper track (with end stops and slider members) and the reverse folded web is brought together at fastener sealing station 400. FIG. 38*a* shows a cross section of the reverse folded web and fastener track prior to entering the sealing station. As shown, web 306 is folded into an inverted general V-shape to form opposed front and rear panels 402, 404 joined by a dead fold 320. As shown in figures, a serial succession of folded package portions depends downwardly from dead fold 320. Each folded package portion has the same pre-defined package with and includes overlapping first and second package side walls with an upper package portion end including overlying free ends located remote from the dead fold 320 and a lower package portion end adjacent the dead fold, and with intermediate portions between the upper and lower package portion ends. In the preferred embodiment, the upper package portion ends include shroud portions although the shroud feature can be omitted if desired. Thus, it can be seen that the package portions of the reverse folded web are oriented in an upside down manner while being processed through the package forming apparatus. The mated fastener track includes mated male and female track members 26, 28 as described above, for example, with reference to FIG. 2. Track members 26, 28 of this embodiment include a longer depending flange 12 and a shorter depending flange 14, respectively. The side 14*a* of flange 14 is joined to the opposing interior surface 402*a* of panel 402, and the lower surface portion 12*a* is joined to panel surface 402*a*. The outwardly facing surface portions 12*b* and 12*c* are joined to the opposing interior surface 404*a* of panel 404. As mentioned, the mated fastener tracks are crushed or stomped to form a serial succession of spaced apart back-to-back slider stop portions. The slider stop portions are spaced apart by the same pre-selected package width as that of the web material. The mated fastener tracks and web material are registered or aligned to one another according to the common bag width spacing. In this manner, the fastener track material can be processed ahead of time and the web material can be pre-printed and pre-punched at a convenient, preferably remote location.

Figure 36A:
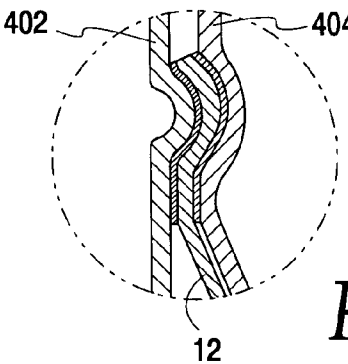
FIG. 36*a* is a fragmentary view of FIG. 36 taken on an enlarged scale.

As will be seen herein, the mated fastener track flanges are either coupled or directly sealed to the package side walls so as to form a peal seal such as that shown in FIG. 36*a*. If desired, the zipper track flanges can be sealed directly to respective side wall panels, omitting the peal seal feature. If desired, the fastener track flanges in this optional form can be of generally equal length. However, in the preferred embodiment, the first fastener track is provided with a shorter flange and is mated to a second track with a longer flange. Preferably, the step of coupling the first and second fastener track flanges to the intermediate portions of respective package side walls comprises a first step of sealing the first fastener track flange to the intermediate portion of the first package side wall and a second step of sealing a peal seal between a portion of the second fastener track flange and a portion of the first package side wall at a point between the fastener tracks and the bottom package portions. In a third step, the second fastener track flange is sealed to the second package side wall as shown for example in FIG. 47.

Figure 59:
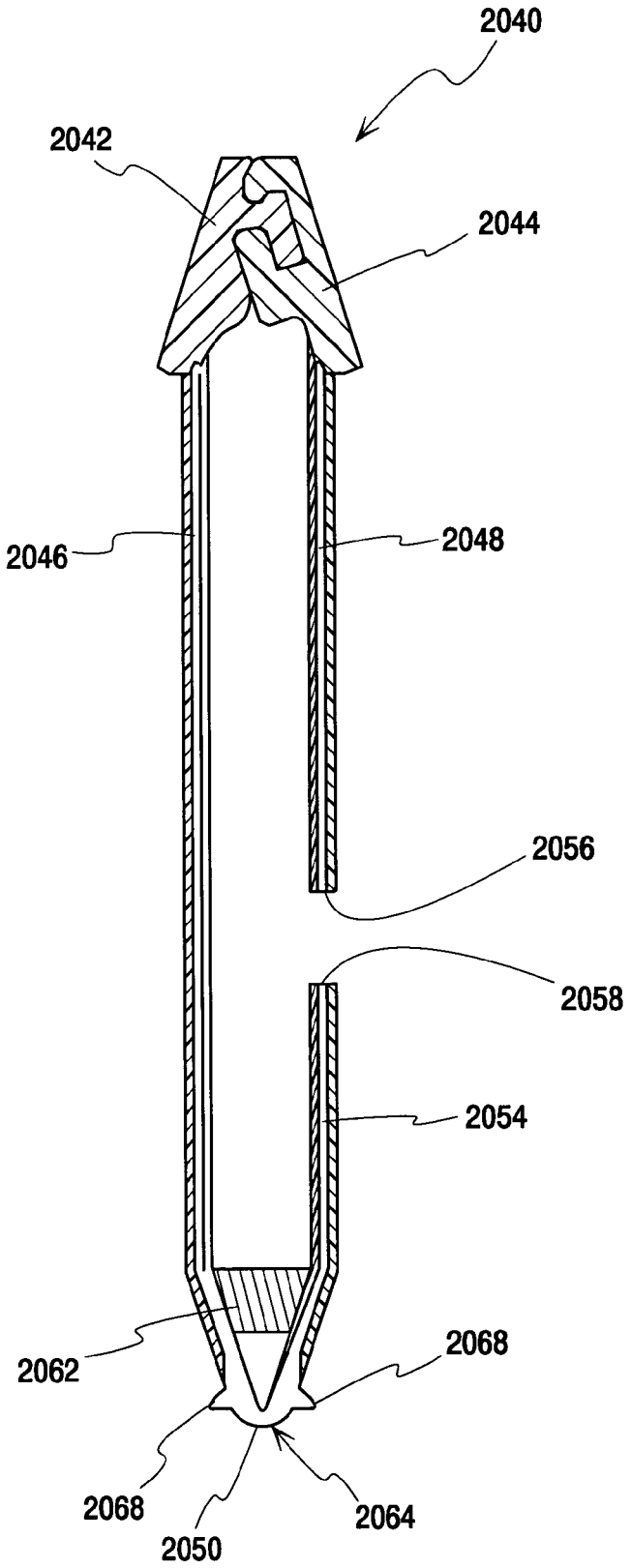
FIG. 59 is a cross-sectional view taken along the line 59-59 of FIG. 58.

Referring to FIG. 29, the fastener track is aligned with the underside of web 306 and is tacked to the flat, unfolded web 306 by sealing members in a preliminary sealing step using tools 401, 403 prior to folding of the web which might otherwise misalign the zipper track and web materials. Either of the fastener track flanges can be sealed to the web material in the preliminary sealing step. When the fastener track 2040 of FIG. 59 is employed, it is generally preferred that a pre-seal portion of the longer flange be tacked to the web material in the preliminary sealing step.

As indicated above, web 306 is pre-printed and pre-punched with different types of punches, prior to package assembly. Track 210 is deformed or crushed prior to station 400 at defined intervals to form mirror image back-to-back stop portions which are severed into equal half portions at slitting station 460. It is important that the deformed zipper tracks and pre-formed web material be carefully aligned and registered one to the other according to the pre-determined bag width spacing referred to above. Preferably, web sensors are located adjacent upstream punch 312 as schematically indicated at 313 (see FIG. 29). An output from sensor 313 is fed to controller 315 which may take any conventional form, but preferably comprises a programmable digital computer. Controller 315, in turn controls operation of stop forming station 360, providing precise "bag width" spacing of deformed stop portions along the length of track 210. Controller 315 also controls the precise placement of sliders onto track 210, at station 364.

Figure 32:
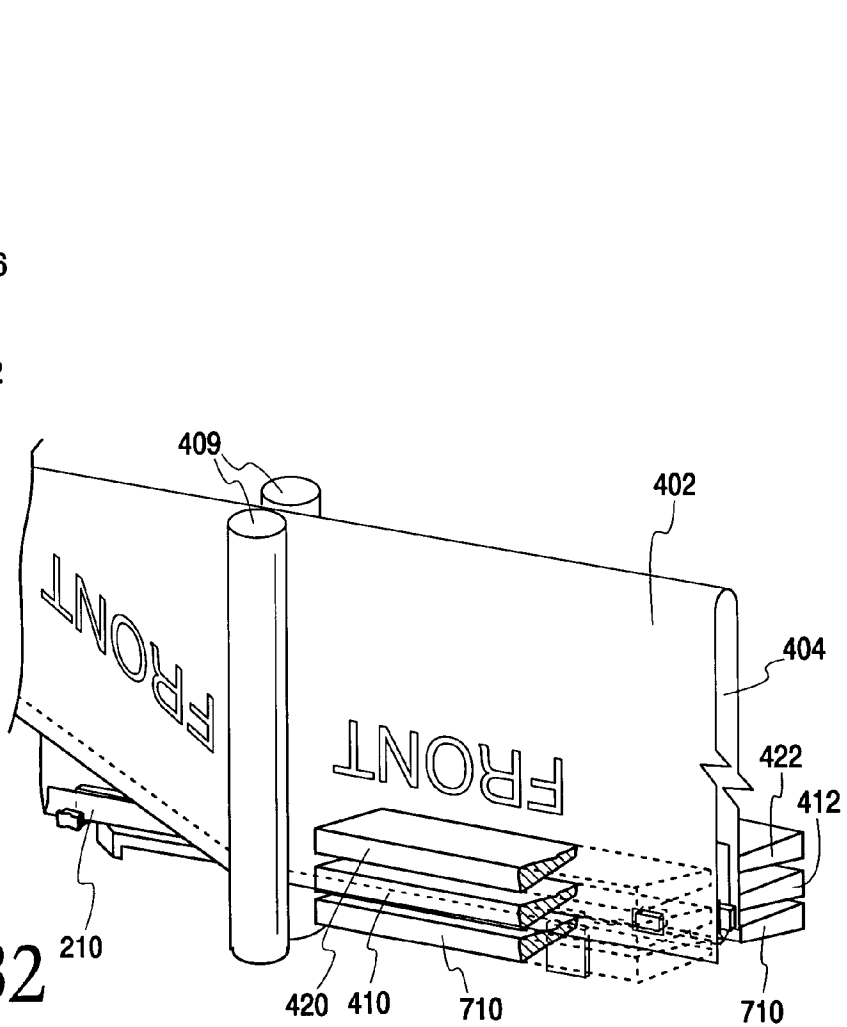
FIGS. 31 and 32 are fragmentary perspective views of a web sealing operation.

With reference to FIGS. 29, 30 and 31, controller 315 also controls operation of drive rollers 409 which drive the joined assembly of fastener tracks and folded web material. For example, with reference to FIG. 31, a fusion sealing station is located immediately downstream of pre-folding station 400 shown in FIG. 29 (see FIGS. 31, 32). Drive rollers 409, located downstream of the reverse folding plow drive the folded web 306 in the downstream direction of arrow 405*a*. FIG. 31 shows an alternative track pre-sealing operation in which the mated fastener track 210 is fed between the folded panel portions of web 306 and is fusion sealed to the web panels by track fusion sealing die 420, 422. Thus, when employing the alternative arrangement shown in FIG. 31, the flat web sealing die 401, 403 of FIG. 29 are omitted. A guide member 411 is interposed between the track sections. The panels are open at the bottom, allowing free access for tooling such guide member 411, as shown in FIG. 31. With reference to FIG. 36, for the preferred flexible package, three pairs of sealing dies are required. The middle pair of sealing dies indicated by reference numerals 410, 412 cooperate with the arrangement shown in FIG. 31 to provide a permanent or fusion seal of the zipper track to the web. In the arrangement indicated in FIG. 31, sealing dies 410, 412 provide the only joinder of the zipper track to the web material. Referring to FIG. 32, if the flexible package is to be constructed without a shroud member, the sealing dies 710 are omitted.

Referring now to FIG. 32, an arrangement similar to that of FIG. 31 is shown. The arrangement of FIG. 32 is substantially identical to that of FIG. 31, except that the web is folded such that the rear panel 404 is slightly shorter than the front panel 402, so as to expose the rearwardly facing mating track. This arrangement allows a user ready access to the zipper or fastener tracks. As will be seen herein, the zipper track can, alternatively, be joined to the web after the web is folded. In this arrangement, the sealing dies 710 are not needed.

Sealing of the prepared fastener track to the side wall panels is carried out at pre-folding station 400, which can accommodate normal as well as reverse folded webs. With reference to FIG. 36, six horizontal sealing tools are arranged in three pairs. The middle pair of sealing tools or dies includes sealing die 410 adjacent panel 402 and sealing die 412 adjacent panel 404. As will be seen herein, panel 402 preferably comprises the front panel of the flexible package while panel 404 comprises the opposed, rear side of the package. If desired, printing on the front and rear panels 402, 404 could be interchanged one for the other. A normally folded web is shown in FIG. 36, although a reverse folded web could be processed without change of tooling. Thus the pre-folding station provides flexible dual mode operation.

As mentioned, it is desired that flange 14 be welded or otherwise joined to panel 402 and the longer flange 12 be joined to the panel 404. Accordingly, sealing tools 410, 412 are heated to a temperature sufficient to cause welding or joining. Preferably, sealing is accomplished with the application of pressure and accordingly the sealing tools are mounted for movement toward and away from one another. In order to prevent inadvertent sealing of fastener flanges 12, 14 by sealing tool 410, an unheated separator tool 416 is temporarily placed between flanges 12, 14. Preferably, both sealing tools 410, 412 are advanced toward one another, toward separator tool 416. As mentioned above, the dead fold 406 forms the top of the shroud in the completed flexible package. If desired, the top of the shroud can be reinforced with a sealing fin, using sealing tool 710 to weld the area adjacent the dead fold 406.

Flange 14 is welded to panel 402, and the longer flange 12 is welded to the panel 404. Accordingly, sealing tools 410 and 412 are heated to a temperature sufficient to cause joining of flanges 12, 14 to panels 402, 404 respectively. In order to prevent inadvertent sealing of fastener flanges 12, 14 by sealing tool 410, an unheated or cooled separator tool 416 is temporarily placed between flanges 12, 14. Preferably, both sealing tools 410, 412 are advanced toward one another, toward separator tool 416. The joinder of the lower surface portion 12*a* of flange 12 and panel 402 forms a conventional peel seal whereas the joinder of flange 14 to panel 402 comprises a permanent seal, as shown in FIG. 36, which shows formation tooling, using either normal or reverse fold techniques.

Figure 38:
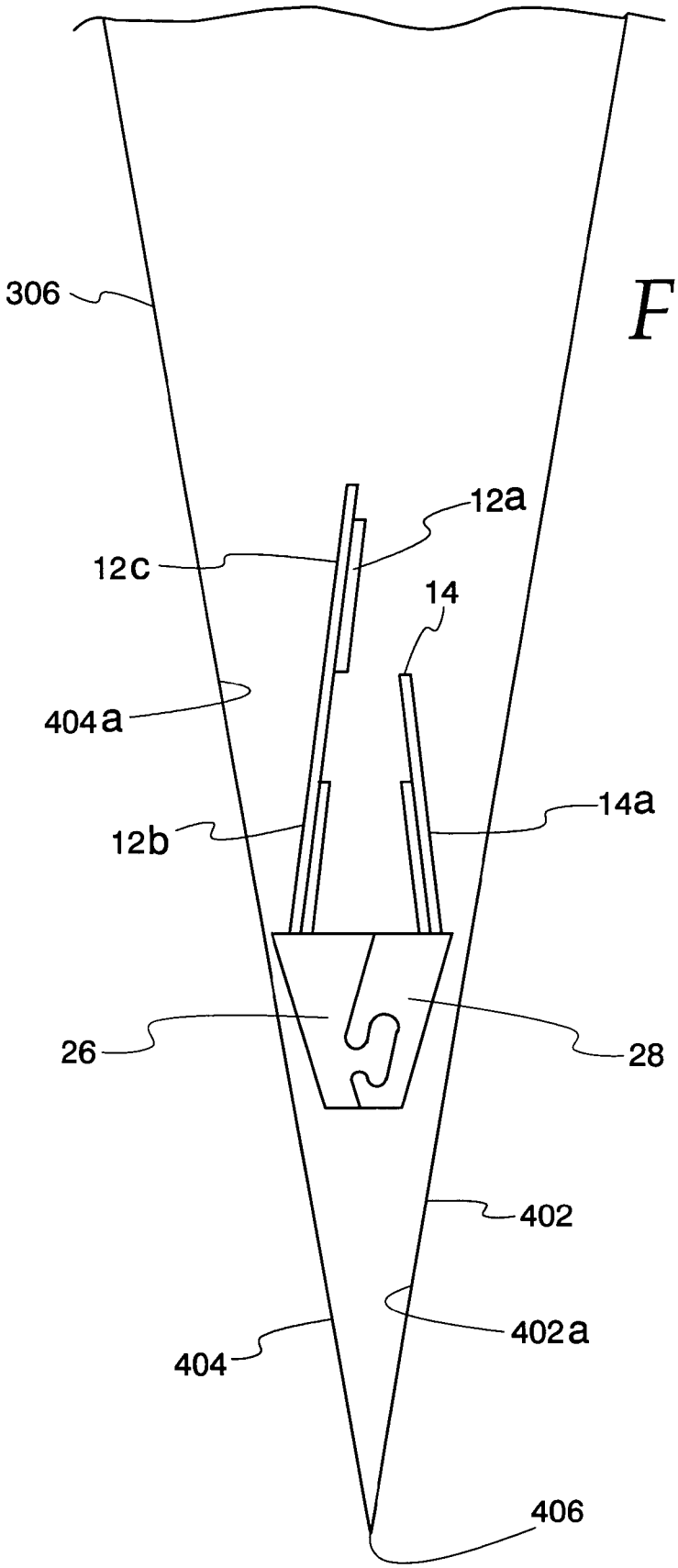
FIG. 38 is a fragmentary perspective view of a normal folded web and mated fastener track assembly, prior to sealing operation.
Figure 38A:
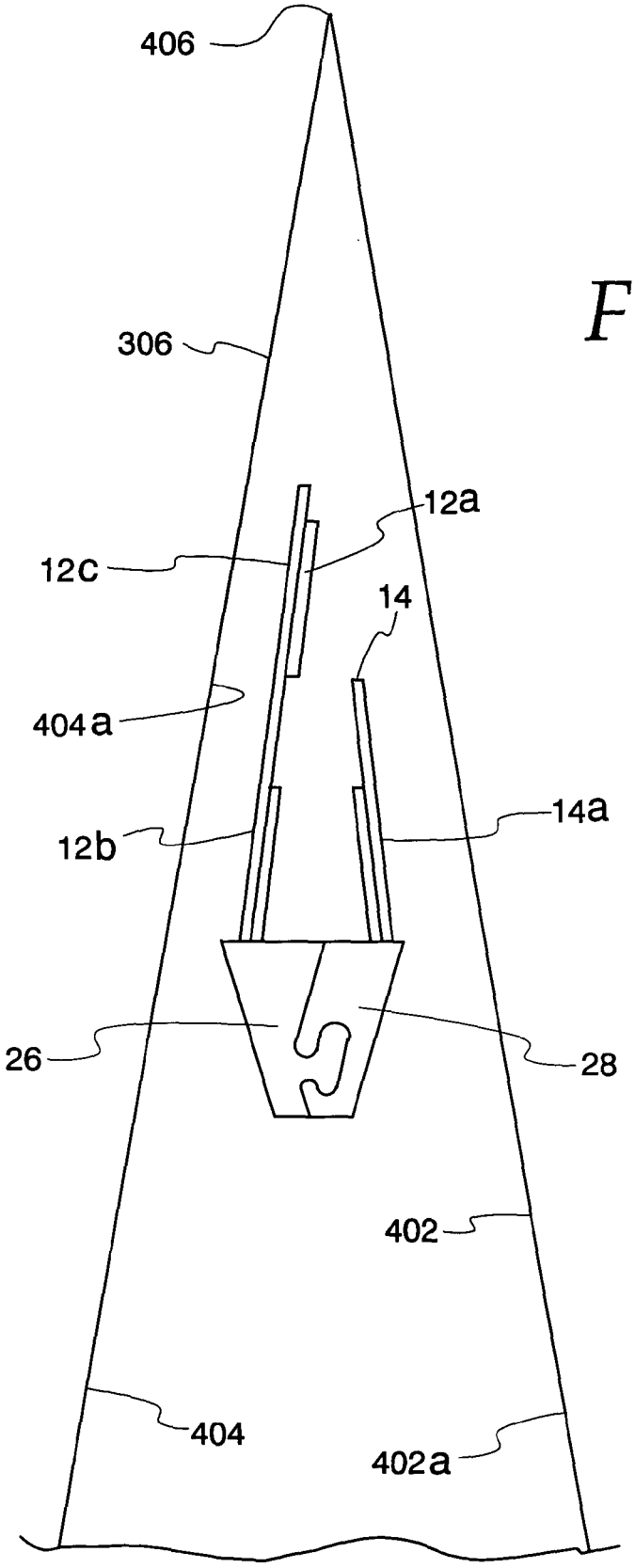
FIG. 38*a* is a cross-sectional view similar to that of FIG. 38, but showing a reverse folded web.

With reference to FIGS. 36 and 38, it is desired that the end portion of interior face 12*a* be joined to panel 402 to form a peel seal. Accordingly, a pair of sealing tools 420, 422 are advanced toward one another to bring flange face 12*a* in contact with the opposed interior surface 402*a* of panel 402 and to form a permanent seal between end portion 12*c* and face 404*a* of panel 404. If desired, a sealing tools 420, 422 can have generally flat, opposing faces as with sealing tools 410, 412, for example. However, it has been found desirable to enhance the seal strength on both faces of the free end of flange 12, in order to prevent product intrusion or "creep" during filling. In order to facilitate high production speeds and rapid filling operations, attention must be given to the impingement or impact force of the product falling in area 405, as indicated in FIG. 36. Depending upon the materials employed, impingement forces in the area 405 might tend to separate the peel seal and permanent seal formed at the free end of flange 12. In order to facilitate the use of light weight packaging films for the package panels and to otherwise enhance the sealing strength in area 405, it has been found desirable to provide the mating faces of sealing tools 420, 422 with an interlocking ridge and groove patterns. As indicated in FIG. 36, it is preferred that the opposing faces of sealing tools 420, 422 have curved, rounded features so as to allow higher heat loadings without undesired cutting as would otherwise result from the use of sharp or sharply rounded tooling seal features. Although a single, simple nested curve could be employed for the seal tools 420, 422, a double reentrance or generally S-shape is preferred.

Figure 37:
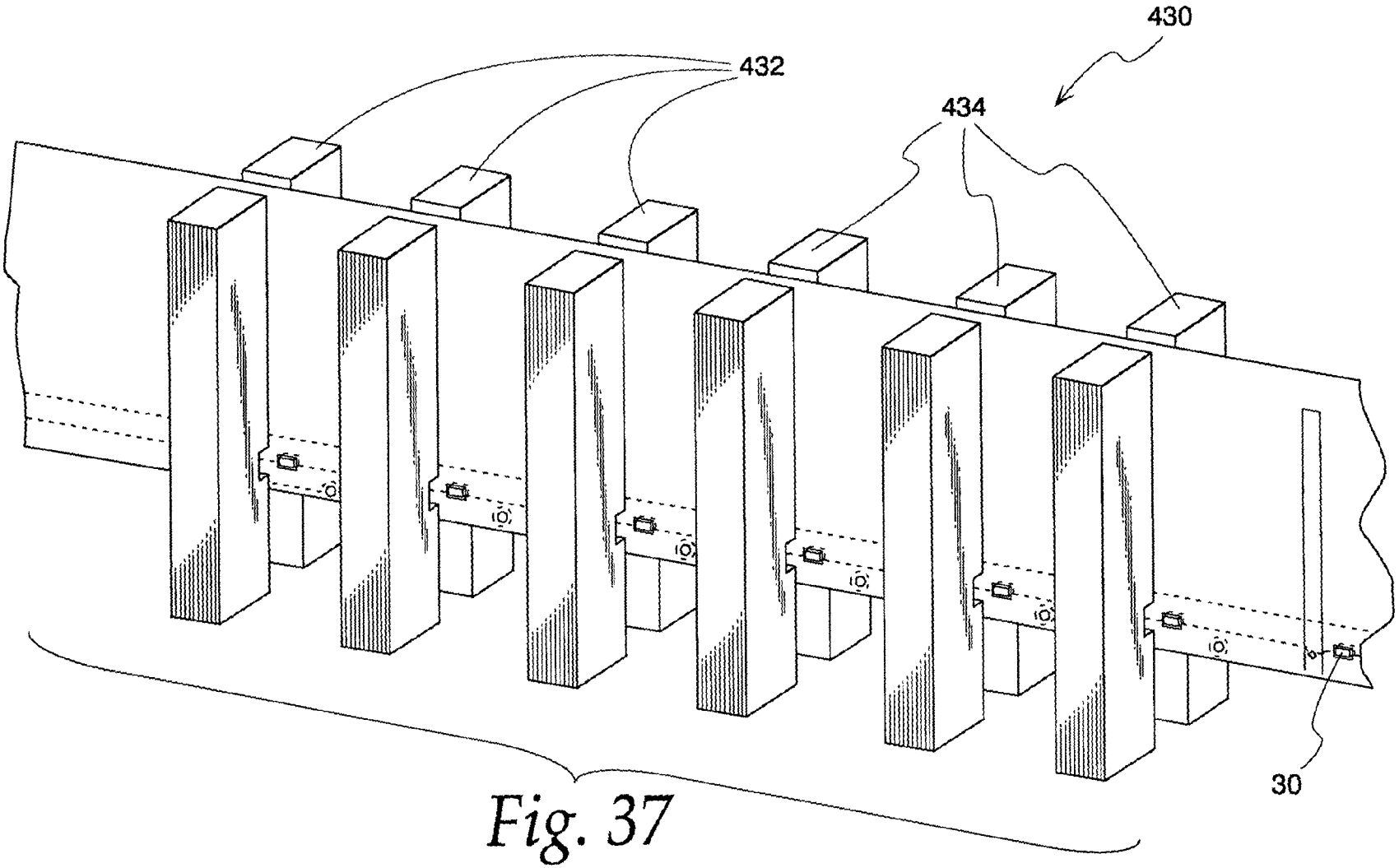
FIG. 37 is a fragmentary perspective view of a side sealing station.

Turning now to FIG. 37, the joined web and prepared fastener tracks are advanced to the station 430. Pairs of vertical sealing bars 432 cooperate to form reduced length side seals for the flexible package. Turning now to FIG. 35, it can be seen that side seals 327 are of reduced height in two ways. First, the side seals 327 stop short of dead fold 320, and second the side seals 327 also stop short of end stops 68 formed along track 210, as indicated by gap g in FIG. 25, so as to provide an intervening spacing. In this manner, unwanted deformation of the end stop is avoided as the side seals are formed. Accordingly, the vertical sealing bars 432 are foreshortened with respect to the overall height of the flexible package.

In the preferred embodiment, sealing bars 432 have heat loadings optimized for rapid assembly. Accordingly, it has been found desirable to add vertical cooling bars 434 at a downstream position to withdraw heat from the side seals. As mentioned above, the vertical sealing bars are foreshortened with respect to the overall height of the flexible package. The vertical cooling bars could also be foreshortened in a similar manner, since their function is to withdraw excess heat lingering after fusion of the side seals is completed. Alternatively, the cooling bars can extend upward beyond the side seals, if desired. If desired, additional operations such as forming peg holes on the side panels with punches 438 can be performed while the bag chain or serial succession of folded package portions is temporarily stopped at station 430. If desired, the punching operation or other operations on the bag panels can be carried out at station 450 located immediately downstream of station 430 (see FIG. 26).

Referring again to FIG. 35, the bag portions are connected together in a serial succession in the form of a bag chain. As mentioned, a gap is provided between side seals 327 and dead fold 320 to allow the unimpeded relative travel between the bag chain and the slitting knife 440 located either at alternate work station 450 or at a point between work stations 430 and 450. Slitting knife 440 is preferably held in a stationary position as the bag chain travels in the direction of arrow 442 to slit the dead fold, forming a fill opening. In this manner, the individual bag portions are readied for forming and filling while providing a number of manufacturing advantages, such as improved positional stability for the bag chain immediately prior to subsequent operations. Top filling and final sealing of the upper end of the flexible packages remains to be accomplished. If desired the filling and final, top sealing could be performed with the flexible packages serially connected in a bag chain. However, it is preferred that the individual, partially formed flexible packages be separated from one another at station 460.

Figure 40:
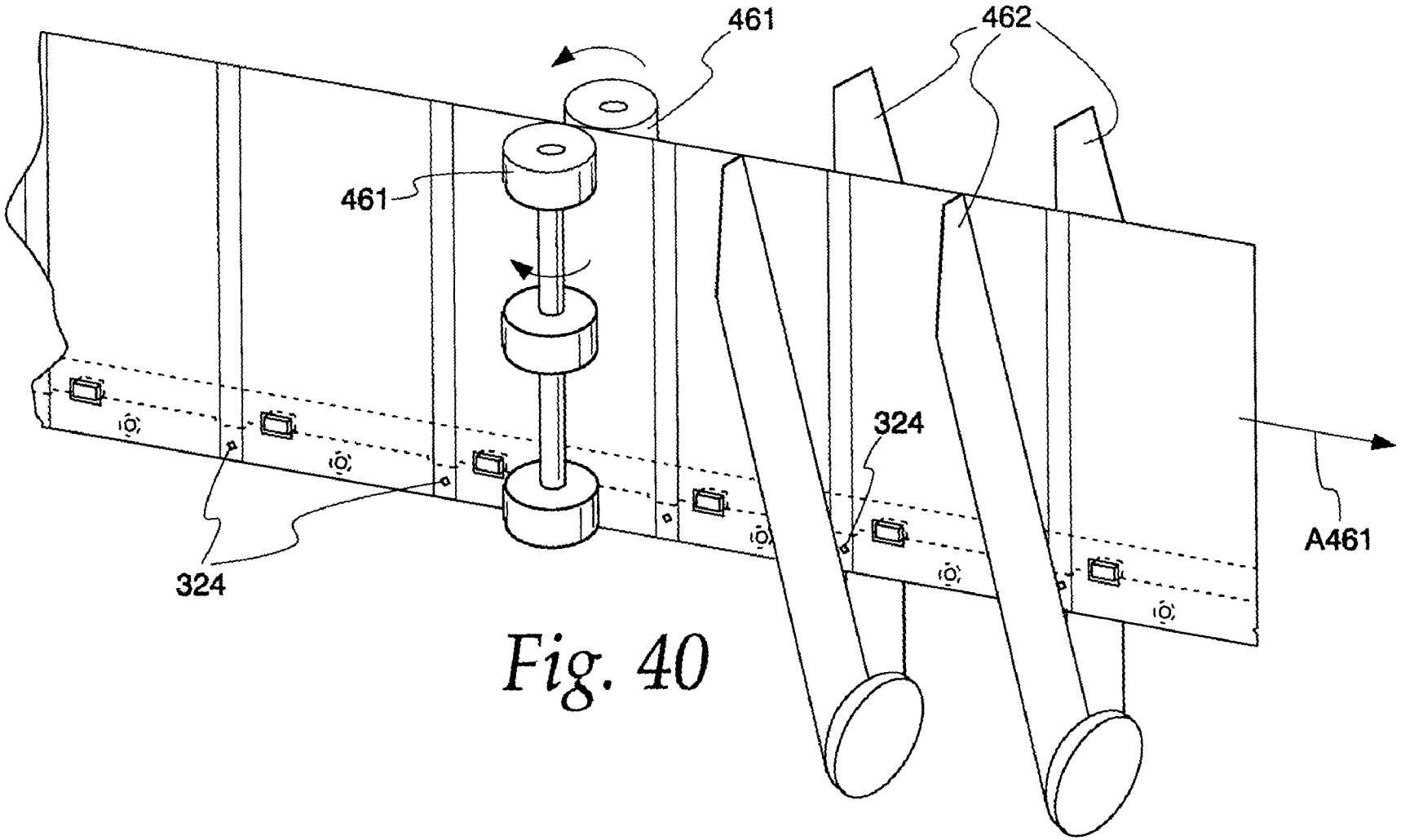
FIG. 40 is a fragmentary perspective view of a package severing station.

With reference to FIG. 40, a series of guillotine-type knives 462 are employed to sever the bag chain to separate the empty, partially formed flexible packages at the end of the bag chain. Knives 462 are aligned so as to intersect the diamond-shaped openings 324, forming opposed V-shaped notches in side seals of adjacent flexible packages. Knives 462 are also aligned so as to divide end stop portions formed in the fastener track at station 360.

Referring again to FIG. 40, drive rollers 461 engage the bag chain for feeding in the forward direction of arrow A461. Preferably, the bag chain is advanced in a stepwise manner, bringing various portions of the bag chain to appropriate work stations, as described above. Controls for managing operation of drive rollers 461 can be located anywhere along the bag chain. As mentioned, sensors are preferably located immediately upstream of the punch station which contains punches 312, 314. Controller 315 (see FIG. 29) is preferably employed to control operation of drive rollers 461 (see FIG. 40).

It is generally preferred that V-shaped notches be formed in both side seals of the flexible packages. It is generally preferred that the portions of the bag chain be supported prior to the severing operation so as to maintain positional control of the severed flexible packages. Any of a number of conventional supports, such as vacuum operated suction cups can be employed for the purpose.

Figure 33:
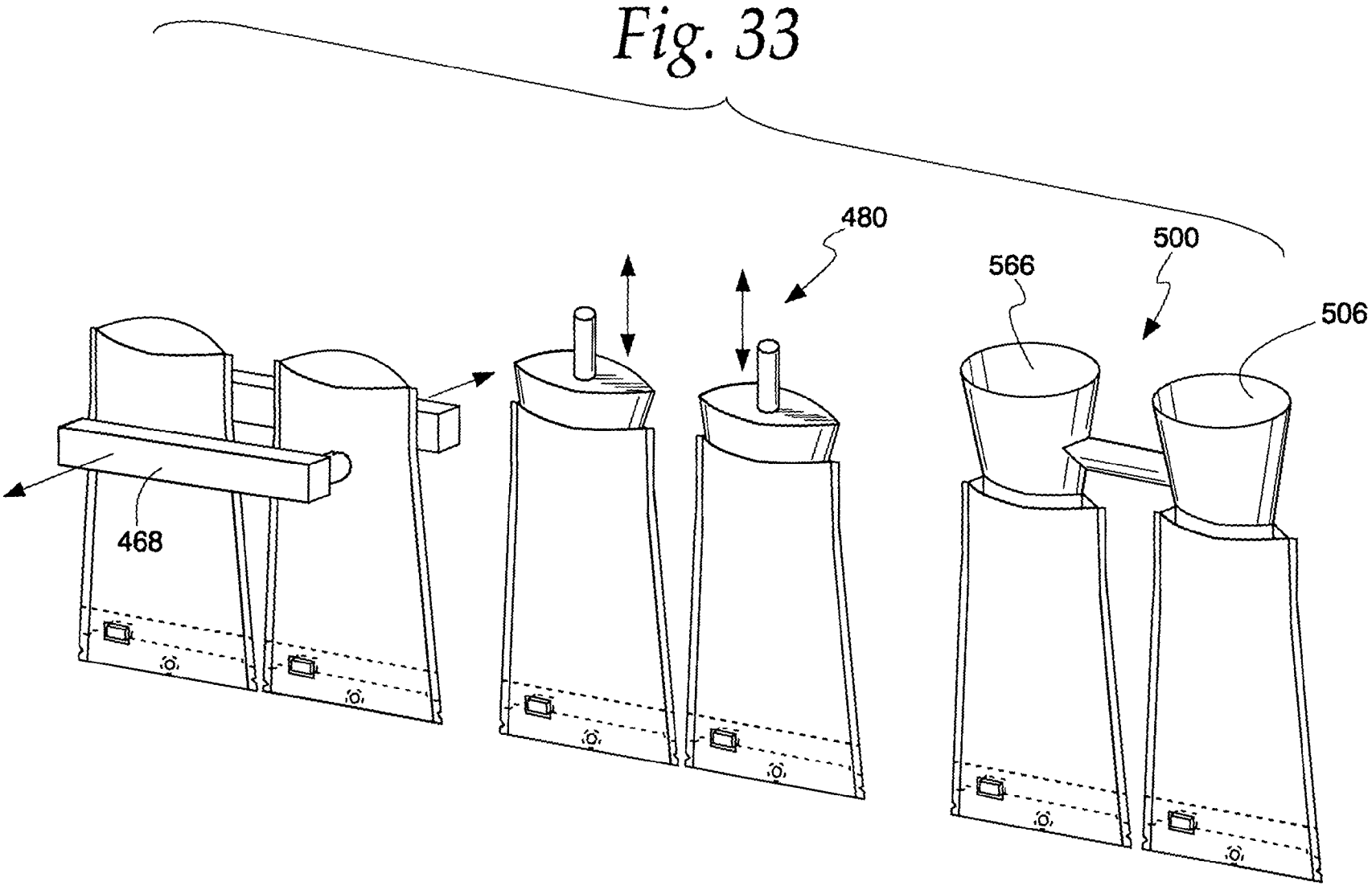
FIG. 33 is a perspective view of a package filling station.

Referring to FIG. 33, upper suction cups 468 are diagrammatically illustrated as spanning a pair of partially formed flexible packages. Preferably, a pair of suction cups 468 are employed, on opposite sides the flexible packages so that, by withdrawing the suction cups away from one another, the upper ends of the flexible packages are opened. At station 480 the interior portions of the flexible packages are inflated in a gas flushing operation. Any suitable gas mixture could be employed, although it is generally preferred that an inert gas for gettering or otherwise displacing oxygen is employed. The separated, but incompletely formed, flexible packages are advanced to filling station 500.

Figure 43:
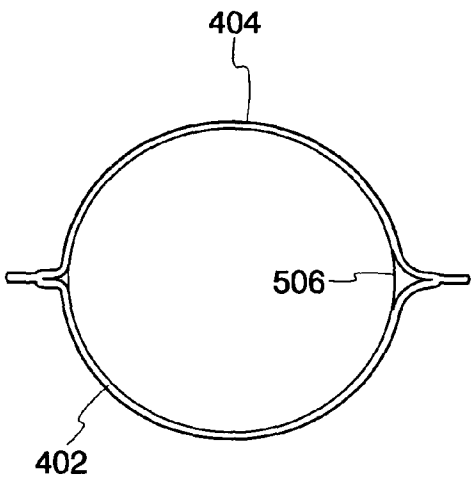
FIG. 43 is a top plan view thereof.
Figure 42:
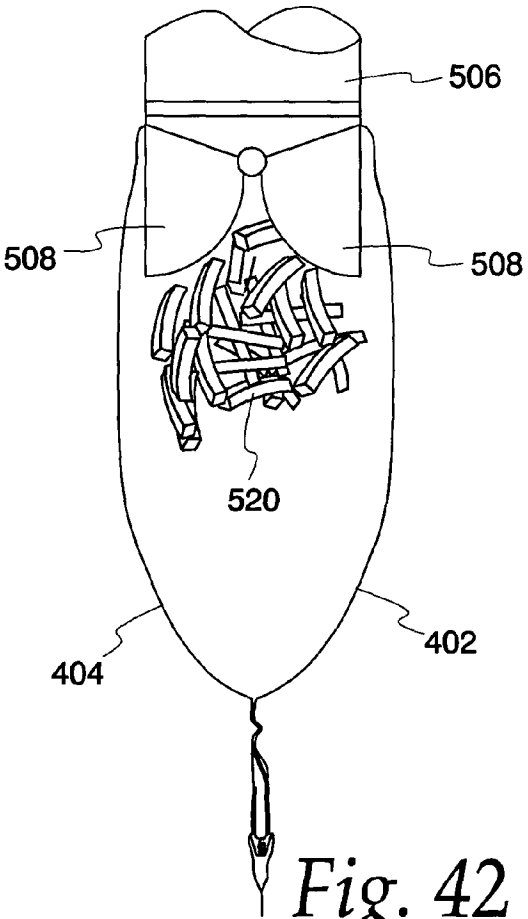
FIG. 42 is a cross-sectional view taken along the line 42-42 of FIG. 41.
Figure 41:
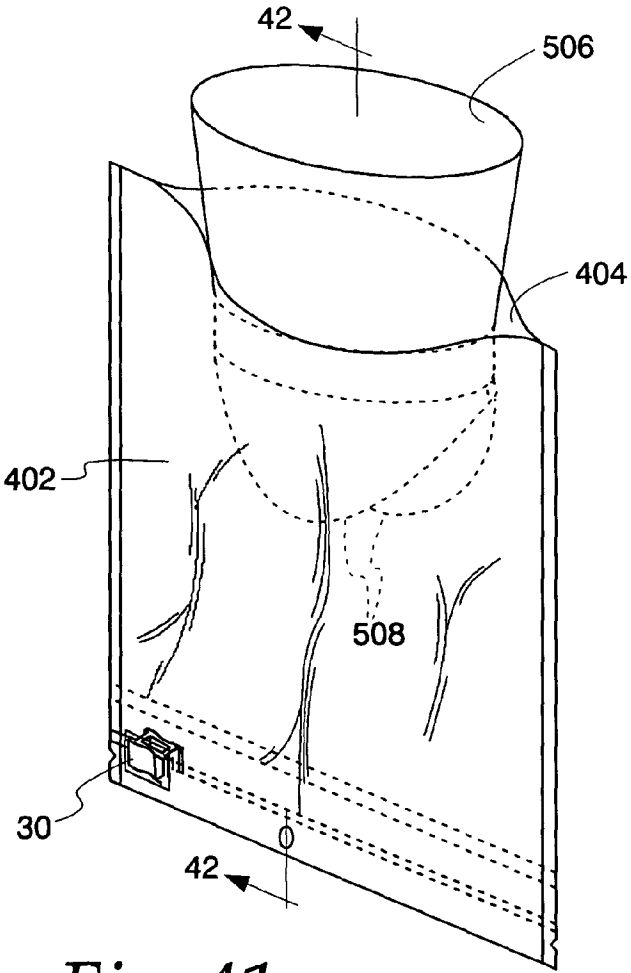
FIG. 41 is a fragmentary perspective view showing filling of the flexible package.

Turning now to FIGS. 33, 41 and 42, duck bill filling apparatus 506 preferably has an articulated clam shell configuration. The bottom ends 508 of the clam shell members are initially brought together so as to facilitate penetration into the interior of the flexible package. The clam shell members are then opened in the manner indicated in FIG. 42 to allow product 520 to drop into the flexible package. FIG. 43 shows the relatively large filling opening made available.

Figure 46:
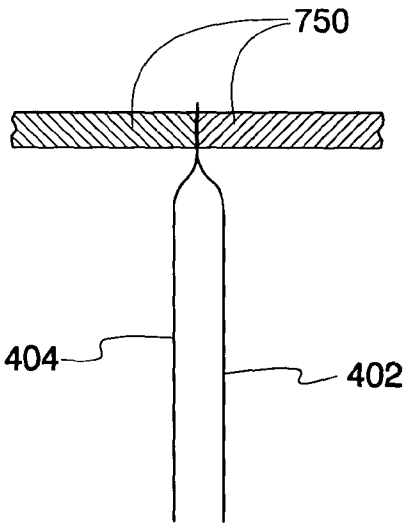
FIG. 46 is a cross-sectional view taken along the line 46-46 of FIG. 45.
Figure 45:
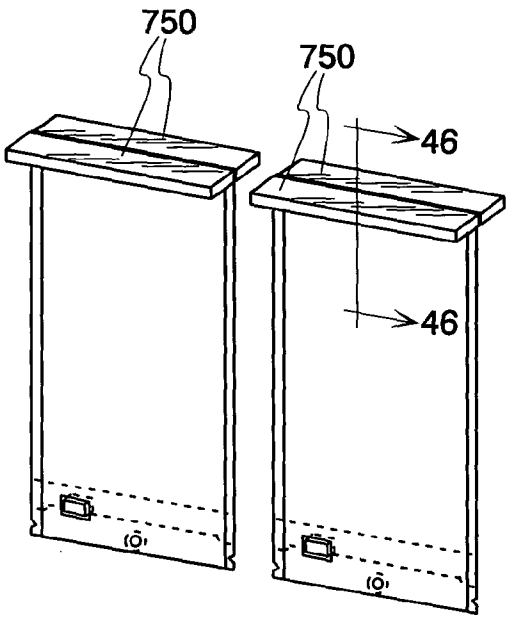
FIG. 45 is a perspective view of a station for sealing bottom portions of a pair of flexible packages.
Figure 44:
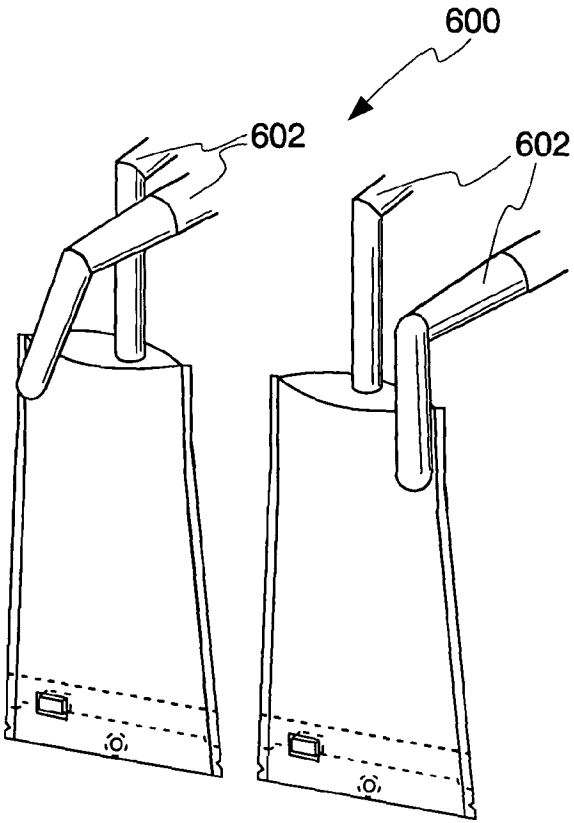
FIG. 44 is a fragmentary perspective view of a work station preparing flexible package for filling.
Figure 47:
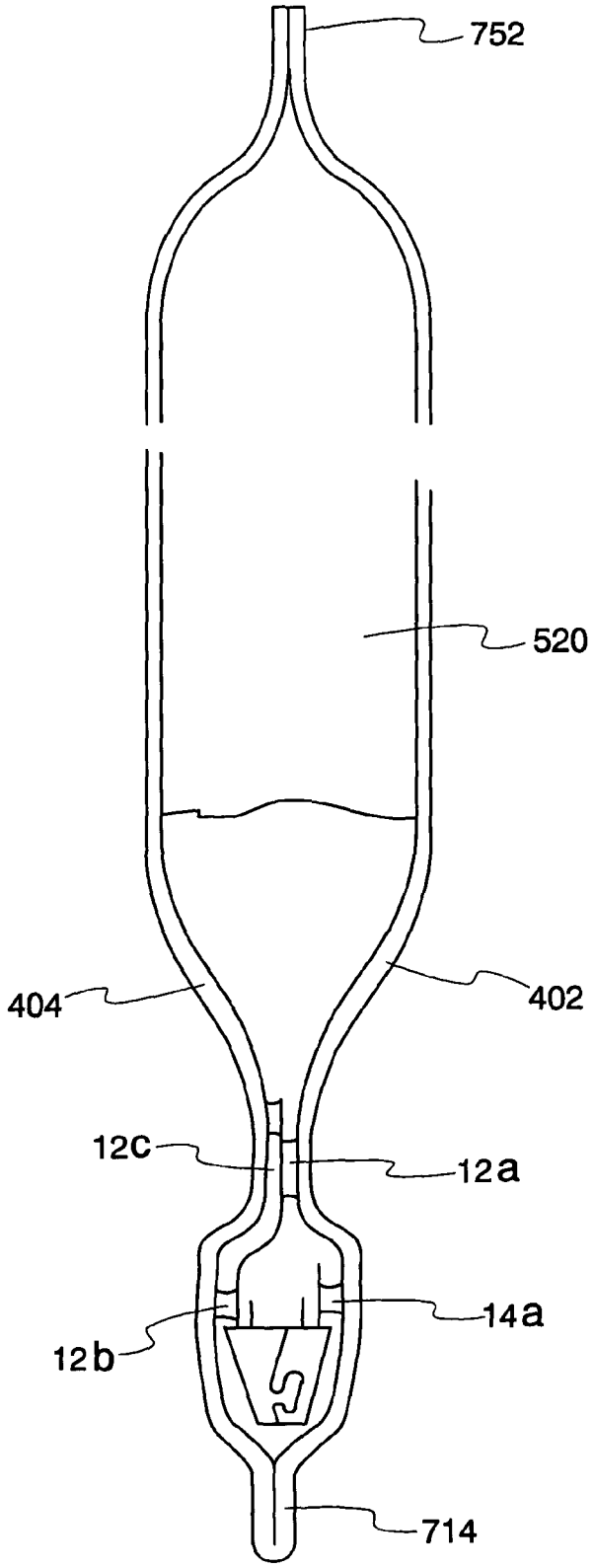
FIG. 47 is a cross-sectional view of the package of FIG. 39, shown in an inverted position.

With filling of the flexible package being completed, a final sealing operation is performed. With reference to FIGS. 26 and 44-46, the flexible packages are advanced to sealing station 600 containing conventional linear stretching apparatus 602. The flexible packages are then advanced to sealing station 700 where the free edges at the bottoms of the flexible packages are sealed. With reference to FIGS. 45 and 46, a pair of sealing bars 750 are employed. As indicated in FIGS. 46 and 47, a fin seal 752 is formed at the bottom of the bag, thus completing formation of the flexible package. If desired, a gusseted construction could be employed at the bottom of the bag.

In addition to advantages described above with reference to the apparatus and method of filling flexible packages, it will be appreciated that the reclosable fastener tracks remain engaged or mated in the closed position throughout the forming, filling and sealing of flexible packages constructed according to principles of the present invention. This reduces the number of unit operations which would otherwise be required to open and reclose the fastener tracks. Further, the working surfaces of the fastener tracks are not exposed to product, dust and particles, which could interfere with reliable mating of the fastener tracks, and the ability of the slider member to move freely. As indicated, for example, in FIG. 35 the longer flange is preferably associated with the male fastener track 26. As seen above, the longer flange, at its bottom end, forms a peel seal with a package panel. The shorter flange, associated with the female fastener track 28 is permanently joined to the package panel at an early stage of operation.

Figure 48:
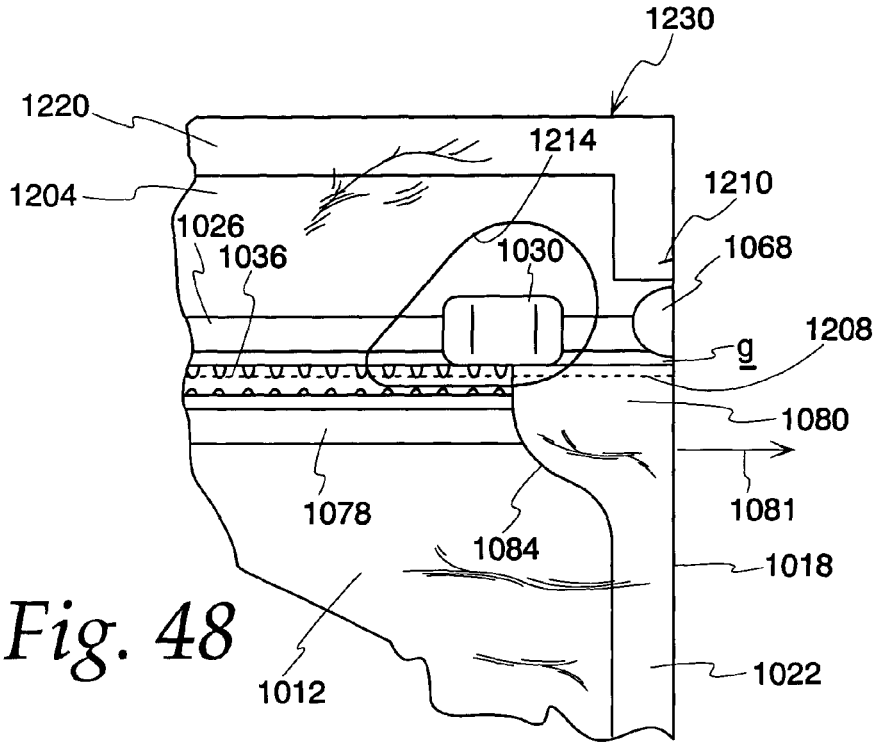
FIG. 48 is a fragmentary elevational view of a further embodiment of a flexible package.
Figure 55:
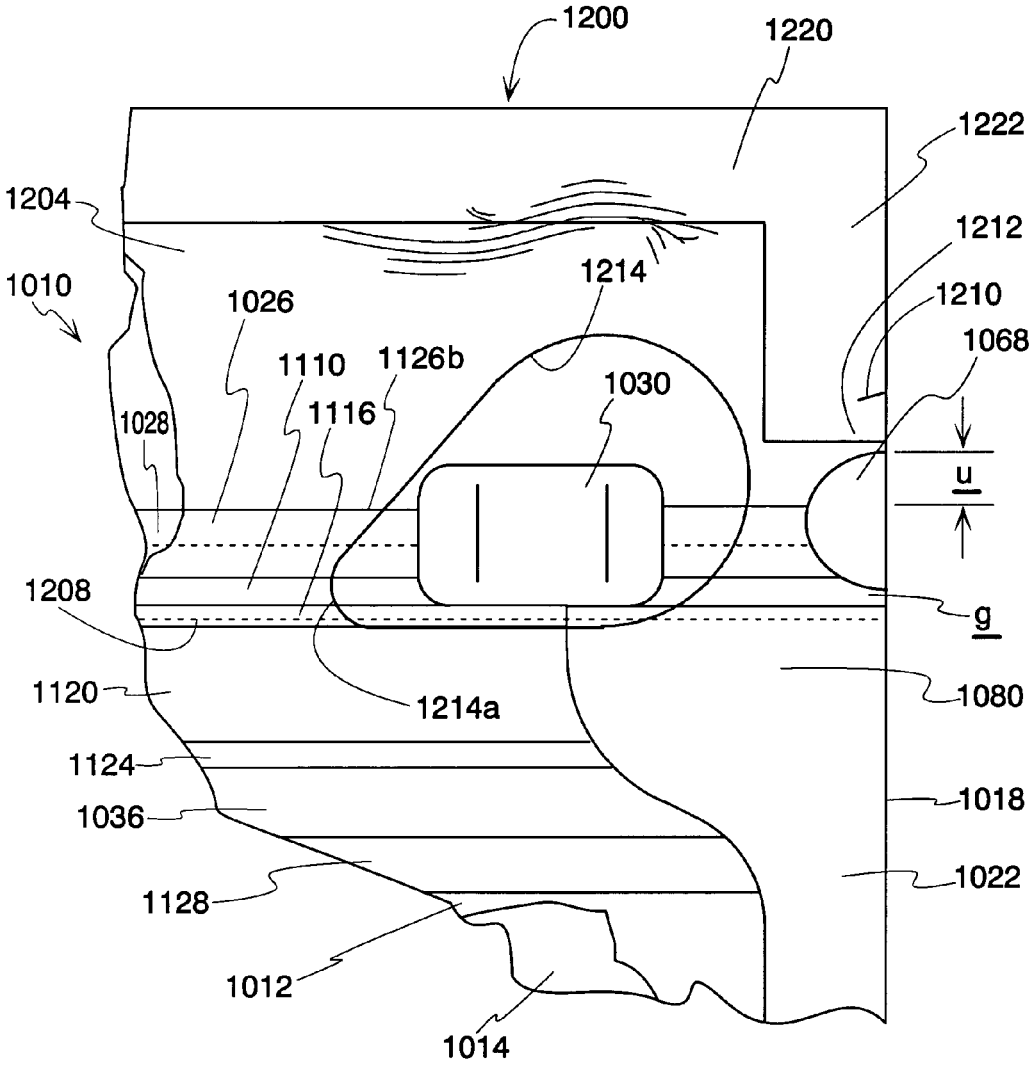
FIG. 55 is a fragmentary elevational view of a further embodiment of a shrouded flexible package.

Referring now to FIGS. 48 and following and initially to FIG. 55, an improved package according to principles of the present invention, is shown. Package 1200 includes the features of flexible package 10, described above and in addition includes a shroud portion 1204 extending above line of weakness 1208 formed in panels 1012, 1014. Line of weakness 1208 can be formed using available conventional techniques, and is preferably formed using laser cutting/scoring techniques. Preferably, line of weakness 1208 extends across the width of flexible package 1200, from one side edge to the other. As shown line of weakness 1208 extends between side seals 1020, 1022 (see FIG. 49).

Figure 49:
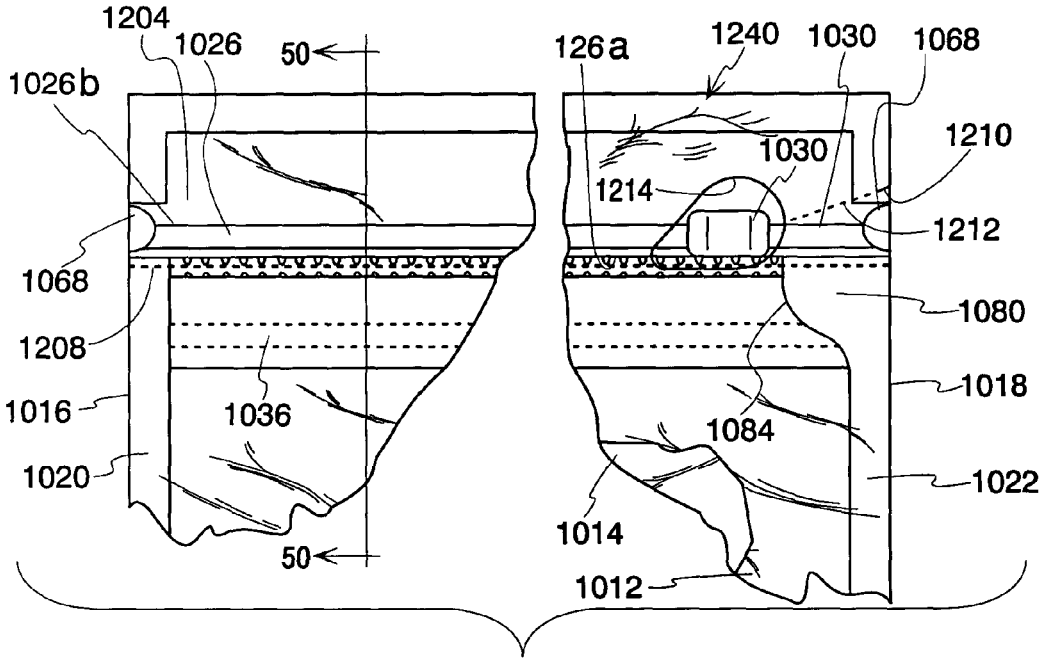
FIG. 49 is a fragmentary elevational view of another embodiment of a shrouded flexible package.

Preferably, shroud 1204 is made for easy tear-away removal in an intuitive manual operation not requiring special directions. Preferably, a tear-start feature 1210 is formed in edge 1018, and is located slightly above stop 1068. The tear-start feature 1210 preferably takes the form of a slit (FIG. 48), but could also comprise an extended line or other weakening feature, if desired (FIG. 49). In the preferred embodiment, as illustrated, the tear-start feature 1210 comprises a linear slit extending toward an opening 1214 which surrounds slider 1030. In the preferred embodiment, the slit line comprising tear-start feature 1210 spaced from opening 1214 and is terminated within a fin seal 1220. If desired, the slit line could extend across the fin seal in a desired, could be made to extend immediately adjacent to or communicating with opening 1214. As will be described more fully herein, opening 1214 has a pointed or acute angle end 1214*a* and the slit line comprising the tear-start feature 1210 is generally aligned with the direction of the pointed end 1214*a* of opening 1214. These features combined to form a convenient directional assist to a consumer during a tear-open operation, ensuring that the tear will continue to a weakening line along with the shroud is severed from the remainder of the flexible package. As will be seen herein, the line of weakness is preferably formed with a laser cutting/scoring operation which ensures a smooth, continuous severing of the shroud from the flexible package.

Preferably, slider 1030 is located at a fully closed position along the fastener tracks and is surrounded by opening 1214 at the closed position. In order to gain access to the package contents, a user grasps the upper edge of shroud 1204 causing an initially tearing at tear-start feature 1210. Tearing continues through the shroud material so as to enter opening 1214, emerging at the pointed or acute angle end 1214*a* through a line of weakness 1208 which, as mentioned above, is preferably formed in a laser cutting/scoring operation. Optionally, as mentioned, a diagonal line may extend between the tear-start feature 1210 and opening 1214. It is generally preferred that such optional line be aligned with the direction of the slit line 1210 and the pointed end 1214*a*. With continued tearing across line of weakness 1208 separation of the shroud is continued the width of package 1200, and the shroud 1204 is removed, leaving a package substantially similar to the packages described above in FIGS. 31-44.

Referring to FIG. 55, shroud 1204 includes an upper fin seal 1220 and a side fin seal portion 1222. Preferably, the upper fin seal 1220 inside fin seal 1222 are formed in separate sealing operations and are made to slightly overlap one another for package integrity and sealing of the package interior. The bottom of side fin seal 1222 is terminated at or slightly above end stop 1068. It is most preferred that side fin seal 1222 be terminated slightly above end stop 1068 to avoid interfering with the controlled formation of the end stop which, as pointed out above, has a shape and position providing novel advantages. Tear-start feature 1210 in the preferred embodiment shown in FIG. 55 is formed at the lower end of side fin seal 1222. If desired, tear-start feature 1210 could be formed in a gap between end stop 1068 and a side fin seal shortened with respect to the side fin seal illustrated in FIG. 55.

Referring now to FIG. 49, flexible package 1240 is substantially identical to flexible package 1200, except for the introduction of a line of weakness 1212 extending between the tear-start feature 1210 and the opening 1214. The arrangement of FIG. 49 is preferably employed where the material chosen for the flexible package or at least the shroud portion thereof is easily stretched rather than torn cleanly when subjected to a tearing force. Addition of the weakening line adjoining the tear-start feature and the opening helps to improve the directionality of the tearing force applied by a consumer. Preferably, the direction of tearing force is generally aligned with the direction of the pointed end 1214*a* of opening 1214 (see FIG. 55).

Figure 50:
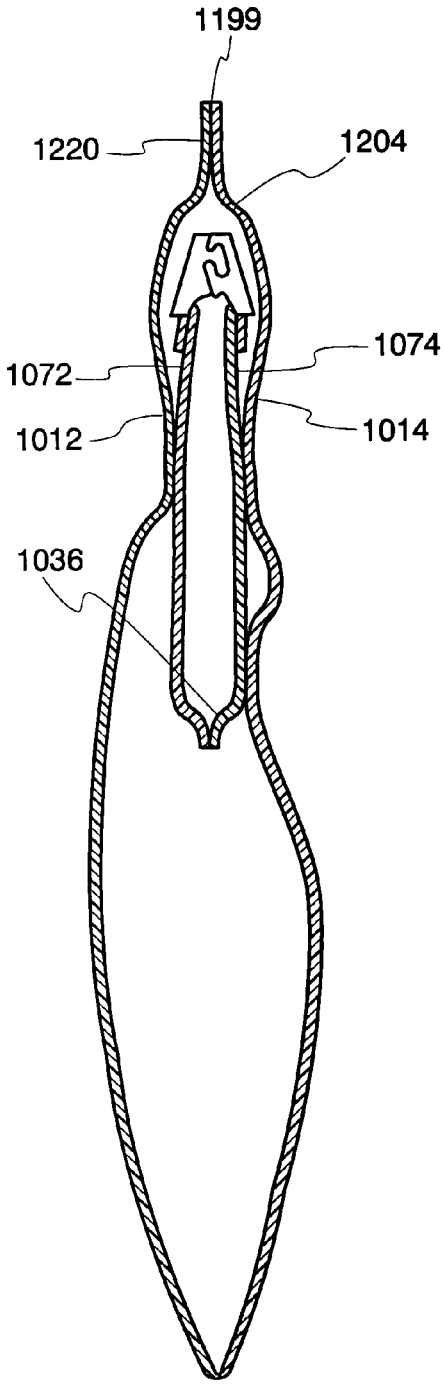
FIG. 50 is a cross-sectional view taken along the line 50-50 of FIG. 49.

Referring now to FIG. 50, a cross section of flexible package 1200 is shown. Preferably, shroud 1204 is formed as a continuous integral extension of panels 1012, 1014, the upper free edges of which are joined together to form upper fin seal 1220. The fastener track arrangement described above with reference to FIG. 10*b* is used.

Figure 51:
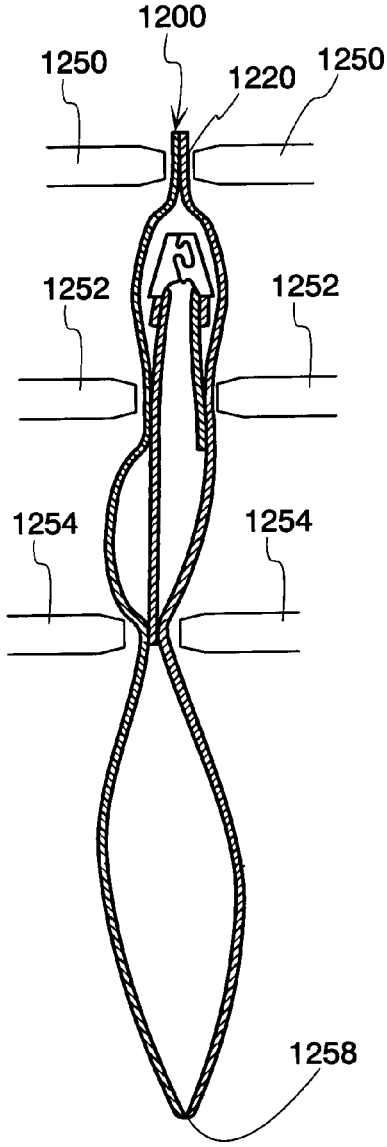
FIG. 51 is a cross-sectional view similar to that of FIG. 50, shown with the schematic depiction of tooling to form the flexible package.

Referring to FIG. 51, exemplary tooling to form the package 1200 is shown. For example, a pair of upper seal bars 1250 form upper fin seal 1220 while a pair of intermediate seal bars 1252 join panels 1012, 1014 to fastener flanges 1072, 1074. Lower seal bars 1254 form the peel seal 1036 and weld band 1078 (FIG. 50). The bottom of package 1200, as is preferred with the other flexible packages shown herein, is formed by a dead fold 1258. A gusseted construction could also be employed.

Figure 52:
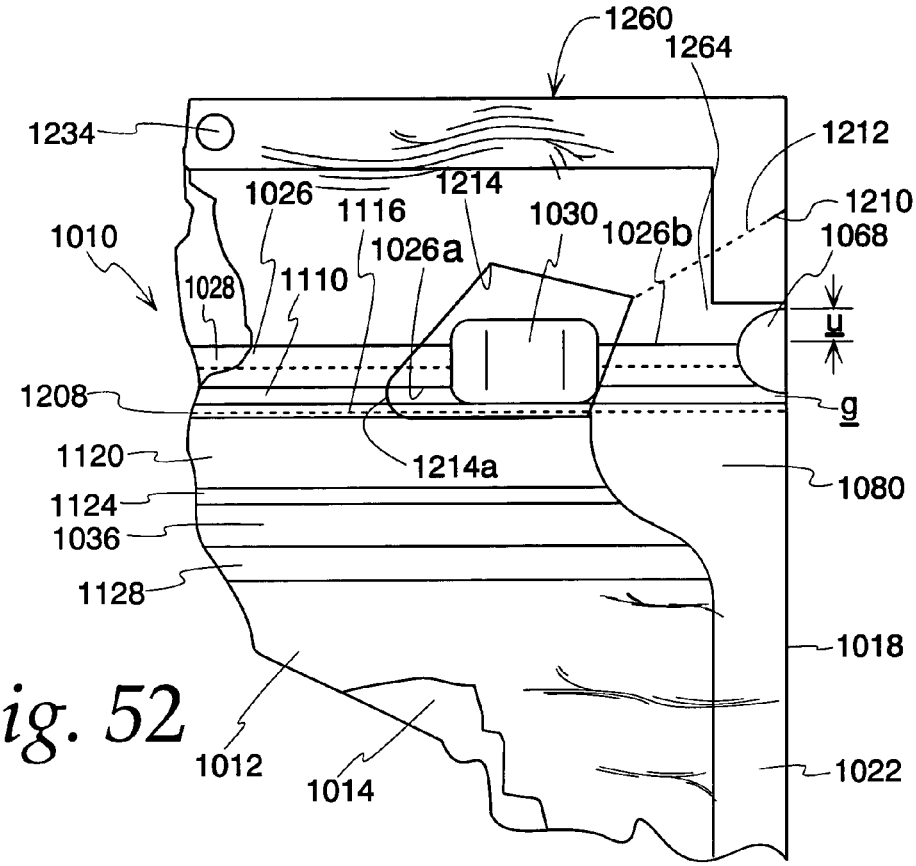
FIG. 52 is a fragmentary elevational view of a further embodiment of a shrouded flexible package.

Referring now to FIG. 52, a flexible package 1260 is substantially identical to flexible package 1200 of FIG. 48, except that the teardrop-shaped opening 1214 is modified to have a generally V-shaped end opposite the pointed end 1214*a*. To ensure that tearing enters into hole 1214 as desired, it is generally preferred that weakening line 1212 bridge the distance between tear-start feature 1210 and the adjacent end of hold 1214.

Figure 53:
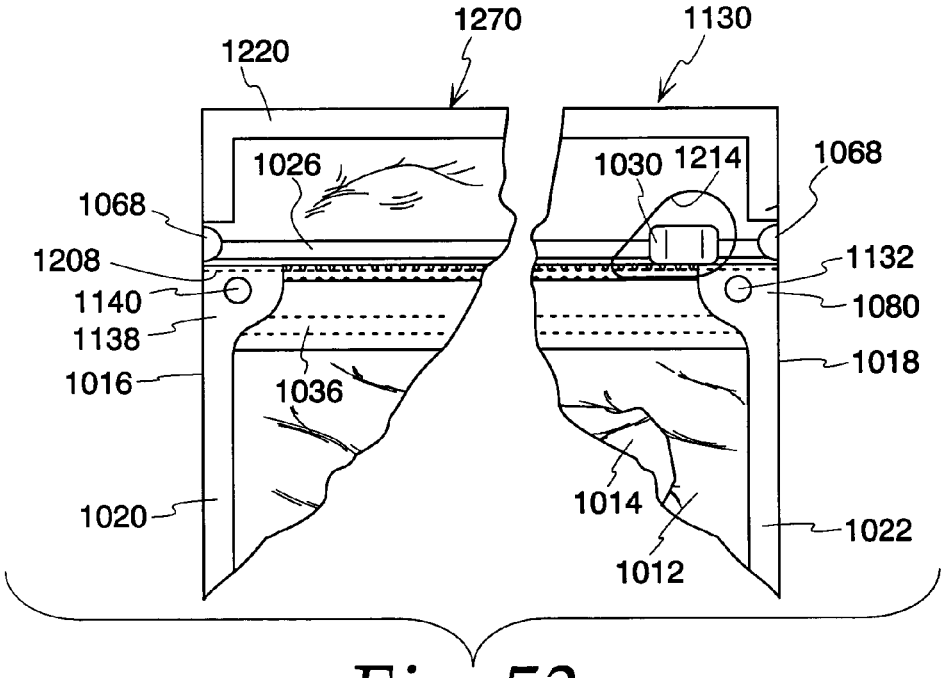
FIG. 53 is a fragmentary elevational view of another embodiment of a shrouded flexible package.

FIG. 53 shows a flexible package 1270 similar to that of flexible package 1200, except that a large or tapered side seals are provided at each side of the package. Peg holes 1132, 1140 are formed in the tapered side seal portions and if desired an optional central peg hole can be formed in upper fin seal portion 1220. As with the other embodiments shown herein, it is generally preferred that the enlarged or tapered side seal portions stop short of the line of weakness 1208.

Figure 54:
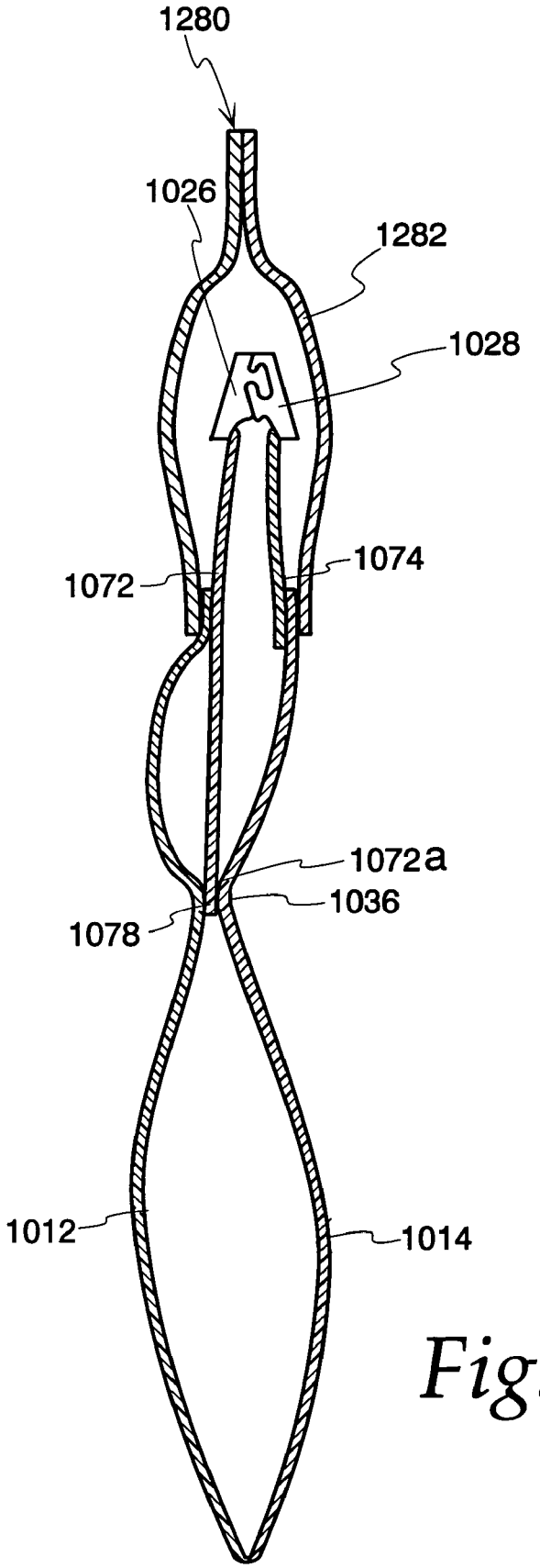
FIG. 54 is a cross-sectional view similar to that of FIG. 50 but showing an alternative shroud construction.

FIG. 54 is a cross-sectional view of an optional flexible package 1280 substantially identical to flexible package 1200, described above, except that a shroud member 1282 is separately formed from panels 1012, 1014 and is joined to the upper ends of the panels by conventional welding or other joining techniques. Most preferably, shroud 1282 is joined to the upper ends of panels 1012, 1014 at the point of sealing with flanges 1072, 1074. The weakening line for removal of the shroud of 1282 can be formed either above or below the point of sealing with the remainder of the flexible package.

Figure 56:
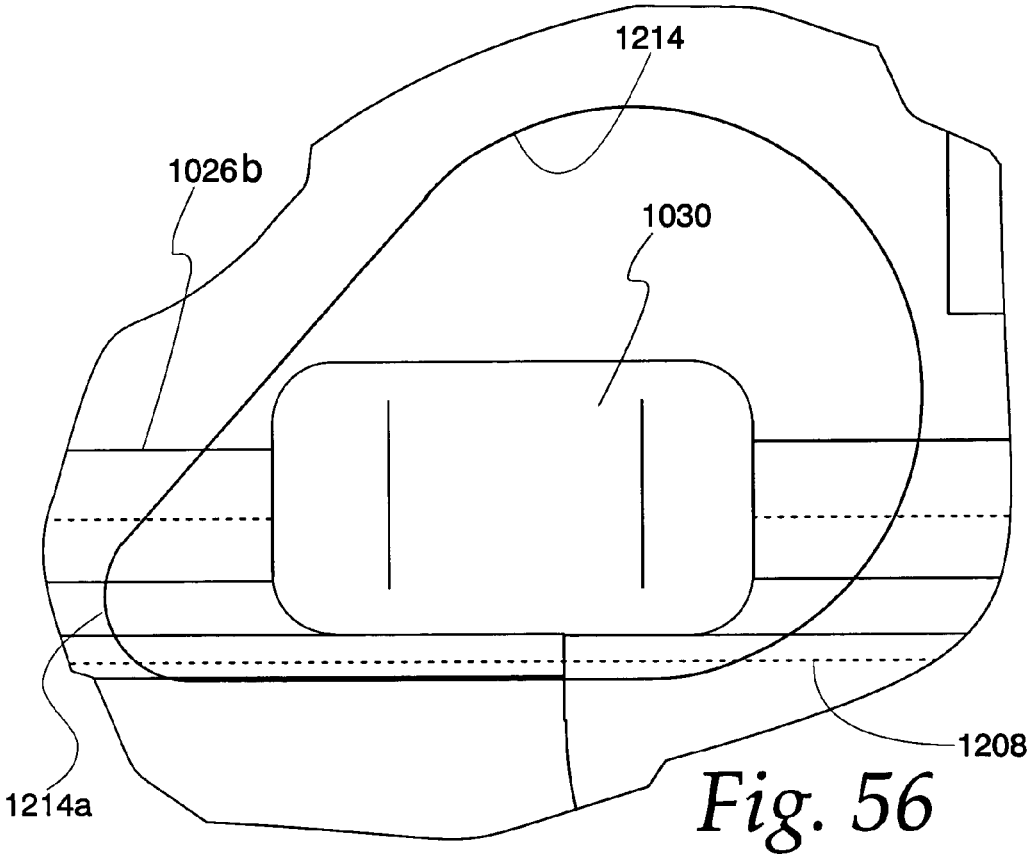
FIG. 56 is a fragmentary view of FIG. 55, shown on an enlarged scale.

FIG. 56 shows an enlarged portion of flexible package 1200, to more clearly illustrate the features of opening 1214 in cooperation of the opening or hole 1214 with the other features of the flexible package. As mentioned above, opening 1214 has a pointed end 1214*a* arranged so as to extend generally toward a central portion of the package. As shown, end 1214*a* forms an acute angle of approximately 45°. If desired, the acute angle can be extended up to 70°. The acute angle feature of end 1214*a* has been found helpful in contributing to the directionality of applied tearing force. If desired, the pointed end 1214*a* can form a sharp corner, but it is generally preferred that a rounded corner be employed, as illustrated. It has been found important for certain types of flexible package materials at the end 1214*a* be kept free of minute notches or tears. For reasons of economy, it is generally preferred that opening 1214 be used by a die cutting operation and a rounded corner 1214*a* has been found to wear in such a manner over its production life so as to avoid tearing or minute notching which could result in misdirection of the tear force applied by a consumer attempting to gain access to the interior of the flexible package.

Figure 57:
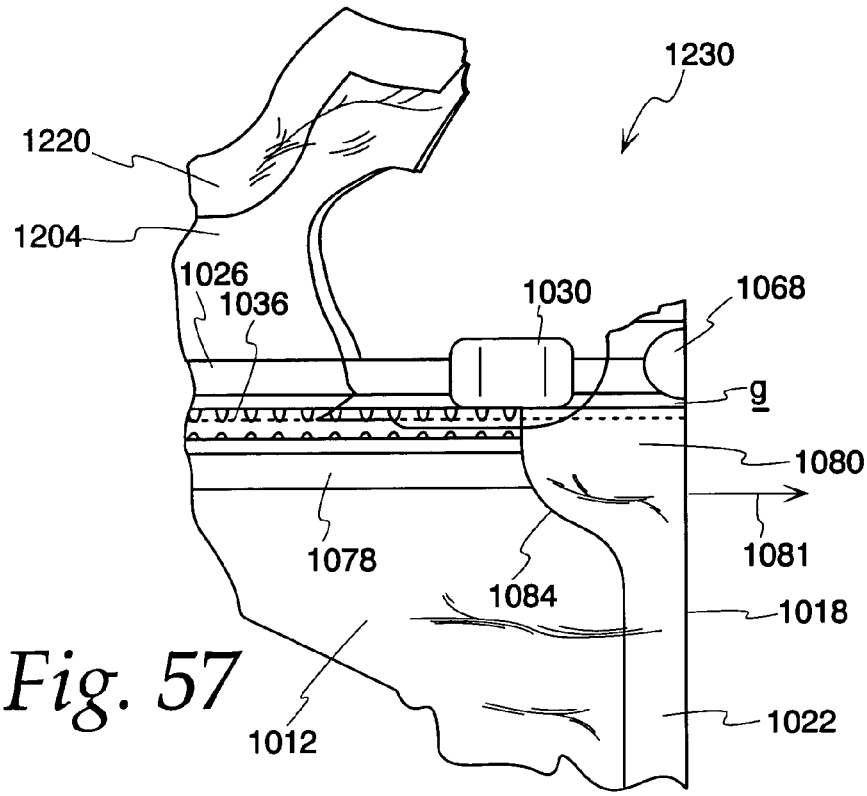
FIG. 57 shows the flexible package partially opened.

FIG. 57 shows flexible package 1230 with the shroud member partially torn away. Tearing of the shroud continues along line 1208 (see FIG. 56).

Referring to FIG. 56, as indicated in the figures, it is generally preferred that the opening 1214 has a lower portion extending below line of weakness 1208, so as to further ensure that the tearing force will be applied to weakening line 1208. If desired, opening 1214 can be lowered to bring the center of pointed end 1214*a* to intersect line of weakness 1208.

As shown in FIG. 56, the right half of opening 1214 generally comprises a semicircle. The present invention also contemplates an arrangement where the left half of the opening also comprises a semicircle. If necessary, the size of the resulting circular opening is increased to provide a space around slider 1030 to avoid interference with the slide during opening.

A number of different flexible package designs have been described above, along with apparatus for constructing any of these package designs, as well as packages having various permutations and combinations of the features described above. Further, as will be seen herein, the apparatus for constructing bags and other flexible packages of various types and designs is able to fabricate a still wider variety of flexible packages having permutations and combinations of further flexible bag features to be described below. For example, apparatus and methods according to principles of the present invention have been described for use with flexible packages having slider fastener or zipper tracks. As has been seen, the flexible packages may be formed with or without shrouds covering the zipper tracks. The apparatus and methods herein are suitable for use with shrouds severable at a point below the zipper tracks from the remainder of the flexible package. As will be seen below, shrouds separable from a point above the zipper tracks may also be formed according to apparatus and methods according to principles of the present invention. Flexible packages having stress relieving features for the slide fasteners have been described above. For example, shrouds defining holes of various shapes including tear drop and rectangular and modified rectangular shape have been described. As will be seen below, shrouds can be provided according to methods and apparatus of the present invention which lack holes for relieving stress caused by bulky slide closure members. Also, shrouds lacking stress relieving holes and having printed matter or other package decoration will be described below, in which a clear window is presented to allow ready visual inspection of a slider member. Tear starting features for shroud removal have been described above. Further configurations of shroud removal tear starting weakening lines will be described below, including so-called "two-dimensional" weakening lines terminating at a point above the zipper tracks to facilitate removal of a shroud at a point located above the zipper tracks. New flexible package features especially suitable for use with shrouds removed at a point above the zipper tracks will be described below, and these features can be readily provided in apparatus and methods according to principles of the present invention. Included is a hinged flap readily configurable by a user to expose the sides of the zipper tracks. Further, methods and apparatus according to principles of the present invention have been described with reference to various flexible packages employing zipper tracks having two relatively simple flat panel flanges as shown for example in FIG. 9. With minimal modification the apparatus and methods according to principles of the present invention can be employed with other types of zipper fastener tracks, including those in which one of the zipper track flanges has a reverse fold. Further, a variety of flexible packages constructed according to apparatus and methods of the present invention have been described as including a sanitary peel seal located below the zipper tracks. While peel seals of this type allow a greater range of package designs, it will be readily appreciated that methods and apparatus according to the present invention can be readily employed with flexible packages which lack peel seals.

Figure 58:
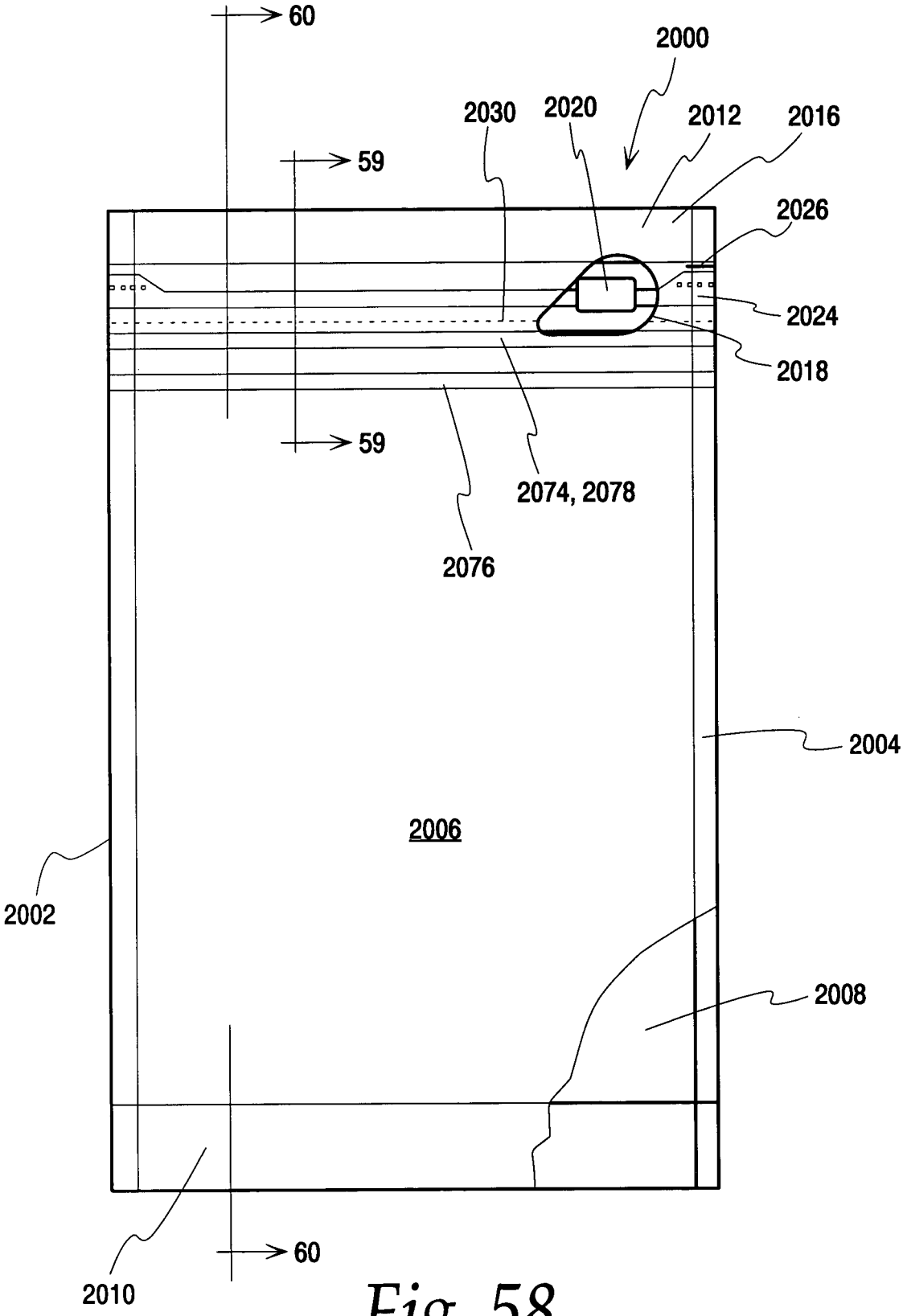
FIG. 58 is an elevational view of another flexible package.

With reference to FIGS. 58-66 additional features of flexible packages according to principles of the present invention, and related application tooling will be described. Referring to FIGS. 58-61 a flexible package utilizing an optional fastener track (shown in FIG. 59) provides a number of improvements relating to both package integrity and application tooling for assembly of the package. Referring to FIG. 58, package 2000 includes side seals 2002, 2004 joining front and rear panels 2008, 2006. The panels are further joined by a bottom seal 2010 and a top seal 2012. Package 2000 includes a shroud 2016 defining a tear drop hole 2018 exposing a slider 2020 which rides along mated fastener tracks. Ends of the mated fastener tracks are crushed in the manner to form end stops, as described above with regard to other embodiments herein. The end stops are identified by reference numeral 2024. A tear notch 2026 is formed in top seal 2012 immediately above end stop 2024. Tearing initiated at notch 2026 migrates to tear drop hole 2018 and continues along a film laser score 2030, in the manner described above. Package 2000 can be constructed using virtually any of the construction techniques known today including bottom fill techniques or top fill either between or beside fastener tracks used for reclosing an opened package.

Referring now to FIG. 59, a zipper track assembly is generally indicated at 2040 and includes mated fastener tracks 2042, 2044. Double wall flanges 2046, 2048 depend from fastener tracks 2042, 2044. Preferably, both layers of the double wall construction comprise sealant material. The longer flange 2046 contains a reverse fold forming a rupturable bottom portion 2050. The longer flange 2046 continues upwardly from bottom portion 2050 to form an opposed wall portion 2054 in line with shorter flange 2048 and opposing the major portion of flange 2046. The lower end of short flange 2048 and the upper end of opposed wall portion 2054 contain adjacent spaced apart free ends 2056, 2058, respectively. Bottom portion 2050, as mentioned, is preferably formed with a dead fold construction with the fold preferably being maintained by a tack seal 2062. Bottom portion 2050 includes a weakened area 2064 which is preferably weakened by thinning, with material being displaced into a pair of ridges 2068. It is generally preferred that the bottom portion 2050 be sufficiently weakened so as to be readily opened by a consumer accessing the package interior after removing the optional shroud and operating the slider member so as to unmate the fastener tracks. If desired, the reverse fold weakened area can be replaced by a true peel seal of conventional design.

Figure 60:
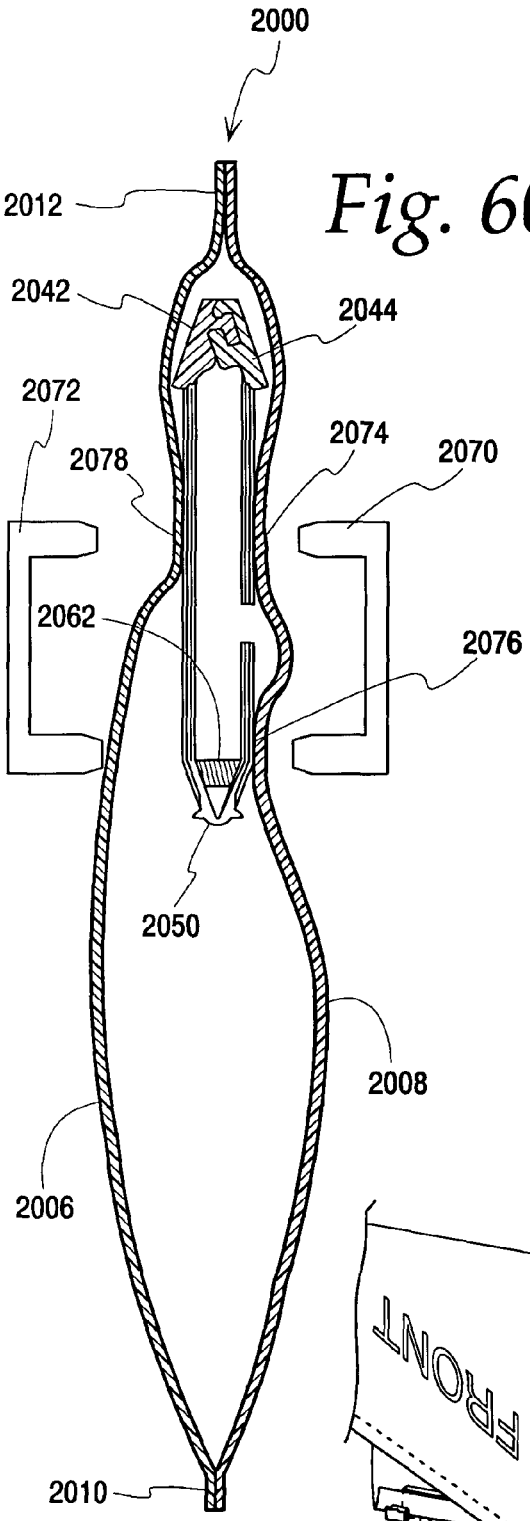
FIG. 60 is cross-sectional view taken along the line 60-60 of FIG. 58.
Figure 61:
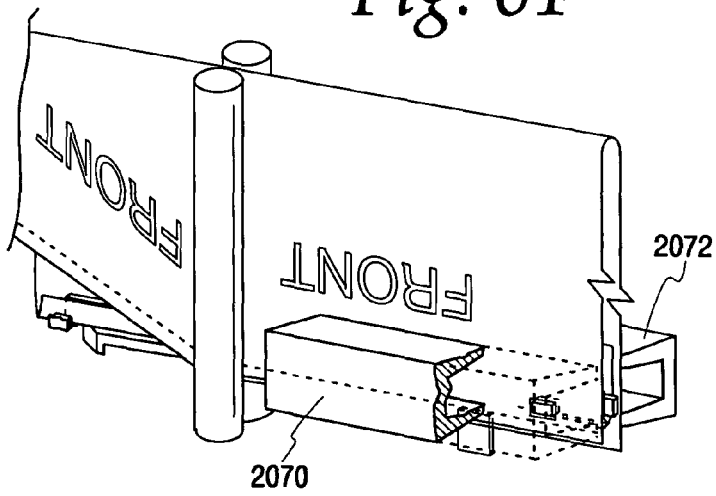
FIG. 61 is a view similar to that of FIG. 60 with the addition of application tooling.

Referring now to FIG. 60, the zipper track assembly is shown mounted to the front and rear panels. Application tooling or die members 2070, 2072 form fusion seals 2074, 2076 and 2078, securing the zipper track assembly to the package panels. Fusion seal 2078 joins a pre-seal portion of the longer flange to panel 2006. Referring to FIG. 61, application tooling for the package forming apparatus is shown. The application tooling for package 2000 replaces the tooling shown in FIG. 31, which is adapted for a different zipper or fastener track assembly.

The zipper track assembly 2040 shown in FIG. 59 can be readily adapted for any of the package constructions described herein, and such is contemplated by the present invention. Further, the package 2000 can be modified according to any of the package features described herein. For example, although a monolithic shroud is shown, a two-piece separately formed shroud, such as that described above could be employed, or the shroud could be omitted altogether. Although a tear drop shaped hole is shown, holes formed in the shroud can have virtually any configuration. Further, package 2000 can include a solid shroud lacking a hole for the slide member, and if desired, the solid or continuous shroud can have printing except for a transparent area exposing the slider member. Optionally, although a tear notch in the form of a short slit is shown, a S-shaped other non-linear or curved shaped slit can be employed. As a further alternative, the package 2000 can be filled beside the fastener track, before seals 2012, 2074 and 2076 are formed.

Figure 62:
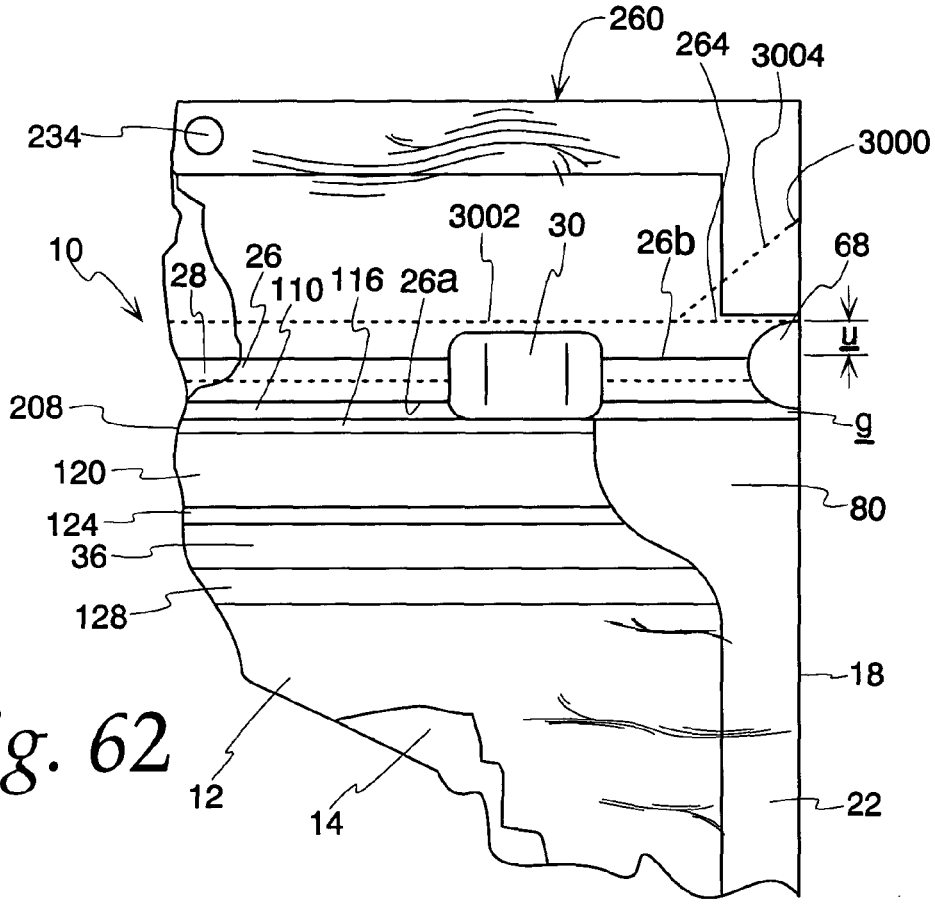
FIG. 62 is a fragmentary elevational view of another flexible package according to principles of the present invention.
Figure 63:
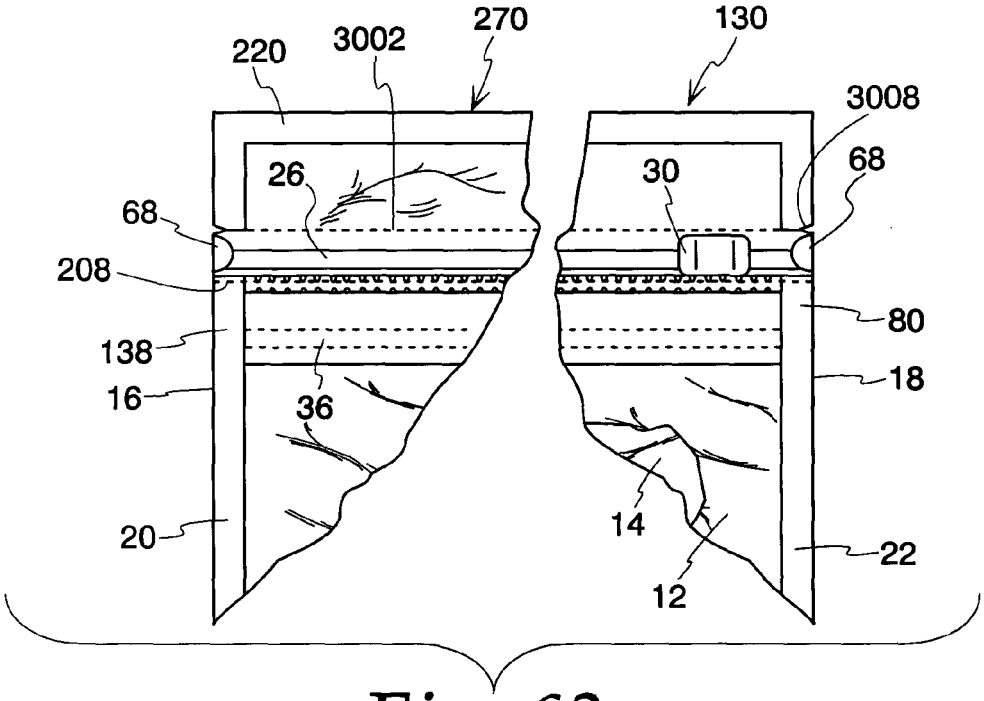
FIG. 63 is a fragmentary elevational view of another flexible package.

Referring now to FIG. 62, a flexible package 260 similar to that described above is formed with optional shroud removal features. Included is tear notch 3000 and a laser score line 3002 positioned above end stop 68, and at or above slider member 30. If desired, an optional bridging tear line 3004 can be employed. In FIG. 63, a V-shaped notch 3008 is formed in the side seal portion of the shroud, and again is located immediately above stop 68.

Figure 64:
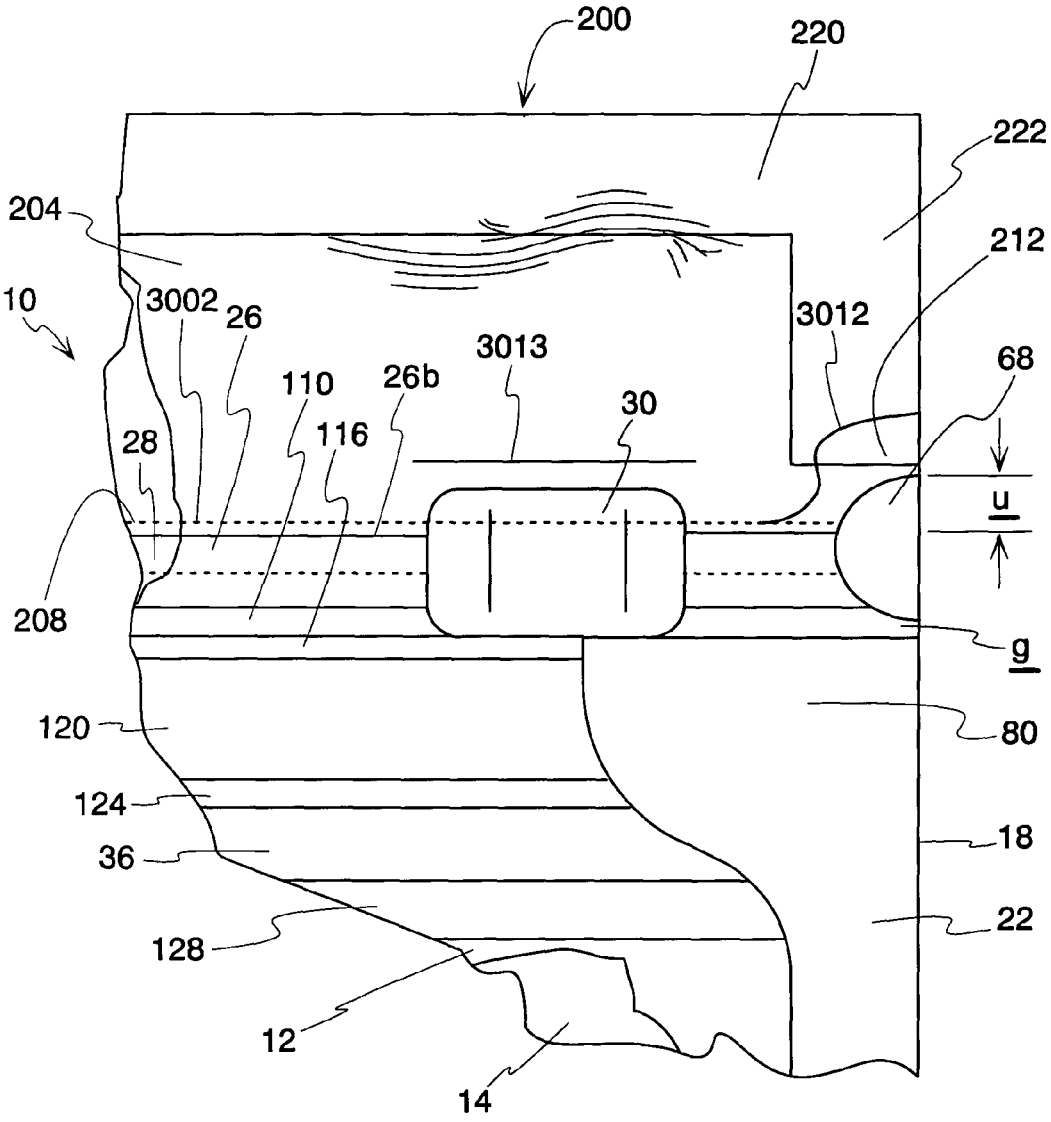
FIG. 64 is a fragmentary elevational view of another flexible package.

Referring now to FIG. 64, a package 200 includes the laser score line 3002 located above the mated fastener tracks, 26, 28. A two-dimensional tear slit 3012 extends from an edge of the package to the laser score line 3002. In the preferred embodiment, the slit line 3012 has a generally S-shaped configuration but could have virtually any non-linear shape, smoothly curved or not.

Figure 65:
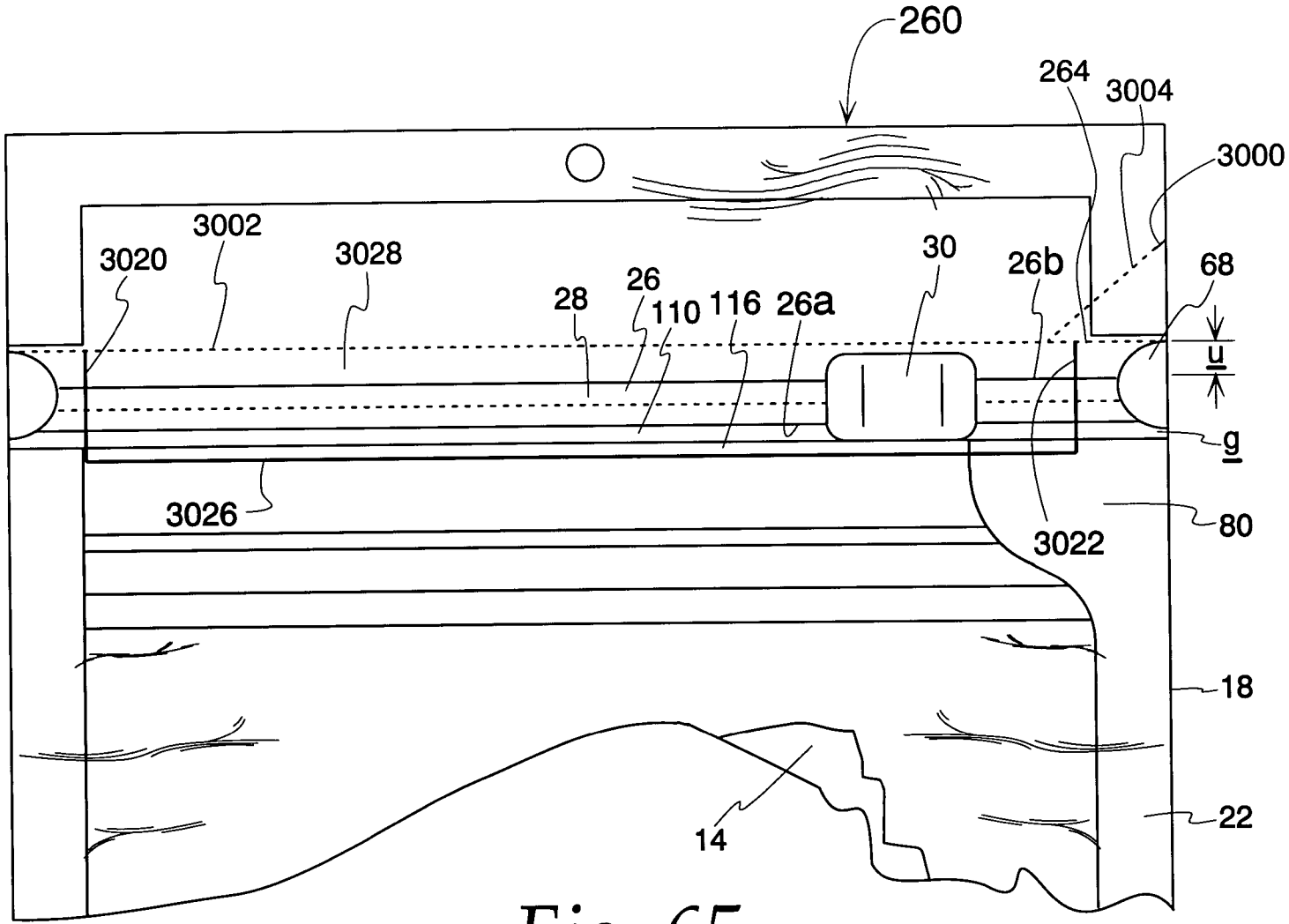
FIGS. 65 and 66 are fragmentary elevational views of another flexible package.
Figure 66:
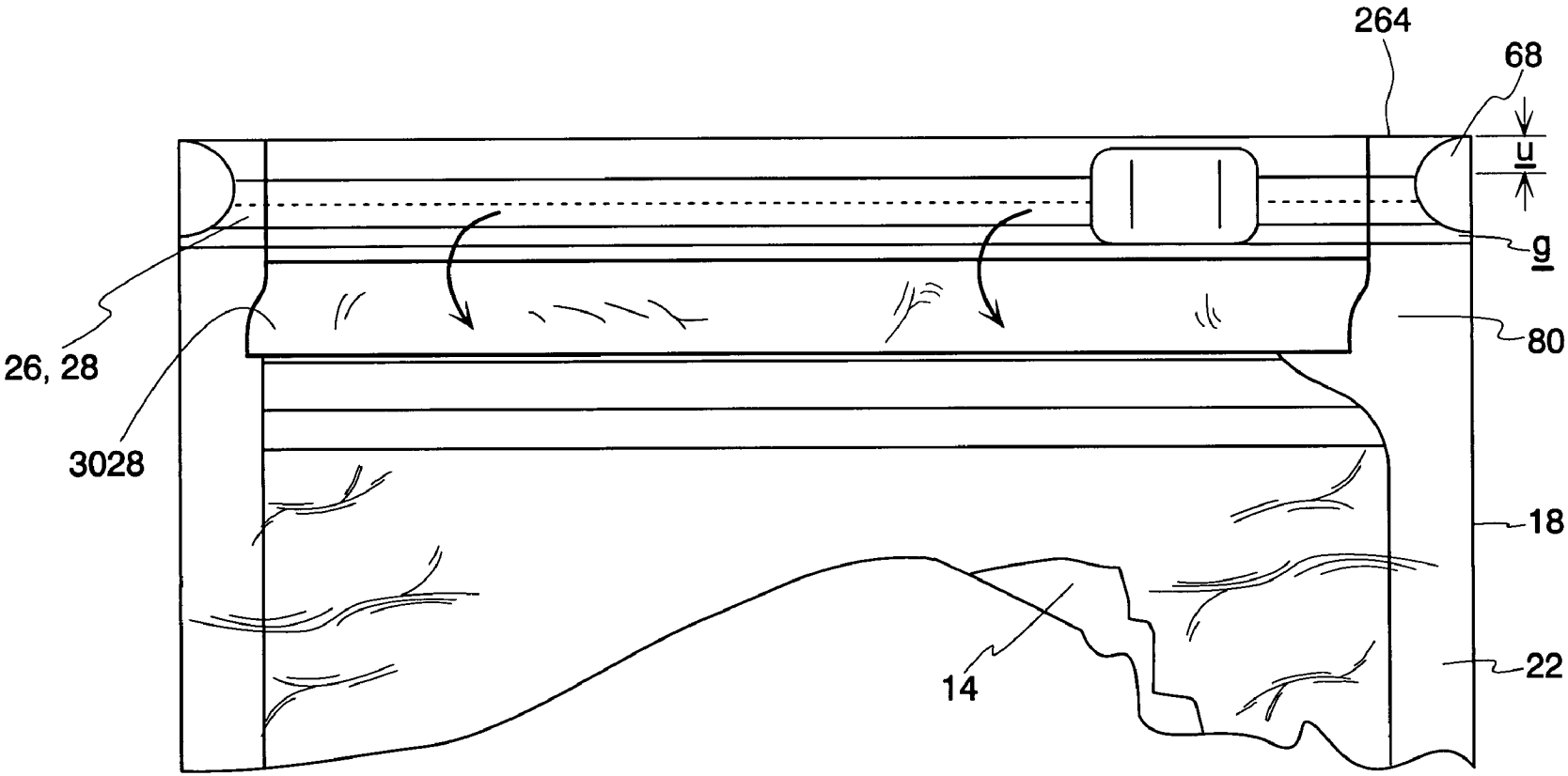

Referring now to FIGS. 65 and 66, a flexible package 260 includes a laser score line 3002, tear notch 3000 and optional tear notch extension 3004. Upon opening package 260, tearing is initiated at notch 3000 and continues to laser score line 3002, traveling across the entire top of the package, allowing the shroud to be removed. This leaves panel portions covering opposed sides of the mated zipper tracks, the covering portions having an upper limit defined by laser score line 3002. In order to facilitate an easier access to slider member 30 and to improve operation of the slider member as well as cleanliness upon package reuse, a hinged panel feature is provided. Included are vertical slit members 3020, 3022 which extend from laser score line 3002, across the fastener tracks to a point below slider member 30. A hinge line 3026 bridges the bottom ends of vertical slits 3020, 3022. Preferably, hinge line 3026 is formed as a crease line forming a hinge for the resulting flap 3028 bounded by slit lines 3020, 3022 and hinge line 3026. As shown in FIG. 66, the flap designated by reference numeral 3028, is folded in a downward direction, exposing the fastener tracks 26, 28, it being understood that a flap 3028 is formed on both front and rear panels of the package. A flap could be formed only in one of the package panels if improved access to only one side of the mated fastener tracks is needed. If desired, the flap could be printed with indicia instructing a user to fold the panel after removal of said shroud.

As shown in FIG. 64 an optional slit 3013 can be provided above slider member 30 to relieve bulging stress caused by slider member 30, disposed within the continuous shroud 204. In certain applications, it is preferred that a peel seal or other barrier be provided in the package, below the fastener tracks in order to protect the package contents from the effects of breaching the package by slit line 3013. If desired, the slit line 3013 can have a two-dimensional, i.e., non-linear shape. It is generally preferred, that the slit 3013 be spaced a sufficient distance from slit line 3012 and laser score line 3002 so as to prevent interference with operation of the shroud removal, as described above. However, it may be desirable in certain applications that the tear start feature formed at the edge of the package give rise to a tearing which communicates with slit 3013, and traveling around slider member 30 so as to intersect laser score line 3002.

Figure 67:
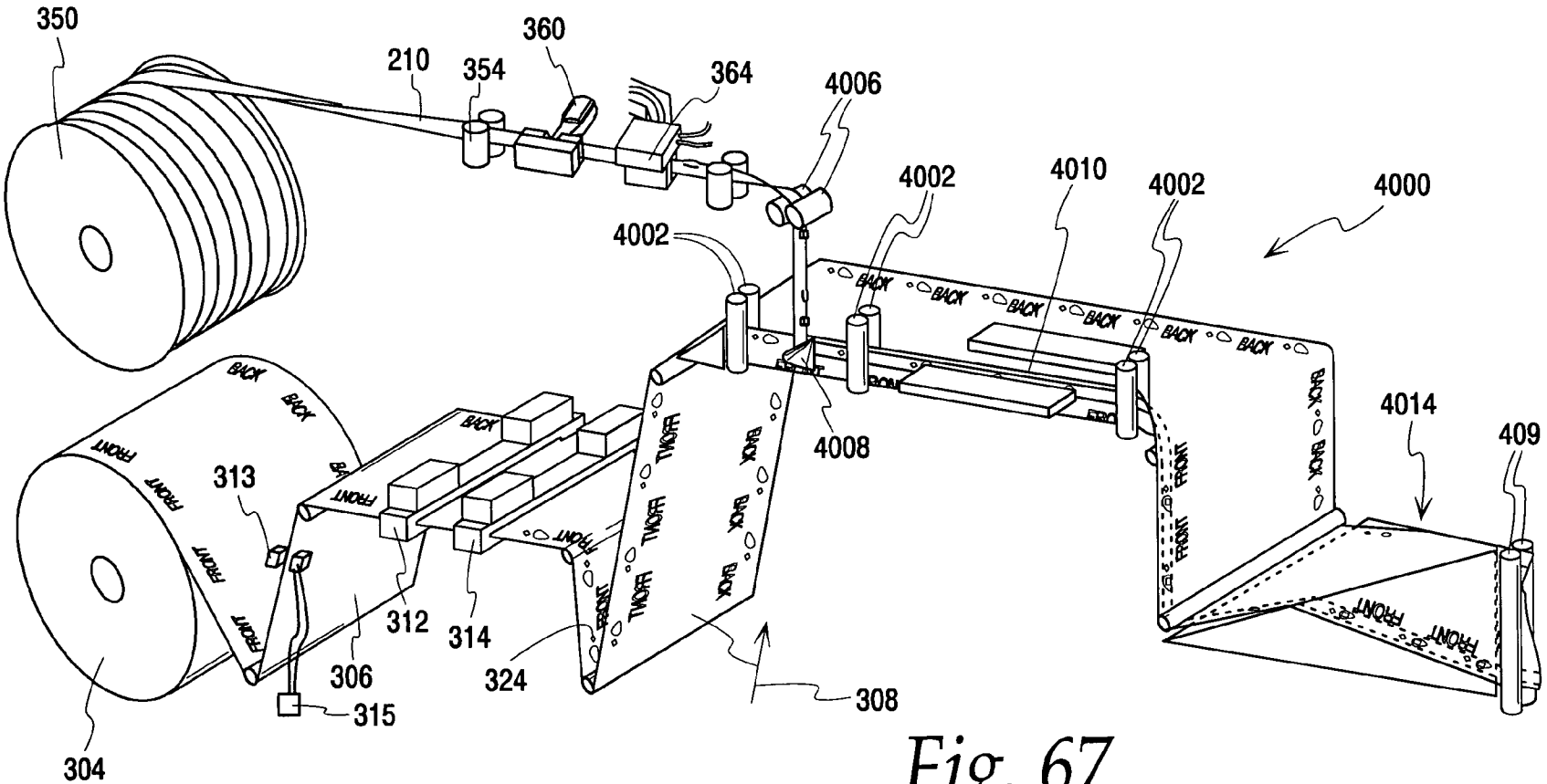
FIG. 67 is a fragmentary perspective view of a web folding and pre-sealed station.

Turning now to FIG. 67, a fastener sealing station 4000 provides many of the features described above with regard to the fastener sealing station 400 shown in FIG. 29. In the fastener sealing station 4000, the fastener track enters the fastener sealing station from below, in preparation for attachment to the underside surface of the web material. It is advantageous in many instances, if the fastener track and its related preparation equipment can be disposed above the path of the web material, as shown in FIG. 67. In order to expose the underside surface of the web material a series of rollers 4002 turn up one edge of the web material, that edge corresponding to the upper end of the finished package, where the fastener track is applied. In the preferred embodiment, rollers 4002 turn up or fold one edge of the web material at an angle of approximately 90° with respect to the major web surface. If desired, the edge of web material can be upturned different angular amounts greater or less than 90°.

The fastener track material is prepared as described above with reference to FIG. 29. Included in the fastener track preparation our drive rollers 354, an ultrasonic stop-forming station 360 and a slider insertion station 364. The prepared and slider-loaded fastener track material is trained by rollers 4006 and guide 4008 into alignment with the web material, parallel to the upturned free edge 4010 of the web material. It is generally preferred that the upturned free edge 4010 be maintained generally flat, although this may not be necessary in all cases. As an optional step, the fastener track material could be tack sealed to the upturned edge of the web material to preserve the relative alignment between the fastener track and web material as they travel downstream toward the reverse folding station 4014.

Figure 68:
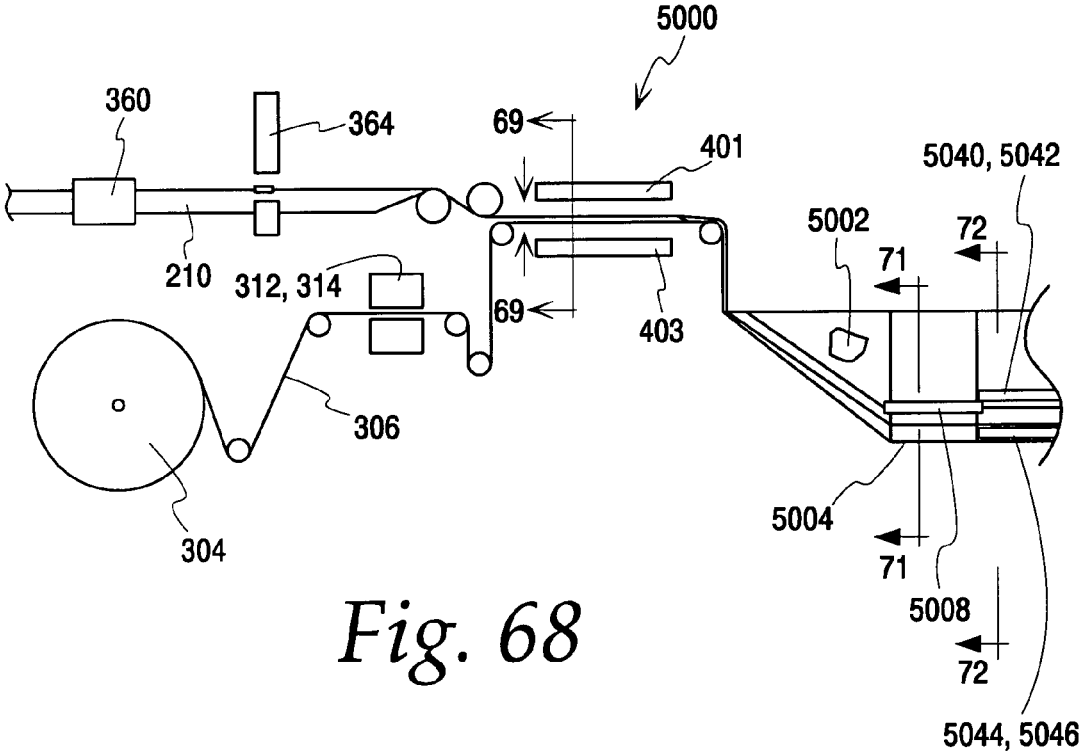
FIG. 68 is an elevational view for constructing packages according to principles of the present invention.

Although the arrangement of FIG. 67 has been described with respect to a reverse folding operation (i.e., with the dead fold on top) it should be understood that the upturned edge arrangement for fastener sealing could be used with virtually any packaging arrangement, including formal folding operations, such as shown in FIG. 68, where the dead fold is located at the bottom of the folded web. Further, edge folding operations can be carried out before or after the principle web folding operation.

Figure 69:
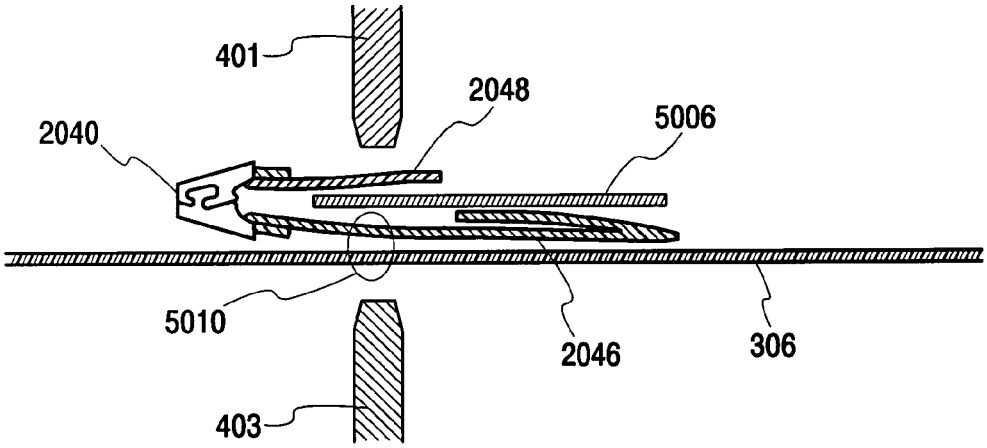
FIG. 69 is a fragmentary cross-sectional view taken along the line 69-69 of FIG. 68.

Turning now to FIGS. 68-72, a pre-sealing station 5000 is shown in conjunction with a horizontal form fill seal machine with bottom fill. The fastener track 210, stop forming station 360 and slider insertion station 364 are as described above. Film 306 is unwound from supply roll 304 and passes through hole punch stations 312, 314 entering the zipper pre-sealing station 5000. The prepared fastener track is sealed to film 306 by sealing dies 401, 403, prior to plow folding. Preferably, the pre-sealing at station 5000 takes place while the film 360 is in a planar or flat configuration. The joined assembly of film and fastener track are then pulled over plow forming 5002 with a resulting dead fold 5004 located at the bottom of the folded web material. The pre-sealing at station 5000 either partially or fully seals the zipper to one of the two panels 5030, 5032 before the folding takes place. FIG. 69 shows the zipper pre-sealing operation utilizing the zipper tracks described above in FIG. 59. A separator 5006 is provided and sealing die 401 is maintained in an unheated condition to assure that pre-seal 5010 occurs only on the long flange 2046 of zipper tracks 2040.

Figure 70:
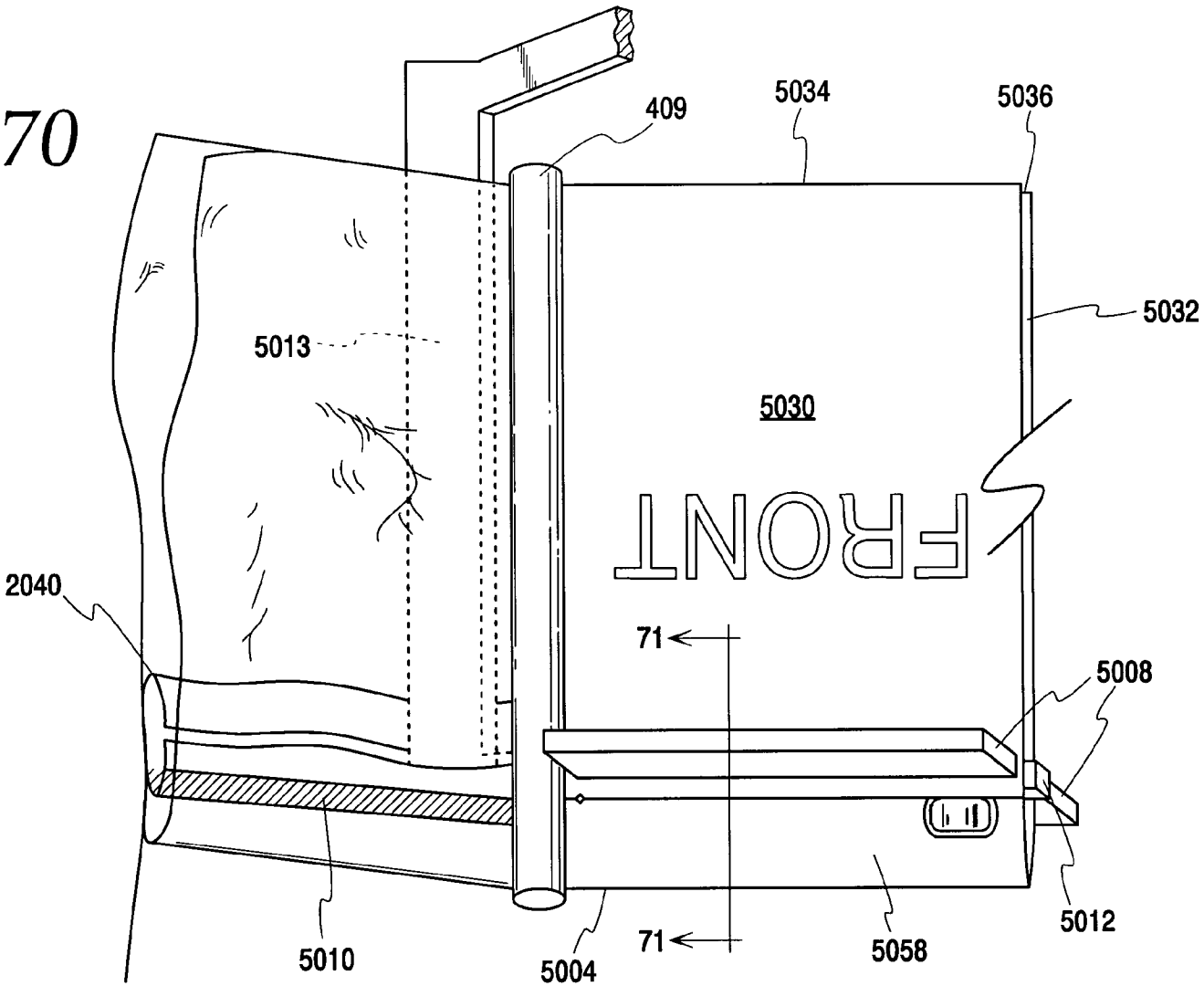
FIG. 70 is a fragmentary perspective view of the final sealing operation of FIG. 68.
Figure 71:
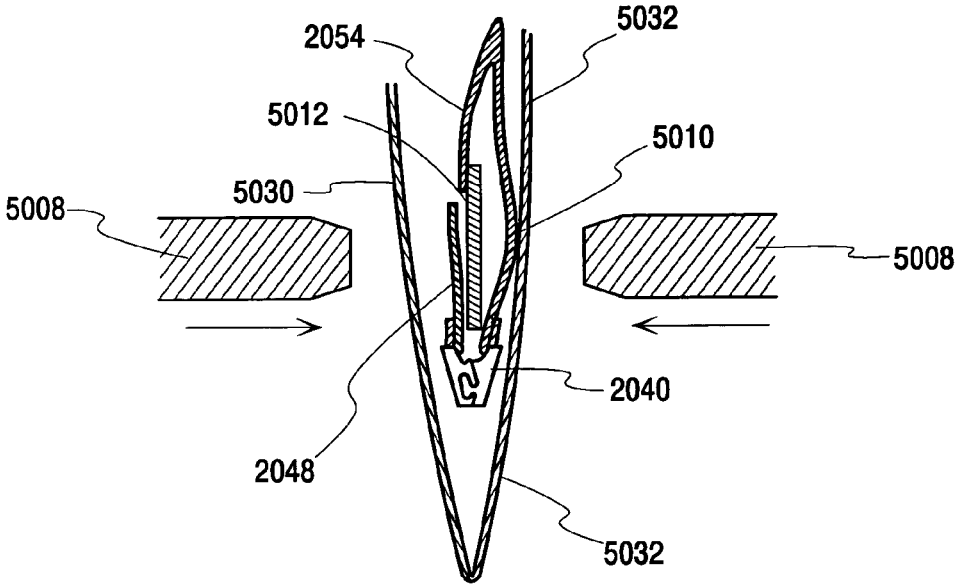
FIG. 71 is a cross-sectional view taken along the line 71-71 of FIG. 68.
Figure 72:
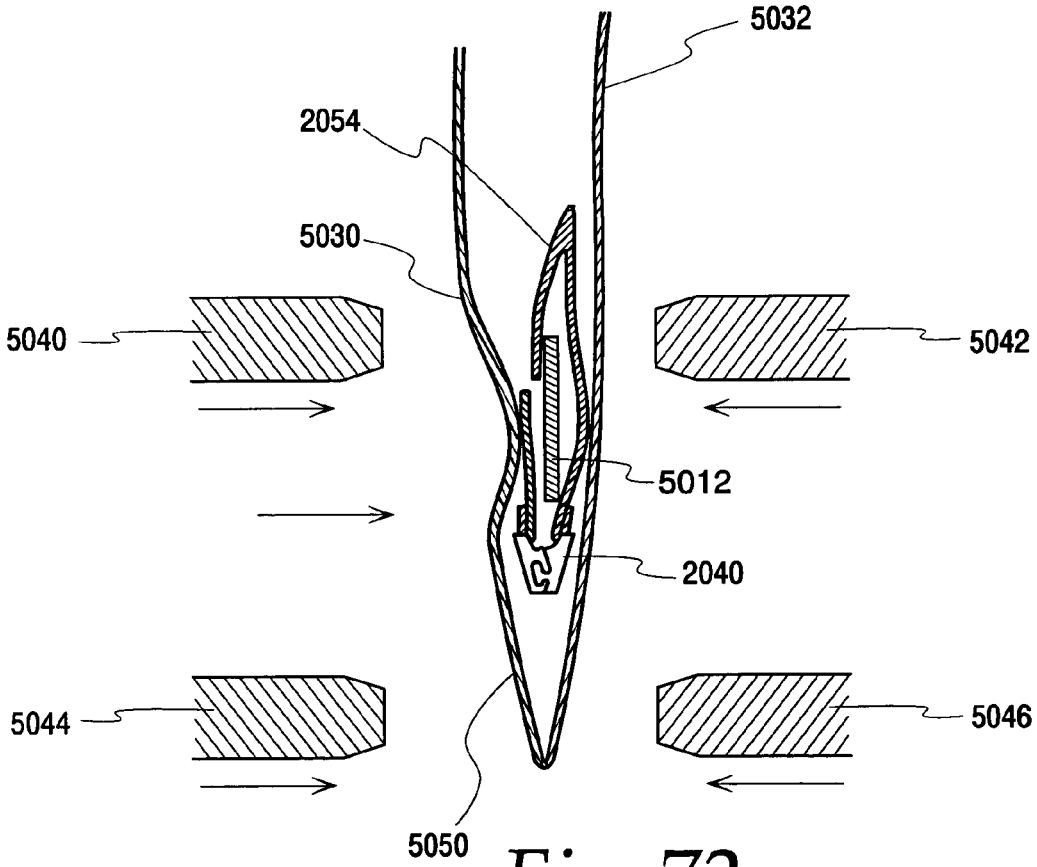
FIG. 72 is a cross-sectional view taken along the line 72-72 of FIG. 68.

After folding, the zipper tracks go through a multistep sealing operation utilizing hot, short-flange sealing dies 5008 (see FIGS. 68, 70). In this operation, the second, shorter zipper flange 2048 is welded to the other panel. The sealing operation can also be used with additional sealing dies, to make additional seals on the flanges for tamper evidence, for example. This arrangement allows the horizontal form fill seal machine to pull the zipper tracks through all of the operations, since the zipper tracks are carried along with the web material as the web material is pulled through the machine. Mounting of the zipper tracks is more accurate as is the relative location of the fastener end stop formations and sliders which are registered to the graphics pre-printed on the web material.

A separator 5012 suspended from a mount 5013 is preferably employed in the final sealing station. In the preferred embodiment illustrated, the package has a shroud portion 5050, partially defined by the dead fold 5004 at the bottom of the folded web. The joined web material and zipper tracks are advanced to the next station, shown in FIG. 72 where hot long-flange seal bar 5040, backed up by unheated long-flange seal bar 5042 mounts the folded portion of the longer flange 2054. Optional hot seal bars 5044, 5046 at the dead fold of the web material are employed to make a header seal. It will be appreciated that the same arrangement can be employed with a reverse folding operation in which header seals 5044, 5046 join free ends of the folded web material in an optional arrangement. Although a bottom fill operation has been illustrated, it will be appreciated that the arrangements of FIGS. 68-72 can be readily employed with conventional beside-the-fastener track filling operations.

Figure 73:
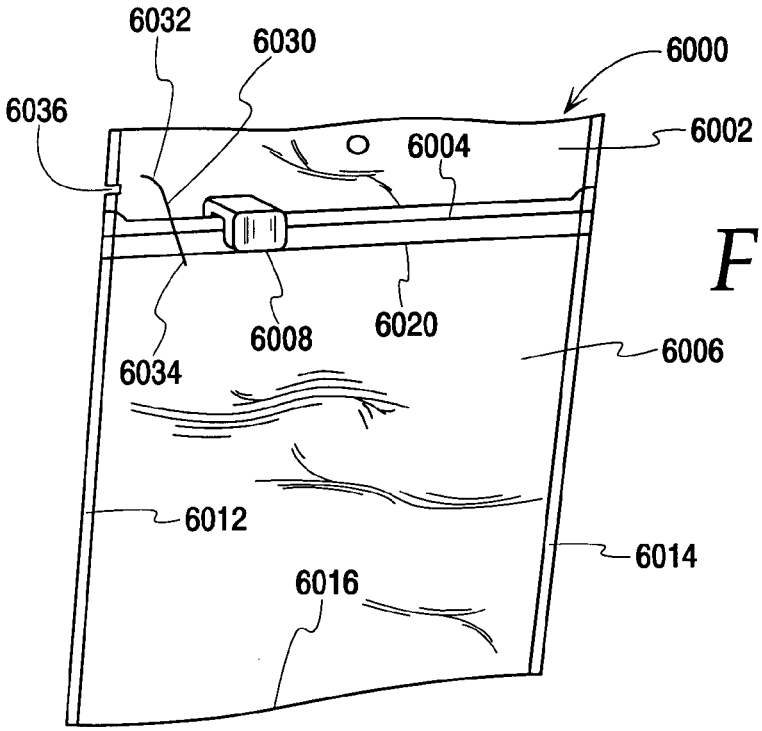
FIG. 73 is a perspective view of an alternative flexible package according to principles of the present invention.
Figure 74:
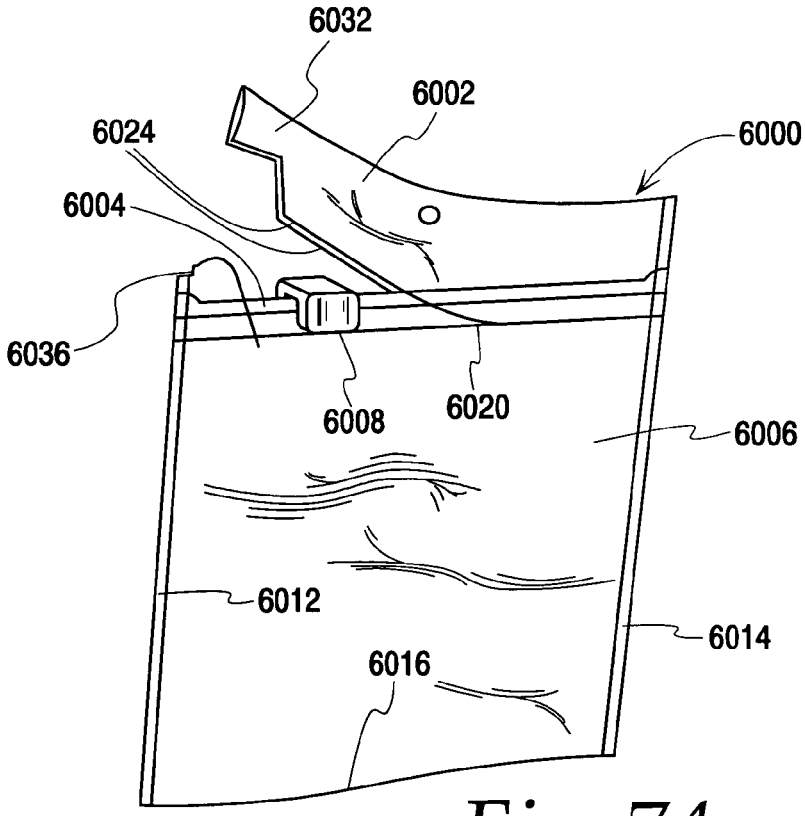
FIG. 74 is perspective view showing the flexible package of FIG. 73 partially opened.

Referring now to FIGS. 73 and 74, a flexible package 6000 includes an upper shroud portion 6002, a mating fastener track assembly 6004 and an internal cavity portion 6006. A slide fastener 6008 is mounted on the fastener track assembly in a conventional manner.

Flexible package 6000 includes opposed lateral seal margins 6012, 6014. The flexible package has a bottom edge 6016 which may include either a margin seal or a conventional dead fold arrangement. Similarly, the upper edge of shroud portion 6002 may be formed either with a margin seal or a conventional dead fold arrangement. Shroud portion 6002 covers the mated fastener track arrangement and slide and is joined to internal cavity portion 6006 along a joining line 6020 which preferably comprises a score line and most preferably a laser-formed score line. In the preceding figures, various arrangements have been proposed for an initial tearing operation which separates the shroud portion from the remainder of the flexible package. Referring to FIG. 64, for example, a tear slit 3012 extends from an edge of the package to a laser score line 3002 located generally above the mated fastener tracks. In FIGS. 73 and 74, flexible package 6000 includes a laser score line 6020 located generally below and generally coextensive with the mated fastener tracks 6004. Consequently, the shroud portion, when torn along the laser score line 6020 has bottom free edges 6024 formed in both front and back overlying layers comprising the shroud portion.

In contrast to the initial tearing arrangements described above, flexible package 6000 has a tear slit 6030 which is spaced from the lateral edge of the flexible package and which extends across the mated fastener tracks, laser score line and the full height of the slider, as can be seen in FIG. 73. The left marginal edge of flexible package 6000 includes a weakening member 6036 which most preferably comprises a notch formed in the left edge of the flexible package. Weakening member 6036 could also comprise a slit, if desired. As shown in FIG. 73, an upper end 6032 of tear slit 6030 is curved towards the left marginal edge of the flexible package and is located adjacent weakening member 6036. Most preferably, the upper end 6032 extends slightly above the weakening member 6036 to assure that tearing initiated at the weakening member 6036 migrates toward tear slit 6030 and, regardless of the vertical component of the direction of migration (i.e., up or down) the tear line is assured of intersecting the upper portion of tear slit 6030. Tearing then continues along slit line 6030 until the point of intersection of the slit line 6030 with the laser score line 6020, with continued tearing extending along the laser score line in a predetermined, controlled manner. If desired, the lower end 6034 of slit line 6030 intersects score line 6020 but most preferably extends below the laser score line 6020 in the manner indicated in FIGS. 73 and 74. The tear line arrangement illustrated herein overcome several difficulties encountered in prior art packaging. For example, it was found that consistency of the direction of tear depends upon the gripping pattern of the consumer. Also, the comparatively bulky slider 6008 contained within the layers forming the shroud portion caused a secondary stress on the shroud portion such that an internal notch and tear was initiated in a direction in a region generally above the mated fastener tracks before the tearing tension created by the consumer reached the laser score line. With the opening arrangement according to principles of the present invention, these problems are avoided and the direction of tension of separation for removal of the shroud portion is now controlled throughout the tearing operation regardless of the gripping and pulling pattern of the consumer and the tolerances of cooperating machinery used to form the flexible package. FIG. 74 shows the initial tearing operation. Tearing begins at the left margin of the flexible package at the line of weakness and continues to the right along a tear line propagated by the consumer until the tear slit is encountered adjacent upper end 6032. Tearing then continues at a downward and inward direction until the laser score line 6020 is encountered. Thereafter, tearing extends along the laser score line in a desired manner.

Figure 75:
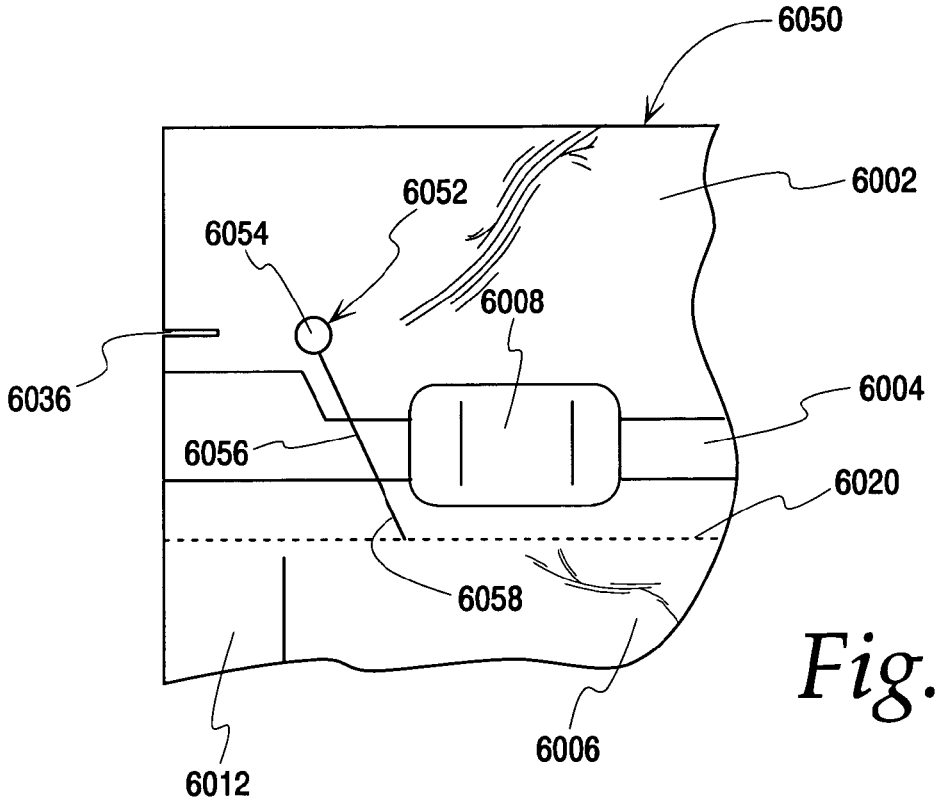
FIGS. 75 and 76 are fragmentary elevational views showing alternative flexible packages according to principles of the present invention.

Referring now to FIG. 75, a flexible package 6050 is substantially identical to flexible package 6000, except for the configuration of the tear slit 6052 which includes an upper end 6054 comprising an opening or aperture connected to a line portion 6056 having a lower end 6058 communicating with laser score line 6020. If desired, the lower end 6058 aligned portion 6056 could extend below the laser score line 6020 or, could terminate slightly above the laser score line, if desired. Cut line portion 6056 is most preferably formed as a straight line but could also include one or more curved line portions extending generally downwardly and inwardly (to the right in FIG. 75) toward the center of the internal cavity portion 6006.

Figure 76:
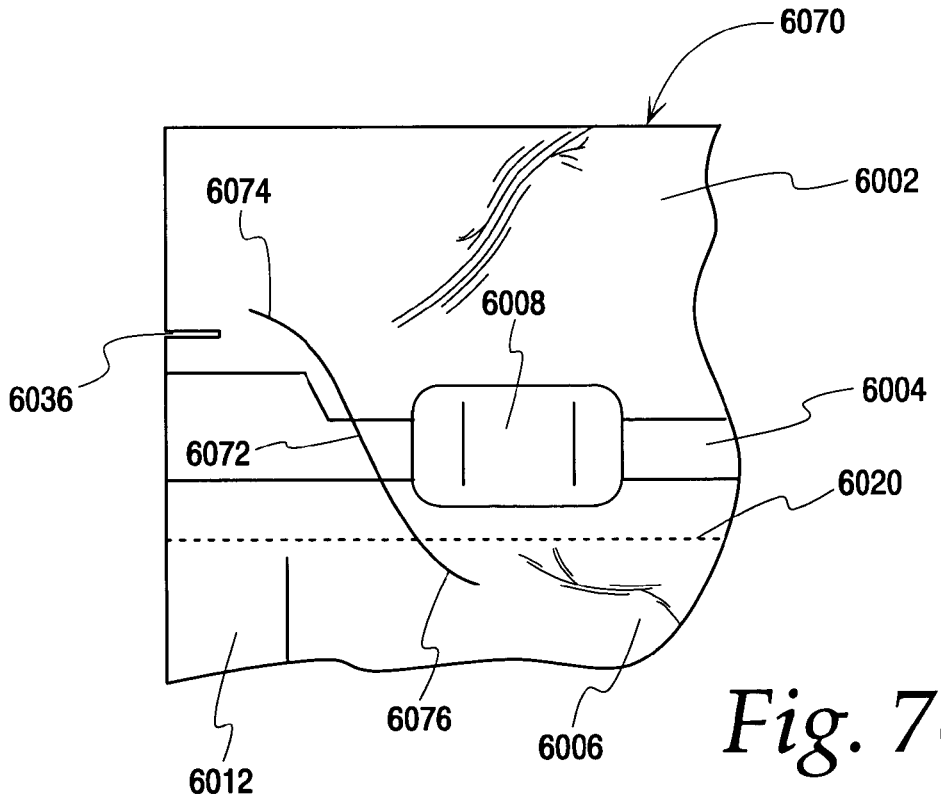

Referring now to FIG. 76, flexible package 6070 is generally identical to flexible packages 6000 and 6050, described above except for a tear slit 6072 having an upper curved portion 6074 and a lower curved portion 6076. As indicated in FIG. 76, the upper curved portion 6074 extends slightly above the notch or weakening member 6036. Tear slit 6072 extends across the full height of slider 6008 and crosses both the mated fastener tracks 6004 and the laser score line 6020 terminating at a point below the laser score line as illustrated. Tear slit 6072 may have an intermediate straight line portion between ends 6074, 6076 or may be continuously curved, with the curve of upper ends 6074 blended into the curve of lower end 6076.

In the preceding arrangements illustrated in FIGS. 73-76, the tear slit extends across the full height of the slider member and is positioned adjacent, i.e., close to the slider member. In this manner, the tear slits of the various arrangements relieve stress exerted on the layers of the shroud portion by the slider member. Thus, during handling and packaging, deformation of the shroud portion due to internal expansive stresses caused by the slider are eliminated. Thus, it is assured that when the consumer initiates a tearing operation, stored internal expansive stresses within the shroud portion will not be present to mislead the desired direction of tearing. Further in each of the arrangements in FIG. 73-76, the upper ends of the tear slits are spaced from the weakening member at the marginal edge of the flexible package. Thus, the consumer must apply an intentional tearing motion to free the initial end of the shroud portion from the remainder of the flexible package. Accidental tearing during handling and shipping is eliminated. If desired, the laser score line could be located generally above the mated fastener tracks, although it is most preferred that the score line extend below the mated fastener tracks as illustrated in FIGS. 73-76. In the most preferred arrangement, the separation of the shroud portion from the remainder of the flexible package is maintained below and out of the way of the track opening through which product is dispensed by the consumer. With the tearing arrangements according to principles of the present invention, examples of which are given in FIGS. 73-76 softer, more stretchable film materials may be used for the flexible package, with assurance that tearing will be conducted in a controlled manner despite internal stresses within the shroud portion and despite variances associated with the manipulation bearing a particular consumer-conducted tearing operation.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A method of packaging a flowable food product, comprising the steps of:

providing a supply of web material defining a serial succession of package sidewalls;

paying out a first portion of the web material;

providing a supply of mated fastener tracks;

paying out a first portion of the mated fastener tracks having first and second fastener track flanges;

crushing a serial succession of spaced apart portions of said mated fastener tracks to form a serial succession of spaced apart back-to-back slider stop portions which are spaced apart by a same preselected package width;

aligning the mated fastener tracks adjacent the upper package portion ends;

lengthwise aligning the package portions of said web material with the back-to-back slider stop portions of said mated fastener tracks to register a first portion of the mated fastener tracks with a first portion of web material;

providing a supply of sliders;

dispensing the sliders one at a time;

inserting the sliders on the mated fastener tracks between the slider stop portions;

mounting the first and the second fastener track flanges to the web material;

reverse folding the web material to form a folded web with a folded-web top, a dead fold at the folded-web top and a serial succession of folded package portions downwardly depending from the dead fold, each folded package portion having the same preselected package width and overlapping first and second package sidewalls with an upper package portion end adjacent the dead fold, and intermediate portions between the upper and the lower package portion ends with the mated fastener tracks aligned with the intermediate portions and with said upper package portion ends including shroud portions;

forming reduced height, transverse, side seals for each package portion to cooperate with said sidewalls to form a pouch, said side seals having upper ends spaced from said upper package portion end and having lower ends spaced from said lower package portion end;

slitting the dead fold at the upper package portion end to form a fill opening;

severing the pouch from the web material and the mated fastener tracks to form a separate flexible package;

filling the pouch with product through the filling opening; and sealing the upper package portion end to enclose the product within the pouch.

2. The method of claim 1 wherein the step of mounting the first and the second fastener track flanges to the web material includes a preliminary sealing step which is carried out before said folding step while maintaining the web material in generally flat, horizontal position.

3. The method of claim 2 wherein the web material has a first edge extending along said serial succession of folded package portions and one of the first and the second fastener track flanges is joined to the first edge in the preliminary sealing step.

4. The method of claim 3 wherein the mated fastener tracks include a first track with a shorter flange mated to a second track with a longer flange and a portion of the second track flange is joined to the first edge in the preliminary sealing step.

5. The method of claim 3 wherein:

the mated fastener tracks include a first track with a shorter flange having a free end mated to a second track with a longer flange;

the longer flange includes a reverse fold and an upper free end above the reverse fold and spaced from the shorter flange free end by a gap; and the step of mounting the first and the second fastener track flanges to the web material further includes a fusion sealing step of applying heat and pressure at two spaced apart points on either side of the gap to join portions of the first and the second fastener track flanges to a portion of the web material remote from the first edge.

6. The method of claim 1 wherein:

the mated fastener tracks include a first track with a shorter flange mated to second track with a longer flange;

the step of mounting the first and the second fastener track flanges to the intermediate portions of respective first and second package sidewalls comprises the step of providing a heat shield and inserting the heat shield between the flanges while applying heat and pressure.

7. The method of claim 1 wherein the mated fastener tracks include a first track with a shorter flange mated to second track with a longer flange and the step of mounting the first and the second fastener track flanges to the intermediate portions of the second track flange to the first package sidewall to form a peel seal having a sinuous, curved cross-section.

8. The method of claim 1 further comprising the step of forming a weakening line in at least one of said sidewalls extending across the mated fastener tracks, to a termination point below said mated fastener tracks.

9. The method of claim 8 further comprising the step of forming a tear line in at least one of said sidewalls along a line extending below said mated fastener tracks and intersecting said termination point.

10. The method of claim 1 wherein the first and the second package sidewalls have lower free ends, movable so as to be spaced apart from one another to form an opening for the introduction of tooling for assembly of the flexible packages.

11. The method of claim 1 wherein the steps of inserting the sliders on the mated fastener tracks between slider stop portions includes inserting the sliders between the previously formed slider stop portions after formation of the slider stop portions, reverse folding includes reverse-folding the web material following the mounting of the first and second fastener track flanges to the web material, and slitting the dead fold at the upper package portion end includes slitting the dead fold after formation of the reduced height side seals.

* * * * *

UNITED STATES PATENT AND TRADEMARK OFFICE

CERTIFICATE OF CORRECTION

PATENT NO. : 8,122,687 B2
APPLICATION NO. : 10/631630
DATED : February 28, 2012
INVENTOR(S) : Kinigakis et al.

It is certified that error appears in the above-identified patent and that said Letters Patent is hereby corrected as shown below:

In Claim 7, Column 29, Line 18; After "portions of" insert -- respective first and second package sidewalls includes the step of sealing a portion of --.

Signed and Sealed this
Seventh Day of August, 2012

David J. Kappos

David J. Kappos
*Director of the United States Patent and Trademark Office*